US007429439B2

(12) United States Patent
Toriyama et al.

(10) Patent No.: US 7,429,439 B2
(45) **Date of Patent: *Sep. 30, 2008**

(54) ELECTROPHOTOGRAPHIC PHOTORECEPTOR AND IMAGE FORMING APPARATUS PROVIDED WITH THE SAME

(75) Inventors: Koichi Toriyama, Yao (JP); Kotaro Fukushima, Kawanishi (JP); Takatsugu Obata, Nara (JP); Takuya Arimura, Higashiosaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 323 days.

This patent is subject to a terminal disclaimer.

(21) Appl. No.: 10/993,770

(22) Filed: Nov. 19, 2004

(65) Prior Publication Data

US 2005/0164107 A1 Jul. 28, 2005

(30) Foreign Application Priority Data

Nov. 19, 2003 (JP) ..... P2003-389669

(51) Int. Cl.
*G03G 5/047* (2006.01)

(52) U.S. Cl. ..... 430/58.85; 430/66; 430/72; 399/159

(58) Field of Classification Search ..... 430/58.65, 430/58.85, 73, 72, 66, 67; 399/159
See application file for complete search history.

(56) References Cited

U.S. PATENT DOCUMENTS 3,824,099 A 7/1974 Champ et al.

(Continued)

FOREIGN PATENT DOCUMENTS

| | | | |
|---|---|---|---|
| JP | 52-4188 | B2 | 2/1977 |
| JP | 54-150128 | A | 11/1979 |
| JP | 54-151955 | | 11/1979 |
| JP | 55-052063 | | 4/1980 |
| JP | 55-42380 | B2 | 10/1980 |
| JP | 58-32372 | B2 | 7/1983 |
| JP | 58-198043 | | 11/1983 |
| JP | 60-022131 | | 2/1985 |
| JP | 02-051162 | | 2/1990 |
| JP | 02-190862 | | 7/1990 |
| JP | 06-043674 | | 2/1994 |
| JP | 07-048324 | | 2/1995 |
| JP | 07-134430 | | 5/1995 |
| JP | 10-069107 | | 3/1998 |
| JP | 11-311875 | | 11/1999 |
| JP | 2003-012619 | * | 1/2003 |
| JP | 2004-004266 | | 1/2004 |
| JP | 2004-205542 | | 7/2004 |
| JP | 2004-325686 | * | 11/2004 |

OTHER PUBLICATIONS

Japanese Patent Office machine-assisted translation of JP 2004-325686 (pub. Nov. 18, 2004).*

(Continued)

*Primary Examiner*—Janis L Dote
(74) *Attorney, Agent, or Firm*—Edwards Angell Palmer & Dodge LLP; David G. Conlin; Dwight D. Kim

(57) ABSTRACT

An electrophotographic photoreceptor of excellent durability having high sensitivity and light responsiveness, not suffering from lowering of the electric characteristics by exposure to light, change of circumstance, or repetitive use, and excellent in the cleaning property and not suffering from lowering of the picture quality of formed images for a long times, in which an enamine compound represented by the general formula (1), for example, an enamine compound represented by the following structural formula (1-1) is incorporated in a photosensitive layer 14, and the surface energy (γ) on the surface of the photosensitive layer 14 is set to 20.0 mN/m or more and 35.0 mN/m or less, the electrophotographic photoreceptor 1:

(1)

(1-1)

5 Claims, 15 Drawing Sheets

U.S. PATENT DOCUMENTS

| | | | | |
|---|---|---|---|---|
| 4,123,269 | A | 10/1978 | Von Hoene et al. | |
| 4,150,987 | A | 4/1979 | Anderson et al. | |
| 4,278,747 | A | 7/1981 | Murayama et al. | |
| 4,338,388 | A | 7/1982 | Sakai et al. | |
| 4,367,273 | A | 1/1983 | Murayama et al. | |
| 4,724,194 | A | 2/1988 | Shirai et al. | |
| 4,859,556 | A | 8/1989 | Sasaki | |
| 4,892,949 | A | 1/1990 | Sasaki | |
| 5,430,526 | A * | 7/1995 | Ohkubo et al. | 399/159 |
| 5,900,342 | A * | 5/1999 | Visser et al. | 430/58.8 |
| 6,117,603 | A * | 9/2000 | Yu et al. | 430/66 |
| 6,171,742 | B1 | 1/2001 | Kawada et al. | |
| 7,074,531 | B2 * | 7/2006 | Fukushima et al. | 430/56 |
| 2004/0101770 | A1 * | 5/2004 | Obata et al. | 430/58.85 |
| 2004/0142258 | A1 * | 7/2004 | Fukushima et al. | 430/56 |

OTHER PUBLICATIONS

Japanese Patent Office machine-assisted translation of JP 2003-012619 (pub. Jan. 2003).*

USPTO English-language translation of JP 2003-12619A (pub. Jan. 2003).*

Diamond, A.S.et al., ed., Handbook of Imaging Materials, Second edition,Marcel Dekker, Inc., NY (2002), pp. 146-151.*

Kitazi T., Hata T., et al., "Extension of Fowe's Formula and Evaluation of Surface Tension of Polymeric Solid", Nippon Secchaku Kyokaishi, Nippon Secchaku Kyokai, 1972, vol. 8, No. 3, pp. 131-141.

* cited by examiner

ELECTROPHOTOGRAPHIC PHOTORECEPTOR AND IMAGE FORMING APPARATUS PROVIDED WITH THE SAME

BACKGROUND OF THE INVENTION

1. Field of the Invention

The present invention relates to an electrophotographic photoreceptor used for electrophotographic image formation and an image forming apparatus provided with the same.

2. Description of the Related Art

In electrophotographic image forming apparatus (hereinafter also referred to as an electrophotographic apparatus) used, for example, as a copying machine, a printer, or a facsimile apparatus, images are formed by way of the following electrophotographic process. At first, a photosensitive layer of an electrophotographic photoreceptor (hereinafter also referred to simply as a photoreceptor) provided in the apparatus is charged uniformly to a predetermined potential by a charger, and exposed to a light such as a laser light irradiated from exposure means in accordance with image information, to form electrostatic latent images. A developer is supplied from development means to the formed electrostatic latent images and colored fine particles referred to as toners which are a component of the developer are deposited on the surface of the photoreceptor to develop the electrostatic latent images and visualized as toner images. The formed toner images are transferred by transfer means from the surface of the photoreceptor to a transfer material, for example, recording paper and fixed by fixing means.

In the transfer operation by the transfer means, not all the toner on the surface of the photoreceptor are transferred and moved to the recording paper, but a portion thereof is remained on the surface of the photoreceptor. Further, a paper powder of the recording paper in contact with the photoreceptor during transfer sometimes remains being deposited as it is on the surface of the photoreceptor. Since obstacles such as residual toner and the deposited paper powder on the surface of the photoreceptor give undesired effects on the quality of the images to be formed, they are removed by a cleaning device. A cleanerless technique has been progressed in recent years and the residual toner is removed by a so-called development and cleaning system of recovering the same by a cleaning function added to the development means, with no independent cleaning means. After cleaning the surface of the photoreceptor as described above, the surface of the photosensitive layer is charge-eliminated by a charge eliminator to eliminate electrostatic latent images.

An electrophotographic photoreceptor used in such an electrophotographic process is constituted by laminating a photosensitive layer containing a photoconductive material on an conductive base body comprising a conductive material. As the electrophotographic photoreceptor, an electrophotographic photoreceptor using an inorganic photoconductive material (hereinafter referred to as an inorganic photoreceptor) has been used so far. Typical inorganic photoreceptor includes a selenium photoreceptor using a layer comprising an amorphous selenium (a-Se) or an amorphous selenium arsenide (a-AsSe) as a photosensitive layer, a zinc oxide or cadmium sulfide photoreceptor using zinc oxide (chemical formula: ZnO) or cadmium sulfide (chemical formula: CdS) together with a sensitizer such as a dye being dispersed in a resin as the photosensitive layer, and an amorphous silicon photoreceptor (hereinafter referred to as a-Si photoreceptor) using a layer comprising amorphous silicone (a-Si) as a photosensitive layer.

However, the inorganic photoreceptor has the following drawbacks. The selenium photoreceptor and the cadmium photoreceptor have drawbacks in view of the heat resistance and the store stability. Further, since selenium and cadmium have toxicity to human bodies and environments, the photoreceptors using them have to be recovered and discarded properly after use. Further, the zinc oxide photoreceptor has a drawback that it has low sensitivity and low durability and is scarcely used at present. Further, while the a-Si photoreceptor attracting attention as the inorganic photoreceptor with no public pollution has advantages such as high sensitive and high durability but since this is manufactured by using a plasma chemical vapor deposition method, it is difficult to uniformly deposit the film of the photosensitive layer and has a drawback tending to cause image defects. Further, the a-Si photoreceptor also has a drawback of low productivity and high manufacturing cost.

As described above, since the inorganic photoreceptor involves many drawbacks, development has progressed for the photoconductive material used for the electrophotographic photoreceptor, and organic photoconductive materials (that is, Organic Photoconductor: abbreviated as: OPC) have been now used frequently instead of the inorganic photoconductive materials used so far. While the electrophotographic photoreceptor using the organic photoconductive material (hereinafter referred to as organic photoreceptor) involves some problems in view of the sensitivity, durability and stability to environment, it has various advantages compared with the inorganic photoreceptor in view of the toxicity, the production cost and the degree of freedom for the material design. Further, the organic photoreceptor also has an advantage that the photosensitive layer can be formed by an easy and inexpensive method typically represented by a dip coating method. Since the organic photoreceptor has such various advantages, it has now gradually been predominant in the electrophotographic photoreceptors. Further, the sensitivity and the durability of the organic photoreceptor has been improved by the research and development in recent years and the organic photoreceptor has been used at present as the electrophotographic photoreceptor except for special cases.

organic photoreceptors are being developed by the development of function-separated electrophotographic photoreceptors of which charge-generating function and charge-transporting function thereof are separately attained by different substances. In addition to the above-mentioned advantages of organic photoreceptors, such function-separated photoreceptors have broad latitude in selecting the materials constituting photosensitive layer and have an advantage in that those having any desired characteristics are relatively readily produced.

The function separated type photoreceptor includes a lamination type and a single layer type. In the lamination type function separated photoreceptor, a lamination type photosensitive layer constituted by lamination of a charge-generating layer containing a charge-generating substance for charge generating function and a charge-transporting layer containing a charge-transporting substance for charge-transporting function is provided. The charge-generating layer and the charge-transporting layer are usually formed such that the charge-generating substance and the charge-transporting substance are formed respectively being dispersed in binder resins as the binding agent. Further, in the single layer type function-separated photoreceptor, a photosensitive layer of a single layer type formed by dispersing the charge-generating substance and the charge-transporting substance in a binder resin together is provided.

A variety of substances have heretofore been investigated for the charge-generating substances that may be used in the function-separated photoreceptors, including, for example, phthalocyanine pigments, squarylium dyes, azo pigments, perylene pigments, polycyclic quinone pigments, cyanine dyes, squaric acid dyes and pyrylium salt dyes, and various materials of good light fastness and good charge-generating ability have been proposed.

On the other hand, various compounds are known for the charge-transporting substances, including, for example, pyrazoline compounds (e.g., refer to Japanese Examined Patent Publication JP-B2 52-4188 (1977)), hydrazone compounds (e.g., refer to Japanese Unexamined Patent Publication JP-A 54-150128 (1979), Japanese Examined Patent Publication JP-B2 55-42380 (1980), and Japanese Unexamined Patent Publication JP-A 55-52063 (1980)), triphenylamine compounds (e.g., refer to Japanese Examined Patent Publication JP-B2 58-32372 (1983) and Japanese Unexamined Patent Publication JP-A 2-190862 (1990)) and stilbene compounds (e.g., refer to Japanese Unexamined Patent Publications JP-A 54-151955 (1979) and JP-A 58-198043 (1983)). Recently, pyrene derivatives, naphthalene derivatives and terphenyl derivatives that have a condensed polycyclic hydrocarbon structure as the center nucleus have been developed (e.g., refer to Japanese Unexamined Patent Publication JP-A 7-48324 (1995)).

The charge-transporting substances must satisfy the following requirements:

(1) they are stable to light and heat;

(2) they are stable to active substances such as ozone, nitrogen oxides (NOx) and nitric acid that may be generated in corona discharging on a photoreceptor;

(3) they have good charge-transporting ability;

(4) they are compatible with organic solvents and binder resins;

(5) they are easy to produce and are inexpensive. Though partly satisfying some of these, however, the charge-transporting substances disclosed in the above-mentioned patent publications could not satisfy all of these at high level.

Further, in recent years, higher sensitivity is required for the photoreceptor characteristic corresponding to the requirement for reduction of the size and increase of the operation speed to electrophotographic apparatus such as a digital copying machines and a printer, and a particularly high charge-transporting ability is demanded for the charge transpiration substance. Further, in a high speed electrophotographic process, since the time from the exposure to the development is short, it has been demanded for a photoreceptor of excellent light responsiveness. In a case where the light responsiveness of the photoreceptor is low, that is, the decaying speed for the surface potential after exposure is slow, the residual potential increases and the photoreceptor is used repetitively in a state where the surface potential is not decayed sufficiently, the surface charges at a portion to be eliminated are not eliminated sufficiently by exposure to bring about a drawback such as lowering of the image quality in the early stage. In the function separated type photoreceptor, since charges generated by the charge-generating substance due to light absorption are transported by the charge transpiration substance to the surface of the photosensitive layer thereby eliminating the surface potential of the photoreceptor at a portion irradiated with a light, the light responsiveness depends on the charge-transporting ability of the charge transpiration substance. Accordingly, a high charge-transporting ability is required for the charge-transporting substance also in view of attaining a photoreceptor having a sufficient light responsiveness.

For the charge-transporting substances that satisfy the requirement, proposed are enamine compounds having higher charge-transporting ability than that of the charge-transporting substances disclosed in the above-mentioned patent publications (e.g., refer to Japanese Unexamined Patent Publications JP-A 2-51162 (1990), JP-A 6-43674 (1994) and JP-A 10-69107 (1998)). Further, in another related art, incorporation of polysilane and an enamine compound having a specified structure to a photosensitive layer is proposed for improving hole-transporting ability of the photoreceptor (for example, refer to Japanese Unexamined Patent Publication JP-A No. 7-134430 (1995)).

Further, in the electrophotographic apparatus, since the operations of charging, exposure, development, transfer, cleaning and charge elimination to the photoreceptor are conducted repetitively, the photoreceptor is required to be excellent in the durability to electrical and mechanical external forces in addition to high sensitivity and excellent light responsiveness. Specifically, it has been demanded that abrasion and injury are not caused by friction with a cleaning material or the like to the surface layer of the photoreceptor and it is not degraded by deposition of active substance such as ozone and $NO_x$ generated upon electric discharge during the charged state.

In order to realize cost reduction and maintenance-free condition of the electrophotographic image forming apparatus, it is important that the electrophotographic photoreceptor has satisfactory durability and can be operated stably for a long period of time. One of factors that influences the durability and the long-term stability of the operation is surface cleanability, namely, ease of surface cleaning which is related with the surface condition of the electrophotographic photoreceptor.

The cleaning of the electrophotographic photoreceptor means that a force exceeding adhesion between the surface of the electrophotographic photoreceptor and the remaining toner or paper powder adhered is exerted on foreign matters such as the remaining toner or paper powder to remove the adherent matter from the surface of the electrophotographic photoreceptor. Accordingly, the lower the wettability of the surface of the electrophotographic photoreceptor becomes, the easier the cleaning becomes. The wettability, namely, the adhesion of the surface of the electrophotographic photoreceptor can be expressed using a surface free energy (which has the same meaning as a surface tension) as an index.

The surface free energy ($\gamma$) is a phenomenon which an intermolecular force, a force acting between molecules constituting a substance, causes on the outermost surface.

A toner that remains on the surface of the electrophotographic photoreceptor by adhesion or fusion without being transferred onto a transfer member is spread on the surface of the electrophotographic photoreceptor in the form of a film while steps from charging to cleaning are repeated. This phenomenon corresponds to "adhesion wettability" in the wettability. Further, a phenomenon in which a paper powder, a rosin, talc or the like is adhered to the surface of the photographic photoreceptor and the contact area with the electrophotographic photoreceptor is then increased to provide strong wettability also corresponds to "adhesion wettability".

FIG. 17 is a side view showing a state of adhesion wettability. In the adhesion wettability shown in FIG. 17, the relation between the wettability and the surface free energy ($\gamma$) is represented by Young's formula (I).

$$\gamma_1 = \gamma_2 \cdot \cos\theta + \gamma_{12} \quad \text{(I)}$$

wherein $\gamma_1$: surface free energy on a surface of material 1

$\gamma_2$: surface free energy on a surface of material 2

$\gamma_{12}$: interface free energy of materials 1 and 2

$\theta$: contact angle of material 2 to material 1

In the formula (I), reduction in wettability of material 2 to material 1 which means that $\theta$ is increased for less wetting is attained by increasing the interface free energy $Y_{12}$ related with a wetting work of the electrophotographic photoreceptor and the foreign matters and decreasing the surface free energies $\gamma_1$ and $\gamma_2$.

When adhesion of foreign matters, water vapor and the like to the surface of the electrophotographic photoreceptor is considered in the formula (I), material 1 corresponds to the electrophotographic photoreceptor and material 2 to foreign matters respectively. Accordingly, when the electrophotographic photoreceptor is actually cleaned, the wettability on the right side of the formula (I), namely, the adhered condition of the toner, paper powder and the like as foreign matters to the electrophotographic photoreceptor can be controlled by controlling the surface free energy $\gamma_1$ of the electrophotographic photoreceptor.

In the related art that defines a surface condition of an electrophotographic photoreceptor, a contact angle with pure water is used (refer to, for example, Japanese Unexamined Patent Publication JP-A 60-22131 (1985)). However, in regard to wetting of a solid and a liquid, the contact angle $\theta$ can be measured as shown in FIG. 17, but in case of a solid and a solid such as an electrophotographic photoreceptor and a toner or a paper powder, the contact angle $\theta$ cannot be measured. Accordingly, the foregoing related art disclosed in JP-A 60-22131 can be applied to wettability between a surface of an electrophotographic photoreceptor and pure water, but a relation between wettability and cleanability of a solid such as a toner constituting a developer or a paper powder cannot be explained satisfactorily.

The wettability between solids can be represented by an interface free energy between solids. With respect to the interface free energy between solids, the Fowkes's theory stating a non-polar intermolecular force is considered to be further extended to a component formed by a polar or hydrogen-bonding intermolecular force (refer to Kitazaki T., Hata T., et al.; "Extension of Fowkes's Formula and Evaluation of Surface Tension of Polymeric Solid", Nippon Secchaku Kyokaishi, Nippon Secchaku Kyokai, 1972, vol. 8, No. 3, pp. 131-141). According to this extended Fowkes's theory, the surface free energy of each material is found from 2 to 3 components. The surface free energy in the adhesion wettability corresponding to the adhesion of the toner or the paper powder to the surface of the electrophotographic photoreceptor can be found from 3 components.

The surface free energy between solid materials is described below. In the extended Fowkes's theory, an addition rule of the surface free energy represented by formula (II) is assumed to be established.

$$\gamma=\gamma^d+\gamma^p+\gamma^h \quad \text{(II)}$$

in which $\gamma^d$: dipole component (polar wettability)

$\gamma^p$: dispersion component (non-polar wettability)

$\gamma^h$: hydrogen-bonding component (hydrogen-bonding wettability).

When the rule of addition of the formula (II) is applied to the Fowkes's theory, the interface free energy $\gamma_{12}$ between substance 1 and substance 2, both of which are solids, is determined as in the following formula (III).

$$\gamma_{12}=\gamma_1+\gamma_2-\{2\sqrt{(\gamma_1^d\cdot\gamma_2^d)}+2\sqrt{(\gamma_1^p\cdot\gamma_2^p)}+2\sqrt{(\gamma_1^h\cdot\gamma_2^h)}\} \quad \text{(III)}$$

in which $\gamma_1$: surface free energy of material 1

$\gamma_2$: surface free energy of material 2

$\gamma_1^d$, $\gamma_2^d$: dipole components of material 1 and material 2

$\gamma_1^p$, $\gamma_2^p$: dispersion components of material 1 and material 2

$\gamma_1^h$, $\gamma_2^h$: hydrogen-bonding components of material 1 and material 2

The surface free energies ($\gamma^d$, $\gamma^p$, $\gamma^h$) of the components in the solid materials to be measured as represented by the formula (II) can be calculated by using known reagents and measuring adhesion with the reagents. Accordingly, with respect to material 1 and material 2, it is possible that the surface free energies of the components are found and the interface free energy of material 1 and material 2 can be found from the surface free energies of the components using the formula (III).

On the basis of the concept of the solid-solid interface free energy found in this manner, another related art controls wettability of a surface of an electrophotographic photoreceptor and a toner or the like using a surface free energy of the electrophotographic photoreceptor as an index (refer to Japanese Unexamined Patent Publication JP-A 11-311875 (1999). JP-A 11-311875 discloses that a surface free energy is defined in the range of from 35 to 65 mN/m to improve cleanability of a surface of an electrophotographic photoreceptor and realize a long life thereof.

According to the present inventors' investigations, however, in the test of photography in which an image is actually formed on, for example, a recording paper using an electrophotographic photoreceptor having the surface free energy in the range disclosed in JP-A 11-311875, damage considered to occur by contact with foreign matters such as a paper powder and the like is confirmed on the surface of the electrophotographic photoreceptor. Further, it is also confirmed that owing to insufficient cleaning caused by this damage, black streaks occurred on images transferred on the recording paper. There is a tendency that the damage generated on the surface of the electrophotographic photoreceptor is increased with the increase in surface free energy.

In still another technique, an amount ($\Delta\gamma$) of change in surface free energy according to duration of an electrophotographic photoreceptor is defined. However, in consideration of the facts that the amount ($\Delta\gamma$) of change is not determined by defining initial characteristics, for example, the surface free energy, of the electrophotographic photoreceptor and the amount ($\Delta\gamma$) of change varies depending on conditions such as an environment in image formation and a material of a transfer member, the amount ($\Delta\gamma$) of change is problematic in that it might include an uncertain element and is therefore inappropriate as a designing standard in actual designing of an electrophotographic photoreceptor.

Further, in an organic photoreceptor, in order to control the surface free energy on the surface of the photoreceptor as in the technique disclosed in JP-A 11-311875, it is necessary to control the kind and the blending amount of a binder resin used for the photosensitive layer as a surface layer. However, this results in a problem that the sensitivity and the light responsiveness of the photoreceptor are lowered depending on the kind or the blending amount of the binder resin.

Since the sensitivity and the light responsiveness of the photoreceptor depends on the charge-transporting ability of the charge-transporting substance as described above, it is considered that lowering of the sensitivity and the light responsiveness can be suppressed by using a charge-transporting substance of high charge-transporting ability. However, the charge-transporting ability of the enamine compound as disclosed in JP-A 2-51162, JP-A 6-43674 or JP-A 10-69107 is insufficient and no sufficient sensitivity and light responsiveness can be obtained even by the use of the enamine compounds. Particularly, no sufficient light responsiveness can be maintained under a low temperature circumstance, and image having practically sufficient image density can not be formed. Further, as in the photoreceptor disclosed in JP-A 7-134430, it may be considered to incorporate a polysilane and an enamine compound having a specified structure. However, a photoreceptor using the polysilane is sensible to light exposure, and brings about another problem of lowering the various characteristics as the photoreceptor when exposed to light, for example, during maintenance.

That is, even the combination of the constitution of the photoreceptor disclosed in JP-A 11-311875 and the constitution of a photoreceptor disclosed in JP-A 2-51162, JP-A 6-43674, JP-A 10-69107 or JP-A 7-134430 can not attain a photoreceptor that has excellent durability having high sensitivity and light responsiveness, excellent circumstantial stability with less change of electric characteristics caused by fluctuation of the circumstance, as well as excellent cleaning property and is capable of providing images of high quality for a long period of time.

SUMMARY OF THE INVENTION

An object of the invention is to provide an electrophotographic photoreceptor that has excellent durability having high sensitivity and a sufficient light responsiveness, with the electric characteristics being not deteriorated by any of exposure to light and change of circumstance, and that, during repetitive use, is excellent in the cleaning property, causes less surface injury even in long time use and causes no deterioration of picture quality of the formed images.

The invention provides an electrophotographic photoreceptor comprising:

a conductive base body; and a photosensitive layer provided on the conductive base body, in which a uniformly charged photosensitive layer is exposed to a light according to image information to form an electrostatic latent image, wherein the photosensitive layer contains an enamine compound represented by the following general formula (1), and the surface free energy (γ) on a surface thereof is in a range of 20.0 mN/m or more and 35.0 mN/m or less.

(1)

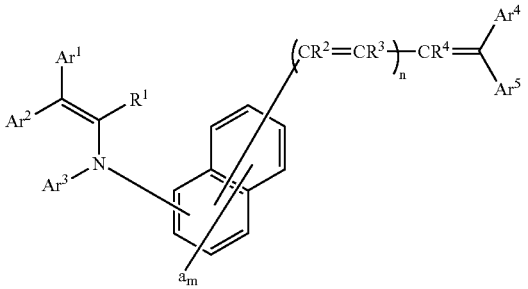

wherein $Ar^1$ and $Ar^2$ each represent an optionally-substituted aryl group or an optionally-substituted heterocyclic group; $Ar^3$ represents an optionally-substituted aryl group, an optionally-substituted heterocyclic group, an optionally-substituted aralkyl group, or an optionally-substituted alkyl group; $Ar^4$ and $Ar^5$ each represent a hydrogen atom, an optionally-substituted aryl group, an optionally-substituted heterocyclic group, an optionally-substituted aralkyl group, or an optionally-substituted alkyl group, but it is excluded that $Ar^4$ and $Ar^5$ are hydrogen atoms at the same time; $Ar^4$ and $Ar^5$ may bond to each other via an atom or an atomic group to form a cyclic structure; "a" represents an optionally-substituted alkyl group, an optionally-substituted alkoxy group, an optionally-substituted dialkylamino group, an optionally-substituted aryl group, a halogen atom, or a hydrogen atom; m indicates an integer of from 1 to 6; when m is 2 or more, then the "a"s may be the same or different and may bond to each other to form a cyclic structure; $R^1$ represents a hydrogen atom, a halogen atom, or an optionally-substituted alkyl group; $R^2$, $R^3$ and $R^4$ each represent a hydrogen atom, an optionally-substituted alkyl group, an optionally-substituted aryl group, an optionally-substituted heterocyclic group, or an optionally-substituted aralkyl group; n indicates an integer of from 0 to 3; when n is 2 or 3, then the $R^2$s may be the same or different and the $R^3$s may be the same or different, but when n is 0, $Ar^3$ is an optionally-substituted heterocyclic group.

Further, in the invention, the enamine compound represented by the general formula (1) is an enamine compound represented by the following general formula (2).

(2)

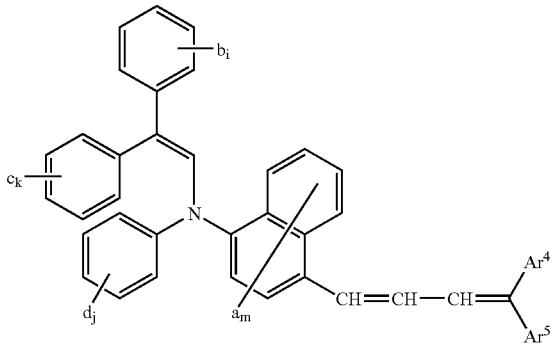

wherein b, c and d each represent an optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure; $Ar^4$, $Ar^5$, "a" and "m" represent the same as those defined in formula (1).

Further, in the invention, the surface free energy (γ) is in a range of 28.0 mN/m or more and 35.0 mN/m or less.

Further, in the invention, the photosensitive layer is constituted by laminating a charge-generating layer containing a charge-generating substance and a charge-transporting layer containing a charge-transporting substance containing an enamine compound represented by the general formula (1).

Further, the invention provides an image forming apparatus comprising:

the electrophotographic photoreceptor mentioned above, charging means for charging the electrophotographic photoreceptor, exposure means for exposing the charged electrophotographic photoreceptor to a light according to image information thereby forming an electrostatic latent image, developing means for developing the electrostatic latent image to form a toner image, transfer means of transferring the toner image from a surface of the electrophotographic photoreceptor to a material to be transferred, and cleaning means for cleaning the surface of the electrophotographic photoreceptor after transfer of the toner image.

According to the invention, in the photosensitive layer of the electrophotographic photoreceptor is incorporated with the enamine compound represented by the general formula (1), preferably, the enamine compound represented by the general formula (2) as a charge-transporting substance. Further, the surface of the electrophotographic photoreceptor is set such that the surface free energy (γ) is in a range of 20.0 mN/m or more and 35.0 mN/m or less, preferably, 28.0 mN/m or more and 35.0 mN/m or less. The surface free energy on the surface of the electrophotographic photoreceptor referred to herein is derived by calculation from the Forkes's expanded theory described above.

The surface free energy on the surface of the electrophotographic photoreceptor is an index of the wettability, that is, the adhesion, for example, of a developer or paper dust to the surface of the electrophotographic photoreceptor. When the surface free energy on the surface of the electrophotographic photoreceptor is set within the preferred range described above, it is possible to suppress excess adhesion particularly to the developer irrespective of provision of the adhesion to an extent necessary for development and suppress the adhesion to obstacles such as the paper dust. Therefore, foreign matters such as excess developer can be removed easily from the surface of the electrophotographic photoreceptor. In this way, it is possible to improve the cleaning property without lowering the developing performance. Accordingly, since injuries due to foreign matters adhering on the surface less occur, an electrophotographic photoreceptor of excellent durability having long life and causing no degradation of quality to the formed images stably for a long time can be attained.

Further, the enamine compound represented by the general formula (1) contained in the photosensitive layer has high charge-transporting ability. Further, among the enamine compounds represented by the general formula (1), the enamine compounds represented by the general formula (2) have particularly high charge-transporting ability. Accordingly, by setting the surface free energy on the surface of the electrophotographic photoreceptor to the range described above and incorporating the enamine compound represented by the general formula (1), preferably, the enamine compound represented by the general formula (2) in the photosensitive layer, an electrophotographic photoreceptor that has excellent durability having high sensitivity and sufficient light responsiveness, with the electric characteristics being not deteriorated even by any of the exposure to light and change of circumstance or repetitive use, and that is excellent in the cleaning property, causes less surface injuries even during long use and causes no degradation of picture quality to the formed images can be attained.

As described above, according to the invention, it is possible to provide an electrophotographic photoreceptor that is excellent in all of the electric characteristics, circumstantial stability and cleaning property.

Further, according to the invention, the photosensitive layer of the electrophotographic photoreceptor is constituted by laminating a charge-generating layer containing a charge-generating substance and a charge-transporting layer containing a charge-transporting substance containing the enamine compound represented by the general formula (1). As described above, with the lamination type constituted by laminating a plurality of photosensitive layers, since the degree of freedom for the materials constituting each of the layers and the combination thereof is increased, the surface free energy value on the surface of the electrophotographic photoreceptor can be easily set to a desired range. Further, since the charge-generating function and the charge-transporting function can be provided to separate layers as described above, materials optimal to the charge-generating function and the charge-transporting function respectively can be selected as the materials for constituting each of the layers. Therefore, an electrophotographic photoreceptor having particularly high sensitivity can be attained.

Further, according to the invention, the image forming apparatus is provided with an electrophotographic photoreceptor excellent in all of the electric characteristic, the circumstantial stability and the cleaning property. Accordingly, an image forming apparatus can be provided such that images with no degradation of the picture quality can be formed stably over a long time under various circumstances and a cost is low and maintenance frequency is less. Further, the electric characteristics of the electrophotographic photoreceptor provided to the image forming apparatus are not deteriorated even when exposed to light, and therefore lowering of the picture quality attributable to the exposure of the electrographic photoreceptor to light, for example, during maintenance can be suppressed.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
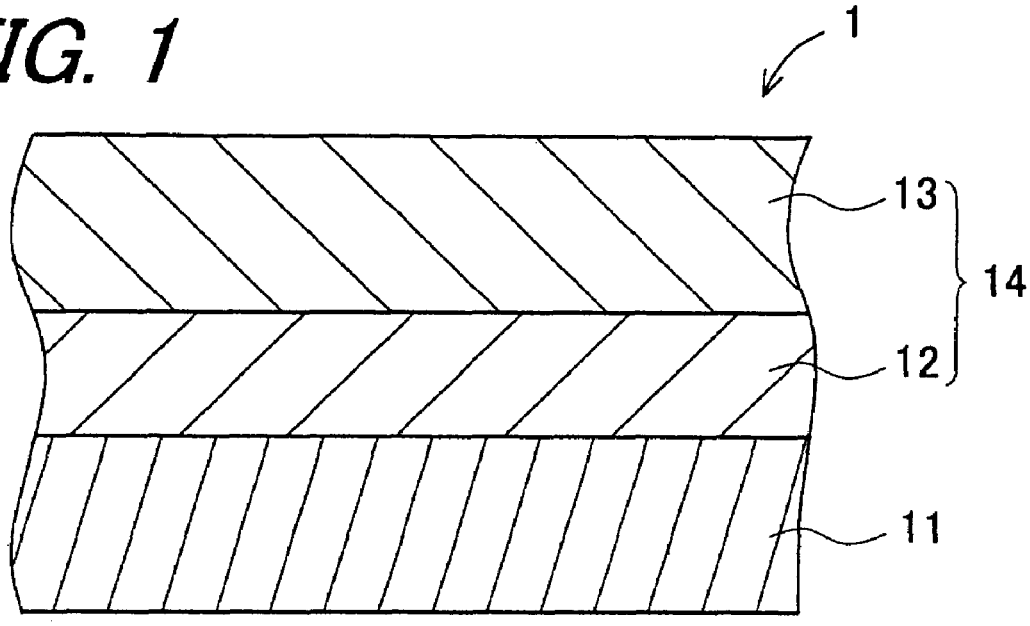
FIG. 1 is a partial cross sectional view schematically showing the constitution of an electrophotographic photoreceptor according to a first embodiment of the invention.

Now referring to the drawings, preferred embodiments of the invention are described below.

FIG. 1 is a partial cross sectional view schematically showing the constitution of an electrophotographic photoreceptor 1 according to a first embodiment of the invention. The electrophotographic photoreceptor 1 of this embodiment (hereinafter simply referred to as photoreceptor) includes a cylindrical conductive base body 11 made of a conductive material, a charge-generating layer 12 containing a charge-generating substance and a charge-transporting layer 13 containing a charge-transporting substance. The charge-generating layer 12 is a layer laminated on an outer circumferential surface of the conductive base body 11. The charge-transporting layer 13 is a layer further laminated on the charge-generating layer 12. The charge-generating layer 12 and the charge-transporting layer 13 constitute a photosensitive layer 14. That is, the photoreceptor 1 is a lamination type photoreceptor.

The conductive base body 11 serves as an electrode for the photoreceptor 1 and also functions as a support member for each of other layers 12 and 13. Though the conductive base body 11 is formed in a cylindrical shape in this embodiment, this is not restricted thereto but may be, for example, a column-like, sheet-like or endless belt shape.

As the conductive material constituting the conductive base body 11, an elemental metal such as aluminum, copper, zinc or titanium, or an alloy such as an aluminum alloy or stainless steel can be used. Further, with no restriction to the metal materials described above, those laminated with a metal foil, those vapor deposited with a metal material, or those vapor deposited or coated with a conductive compound such as a conductive polymer, tin oxide or indium oxide on a surface of polymeric materials such as polyethylene terephthalate, nylon and polystyrene, hard paper or glass can also be each used. The conductive materials can be used being fabricated into a predetermined shape.

On a surface of the conductive base body 11, anodized film treatment, surface treatment with chemicals or hot water, coloring treatment or diffuse reflection treatment such as surface roughening may be applied optionally within a range not giving effects on the picture quality. In the electrophotographic process using laser as an exposure light source, since the wavelength of the laser light is uniform, laser light reflected on the surface of the photoreceptor and laser light reflected inside the photoreceptor may sometimes cause interference and interference fringes caused by the interference appear on the images to form image defects. By applying the treatment described above to the surface of the conductive base body 11, image defects caused by the interference of the laser light having uniform wavelength can be prevented.

The charge-generating layer 12 chiefly contains a charge-generating substance for generating charges by absorbing a light. A substance effective as the charge-generating substance includes organic photoconductive materials, for example, azo pigments such as monoazo pigments, bisazo pigments and trisazo pigments, indigo pigments such as indigo and thioindigo, perylene pigment such as perylene imide and perylene acid anhydride, polycyclic quinone pigments such as anthraquinone and pyrene quinone, phthalocyanine pigments such as metal phthaloycyanine and non-metal phthalocyanine, and squalirium dye, pirylium salts and thiopirylium salts and triphenylmethane dyes, and inorganic photoconductive materials such as selenium and amorphous silicone. These charge-generating substances may be used each alone or as a combination of two or more of them.

Among the charge-generating substances described above, it is preferred to use an oxotitanium phthalocyanine compound represented by the following general formula (A).

(A)

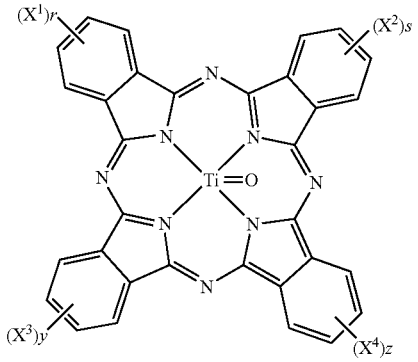

In the general formula (A) $X^1$, $X^2$, $X^3$ and $X^4$ each represent a hydrogen atom, halogen atom, alkyl group or alkoxy group, r, s, y and z each represent an integer of from 0 to 4.

The oxotitanium phthalocyanine compound represented by the general formula (A) is a charge-generating substance having a high charge generation efficiency and a high charge injection efficiency. Therefore, it generates large amount of charges by absorbing a light, and injects the generated charges efficiently to the charge-transporting substance contained in the charge-transporting layer 13, without being accumulated therein. Further, as described later, since the enamine compound represented by the general formula (1), preferably, general formula (2) having high charge moveability contained in the charge-transporting layer 13 is used for the charge-transporting substance in the embodiment of the invention. Accordingly, the charges generated in the oxotitanium phthalocyanine compound represented by the general formula (A) as the charge-generating substance by absorption of a light is injected effectively to the enamine compound represented by the general formula (1), preferably, the general formula (2) as the charge-transporting substance and transported smoothly to the surface of the photosensitive layer 14. Accordingly, a photoreceptor 1 having high sensitivity and high resolution is obtained by using the oxotitanium phthalocyanine compound represented by the general formula (A) as the charge-generating substance and the enamine compound represented by the general formula (1), preferably, the general formula (2) to be described later as the charge-transporting substance.

The oxotitanium phthalocyanine compound represented by the general formula (A) can be produced by a production process known so far such as a process described in "Phthalocyanine Compound" written by Moser and Thomas. For example, among oxotitanium phthalocyanine compounds represented by the general formula (A), oxotitanium phthalocyanine in which $X^1$, $X^2$, $X^3$ and $X^4$ each represents a hydrogen atom is obtained by synthesizing dichlorotitanium phthalocyanine by melting under heating of phthalonitrile and titanium tetrachloride or reacting them under heating in an appropriate solvent such as α-chloronaphthalene, and thereafter hydrolyzing the same with a base or water. Further, the oxotitanium phthalocyanine can also be produced by reacting under heating isoindoline and titanium tetraalkoxide such as tetrabuthoxytitanium in an appropriate solvent such as N-methylpyrrolidone.

The charge-generating substance may also be used in combination with sensitizing dyes such as triphenyl methane dyes typically represented by methyl violet, crystal violet, night blue and Victoria blue, an acridine dyes typically represented by erythrocin, rhodamine B, rhodamine 3R, acridine orange and flapeocin, thiazine dyes typically represented by methylene blue and methyl green, oxadine dyes typically represented by capriblue and Meldora's blue, cyanine dyes, styryl dyes, pyrylium salt dyes or thiopyrylium salt dyes.

A method of forming the charge-generating layer 12 usable herein can include a method of vapor-depositing the charge-generating substance on the surface of the conductive base body 11 or a method of coating a coating liquid for charge-generating layer obtained by dispersing the charge-generating substance described above in an appropriate solvent on the surface of the conductive base body 11. Among them, preferably used is a method of dispersing the charge-generating substance in a binder resin solution obtained by mixing a binder resin as a binder in a solvent by a method known so far to prepare a coating liquid for charge-generating layer and coating the obtained coating liquid on the surface of the conductive base body 11. Explanation will be made to the method below.

The binder resin to be used for the charge-generating layer 12 can include, for example, resins such as polyester resin, polystyrene resin, polyurethane resin, phenol resin, alkyd resin, melamine resin, epoxy resin, silicone resin, acryl resin, methacryl resin, polycarbonate resin, polyarylate resin, phenoxy resin, polyvinyl butyral resin and polyvinyl formal resin and copolymer resins containing two or more repetitive units constituting these resins. Specific examples of the copolymer resin can include insulating resins such as vinyl chloride-vinyl acetate copolymer resin, vinyl chloride-vinyl acetate-maleic acid anhydride copolymer resin and acrylonitrile-styrene copolymer resin. The binder resin is not limited to them, but generally used resins can e used as a binder resin. These resins can be used alone or two or more of them may be used as a mixture.

As a solvent for the coating liquid for charge-generating layer, for example, halogenated hydrocarbons such as dichloromethane or dichloroethane, ketones such as acetone, methyl ethyl ketone or cyclohexanone, esters such as ethyl acetate or butyl acetate, ethers such as tetrahydrofuran or dioxane, alkylethers of ethylene glycol such as 1,2-dimethoxyethane, aromatic hydrocarbons such as benzene, toluene or xylene, or aprotonic polar solvents such as N,N-dimethyl formamide or N,N-dimethylacetoamide, etc, are used. Among the solvents, non-halogen based organic solvents are preferably used in view of the global environment. The solvents may be used alone or two or more of them may be mixed and used as a mixed solvent.

In the charge-generating layer 12 constituted by containing the charge-generating substance and the binder resin, a ratio W1/W2 between a weight W1 of charge-generating substance and a weight W2 of binder resin is preferably in a range of 10/100 or more and 99/100 or less. In a case where the ratio W1/W2 is less than 10/100, the sensitivity of the photoreceptor 1 is lowered. In a case where the ratio W1/W2 exceeds 99/100, since not only the film strength of the charge-generating layer 12 is lowered but also the dispersibility of charge-generating substance is lowered to increase the coarse particles, surface charges in the portions other than those to be eliminated by exposure are decreased to increase image defects, particularly, fogging of images referred to as black spots formed as minute black spots by the adhesion of the toner on the white background. Accordingly, the preferred range for the ratio W1/W2 is defined as 10/100 or more and 99/100 or less.

The charge-generating substance may be pulverized previously by a pluverizer before dispersion in a binder resin solution. The pluverizer used for the pulverization can include, for example, a ball mill, sand mill, attritor, vibration mill and supersonic dispersing machine.

The dispersing machine used upon dispersion of the charge-generating substance in the binder resin solution can include, for example, a paint shaker, ball mill or sand mill. As the dispersion condition in this case, appropriate conditions are selected so that impurities are not mixed, for example, by abrasion of members constituting a vessel and a dispersing machine to be used.

The coating method of the coating liquid for charge-generating layer can include, for example, spray methods, bar coat methods, roll coat methods, blade methods, wring methods or dip coating methods. Among the coating methods, an optimal method can be selected while taking the physical property of coating and productivity into consideration. Among the coating methods, particularly, the dip coating method is used frequently in a case of producing electrophotographic photoreceptors. This is because Since this method is relatively simple and excellent in view of the productivity and the cost. It is noted that this method is a method of dipping a base body to a coating tank filled with a coating liquid and then pulling up it at a constant speed or a successively changing speed thereby forming a layer on the surface of the base body. As the apparatus used for the dip coating method, a coating liquid dispersion apparatus typically represented by a supersonic wave generation apparatus may also be provided.

The thickness of the charge-generating layer 12 is, preferably, in a range of 0.05 μm or more and 5 μm or less, more preferably, 0.1 μm or more and 1 μm or less. In a case where the thickness of the charge-generating layer 12 is less than 0.05 μm, the light absorption efficiency is lowered to lower the sensitivity of the photoreceptor 1. In a case where the thickness of the charge-generating layer 12 exceeds 5 μm, charge transfer inside the charge-generating layer 12 forms a rate-determining step in the process of eliminating the surface charges of the photosensitive layer 14 to lower the sensitivity of photoreceptor 1. Accordingly, suitable range for the thickness of the charge-generating layer 12 is defined as 0.05 μm or more and 5 μm or less.

The charge-transporting layer 13 is provided on the charge-generating layer 12. The charge-transporting layer 13 can be constituted with a charge-transporting substance having a function of receiving charges generated from the charge-generating substance contained in the charge-generating layer 12 and transporting them and a binder resin for binding charge-transporting substance. In this embodiment, an enamine compound represented by the following general formula (1) is used as the charge-transporting substance.

(1)

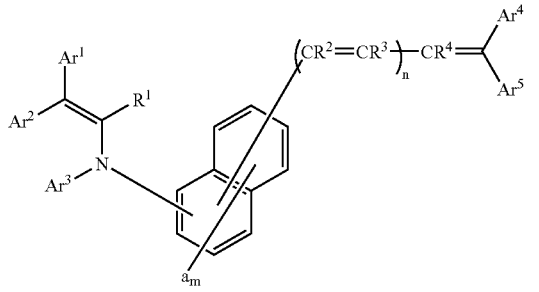

In the general formula (1), $Ar^1$ and $Ar^2$ each represent an optionally-substituted aryl group or an optionally-substituted heterocyclic group; $Ar^3$ represents an optionally-substituted aryl group, an optionally-substituted heterocyclic group, an optionally-substituted aralkyl group, or an optionally-substituted alkyl group; $Ar^4$ and $Ar^5$ each represent a hydrogen atom, an optionally-substituted aryl group, an optionally-substituted heterocyclic group, an optionally-substituted aralkyl group, or an optionally-substituted alkyl group, but it is excluded that $Ar^4$ and $Ar^5$ are hydrogen atoms at the same time; $Ar^4$ and $Ar^5$ may bond to each other via an atom or an atomic group to form a cyclic structure; "a" represents an optionally-substituted alkyl group, an optionally-substituted alkoxy group, an optionally-substituted dialkylamino group, an optionally-substituted aryl group, a halogen atom, or a hydrogen atom; m indicates an integer of from 1 to 6; when m is 2 or more, then the "a"s may be the same or different and may bond to each other to form a cyclic structure; $R^1$ represents a hydrogen atom, a halogen atom, or an optionally-substituted alkyl group; $R^2$, $R^3$ and $R^4$ each represent a hydrogen atom, an optionally-substituted alkyl group, an optionally-substituted aryl group, an optionally-substituted heterocyclic group, or an optionally-substituted aralkyl group; n indicates an integer of from 0 to 3; when n is 2 or 3, then the $R^2$s may be the same or different and the $R^3$s may be the same or different, but when n is 0, $Ar^3$ is an optionally-substituted heterocyclic group.

In the general formula (1), specific examples of the aryl group represented by $Ar^1$, $Ar^2$, $Ar^3$, $Ar^4$, $Ar^5$, "a", $R^2$, $R^3$ or $R^4$ can include, for example, phenyl, naphthyl, pyrenyl and anthonyl. A substituent which may be present on the aryl group include, for example, alkyl groups such as methyl, ethyl, propyl and trifluoromethyl, alkenyl groups such as 2-propenyl and styryl, alkoxy groups such as methoxy, ethoxy and propoxy, amino groups such as methylamino and dimethylamino, halogeno groups such as fluoro, chloro and bromo, aryl groups such as phenyl and naphthyl, aryloxy groups such as phenoxy, and arylthio groups such as thiophenoxy. Specific examples of the aryl group having such substituents can include tolyl, methoxyphenyl, biphenylyl, terphenyl, phenoxyphenyl, p-(phenylthio)phenyl and p-styrylphenyl.

In the general formula (1), specific examples of the heterocyclic group represented by $Ar^1$, $Ar^2$, $Ar^3$, $Ar^4$, $Ar^5$, $R^2$, $R^3$ or $R^4$ can include furyl, thienyl, thiazoryl, benzofuryl, benzothiophenyl, benzothiazoryl and benzooxazoryl. A substituent which may be present on the heterocyclic group described above can include, for example, substituents similar to those which may be present on the aryl group represented by $Ar^1$ and the like described above, and specific examples of the heterocyclic group having a substituent can include N-methyl indolyl and N-ethyl carbazolyl.

In the general formula (1), specific examples of the aralkyl group of $Ar^3$, $Ar^4$, $Ar^5$, $R^2$, $R^3$ or $R^4$ can include, for example, benzyl and 1-naphthylmethyl. A substituent which may be present on the aralkyl group described above can include, for example, substituents similar to those which may be present on the aryl group represented by $Ar^1$ and the like described above, and specific examples of the aralkyl group having a substituent can include p-methoxybenzyl.

In the general formula (1), as the alkyl group represented by $Ar^3$, $Ar^4$, $Ar^5$, "a", $R^1$, $R^2$, $R^3$ or $R^4$, those having from 1 to 6 carbon atoms are preferred, and specific examples thereof can include chained alkyl groups such as methyl, ethyl, n-propyl, isopropyl and t-butyl, and cycloalkyl groups such as cyclohexyl and cyclopentyl. A substituent which may be present on the alkyl groups described above can include substituents similar to those which may be present on the aryl group represented by $Ar^1$ described above, and specific examples of the alkyl group having a substituent can include halogenated alkyl groups such as trifluoromethyl and fluoromethyl, alkoxyalkyl groups such as 1-methoxyethyl, and alkyl groups substituted with a heterocyclic group such as 2-thienylmethyl.

In the general formula (1), as the alkoxy group represented by "a", those having from 1 to 4 carbon atoms are preferred, and specific examples can include methoxy, ethoxy, n-propoxy and isopropoxy. A substituent which may be present on the alkyl group described above can include substituents similar to those which may be present on the aryl group represented by $Ar^1$ described above.

In the general formula (1), as the dialkylamino group represented by "a", those having from 1 to 4 carbon atoms substituted with an alkyl group are preferred, and specific examples can include, dimethylamino, diethylamino and diisopropylamino. A substituent which may be present on the dialylamino group can include, for example, substituents similar to those which may be present on the aryl group represented by $Ar^1$.

In the general formula (1), specific examples of the halogen atom represented by "a" or $R^1$ can include a fluorine atom and a chlorine atom.

In the general formula (1), specific examples of the atoms for bonding $Ar^4$ and $Ar^5$ can include an oxygen atom, sulfur atom and nitrogen atom. The nitrogen atom, for example, as a bivalent group such as an imino group or N-alkylimino group, bonds $Ar^4$ and $Ar^5$. Specific examples of the atomic group for bonding $Ar^4$ and $Ar^5$ can include bivalent groups, for example, an alkylene group such as methylene, ethylene and methylmethylene, an alkenylene group such as vinylene and propenylene, an alkylene group containing a hetero atom such as oxymethylene (chemical formula: —O—$CH_2$—), and an alkenylene group containing a hetero atom such as thiovinylene (chemical formula: S—CH=CH—).

For the charge-transporting substance, an enamine compound represented by the following general formula (2), among enamine compounds represented by the general formula (1), is preferably used.

(2)

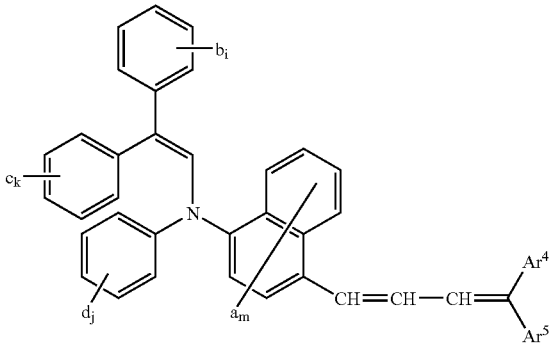

In the general formula (2), b, c and d each represent an optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure; $Ar^4$, $Ar^5$, "a" and "m" represent the same as those defined in formula (1).

In the general formula (2), the alkyl group represented by b, c or d is preferably those having from 1 to 6 carbon atoms, and specific examples thereof can include chained alkyl groups such as methyl, ethyl, n-propyl and isopropyl, and cycloalkyl groups such as cyclohexyl and cyclopentyl. A substituent which may be present on the alkyl group described above can include, for example, substituents similar to those which may be present on the aryl group represented by $Ar^1$ and the like described above, and the specific examples of the alkyl group having a substituent can include halogenated alkyl groups such as trifluoromethyl and fluoromethyl and alkoxyalkyl groups such as 1-methylethyl and alkyl groups substituted with a heterocyclic group such as 2-thienylmethyl.

In the general formula (2), the alkoxy group represented by b, c or d is preferably those having from 1 to 4 carbon atoms, and specific examples thereof can include, methoxy, ethoxy, n-propoxy and isopropoxy. A substituent which may be present on the alkyl groups can have can include, for example, substituents similar to those which may be present on the aryl group represented by $Ar^1$ and the like described above.

In the general formula (2), the dialkyl group represented by b, c or d is preferably those substituted with an alkyl group having from 1 to 4 carbon atoms, and specific examples thereof can include dimethylamino, diethylamino and diisopropylamino. A substituent which the dialkylamino groups can include, for example, substituents similar to those which may be present on the aryl group represented by $Ar^1$ and the like described above.

In the general formula (2), specific examples of the aryl group represented by b, c or d can include phenyl and naphthyl. A substituent which may be present on the aryl groups can include, for example, substituents similar to those which may be present on the aryl group represented by $Ar^1$ and the like described above, and specific examples of the aryl group having the substituent can include tolyl and methoxyphenyl.

In the general formula (2), specific examples of the halogen atom represented by b, c or d can include, a fluorine atom and a chlorine atom.

Enamine compounds represented by the general formula (1) have a high charge-transporting ability. In the enamine compounds represented by the general formula (1), enamine compounds represented by the general formula (2) have particularly high charge-transporting ability. Accordingly, a photoreceptor 1 of high sensitivity, excellent in light responsiveness and chargeability, and capable of coping with high speed electrophotographic process can be obtained by incorporating any of the enamine compounds represented by the general formula (1), preferably, any of the enamine compounds represented by general formula (2) as the charge-transporting substance into the charge-transporting layer 13. The good electric characteristics of the photoreceptor 1 are maintained even when the circumstances surrounding the photoreceptor 1, for example, temperature and humidity are changed, or maintained without degradation even after repetitive use. That is, a photoreceptor 1 having good characteristics, and excellent in circumstantial stability and electrical durability can be obtained. As described above, since the photoreceptor 1 is excellent in the circumstantial stability, it has a sufficient light responsiveness under a low temperature circumstance and can provide images having a sufficient image density.

Further, since a photoreceptor 1 having good electric characteristics described above can be obtained with no incorporation of polysilicone to the charge-transporting layer 13, using any of the enamine compounds represented by the general formula (1), preferably, any of the enamine compounds represented by the general formula (2), a photoreceptor 1 with no deterioration of the electric characteristics even when exposed to light can be obtained.

Further, among enamine compounds represented by the general formula (1), enamine compounds represented by the general formula (2) can be synthesized relatively easily, and have a high production yield, they can be produced at a reduced cost. Accordingly, the photoreceptor 1 having good electric characteristics as described above can be produced at a low production cost using any of the enamine compounds represented by the general formula (2) as the charge-transporting substance.

Among the enamine compounds represented by the general formula (1), compounds having especially excellent in view of the characteristics, cost and productivity can include, for example, those in which each of $Ar^1$ and $Ar^2$ represents a phenyl group, $Ar^3$ represents a phenyl group, tolyl group, p-methoxyphenyl group, biphenylyl group, naphthyl group or thienyl group, at least one of $Ar^4$ and $Ar^5$ represents a phenyl group, p-tolyl group, p-methoxyphenyl group, naphthyl group, thienyl group or thiazolyl group, and $R^1$, $R^2$, $R^3$ and $R^4$ each represents a hydrogen atom, and n represents 1.

Specific examples of enamine compounds represented by the general formula (1) can include, for example, Exemplified Compounds No. 1 to No. 220, in Tables 1 to 32 described below, but they are not limited to them. Further, in Tables 1 to 32, each of the exemplified compounds is represented by a group corresponding to each group of the general formula (1). For example, Exemplified Compound No. 1 shown in Table 1 is an enamine compound represented by the following structural formula (1-1). In Tables 1 to 32, in a case of exemplifying those in which $Ar^4$ and $Ar^5$ bond with each other by way of an atom or an atomic group to form a ring structure, carbon-carbon double bonds for bonding $Ar^4$ and $Ar^5$, and ring structures formed by $Ar^4$ and $Ar^5$ together with the carbon atom of the carbon-carbon double bonds are shown in the column for $Ar^4$ to the column for $Ar^5$.

(1-1)
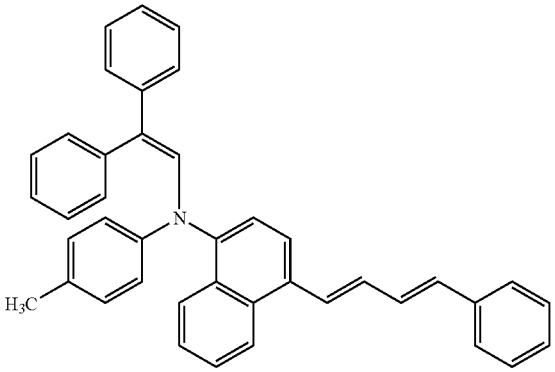
TABLE 1
| Compound No. | $Ar^1$ | $Ar^2$ | $R^1$ | $Ar^3$ | 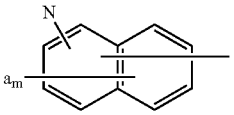 | n |
|---|---|---|---|---|---|---|
| 1 | 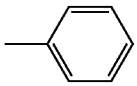 | 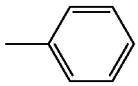 | H | 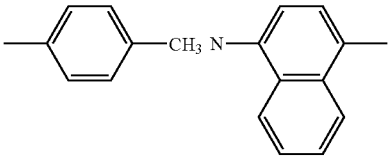 | | 1 |
| 2 | 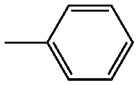 | 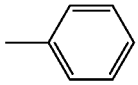 | H | 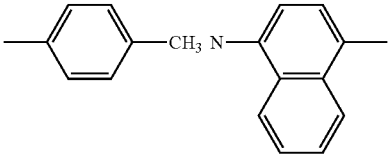 | | 1 |
| 3 | 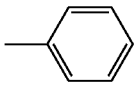 | 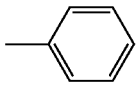 | H | 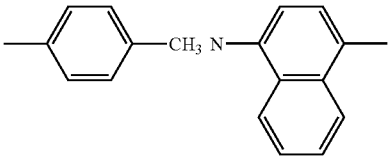 | | 1 |
| 4 | 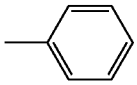 | 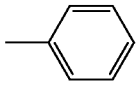 | H | 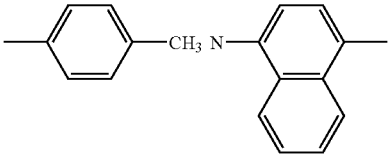 | | 1 |
| 5 | 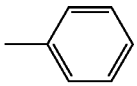 | 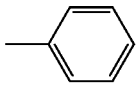 | H | 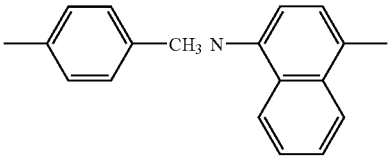 | | 1 |

TABLE 1-continued
| | | | | | |
|---|---|---|---|---|---|
| 6 | 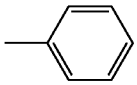 | 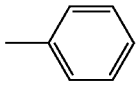 | H | 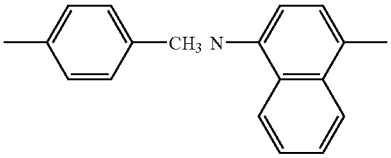 | 1 |
| 7 | 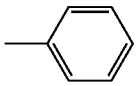 | 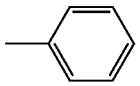 | H | 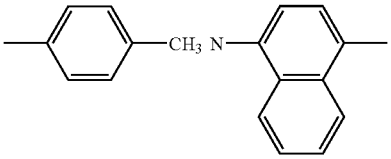 | 1 |
| Compound No. | $-(CR^2=CR^3)_n-$ | $R^4$ | $Ar^4$ | $Ar^5$ |
|---|---|---|---|---|
| 1 | CH=CH | H | H | 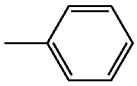 |
| 2 | CH=CH | H | H | 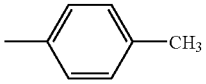 |
| 3 | CH=CH | H | $-CH_3$ | 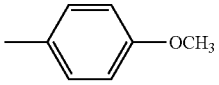 |
| 4 | CH=CH | H | H | 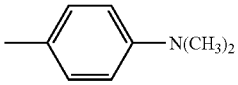 |
| 5 | CH=CH | H | H | 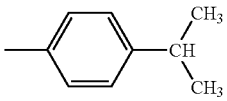 |
| 6 | CH=CH | H | H | 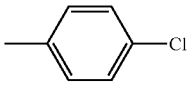 |
| 7 | CH=CH | H | $-CH_3$ | 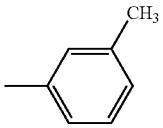 |
TABLE 2
| Compound No. | $Ar^1$ | $Ar^2$ | $R^1$ | $Ar^3$ | 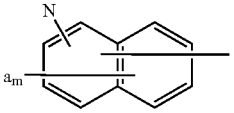 | n |
|---|---|---|---|---|---|---|
| 8 | 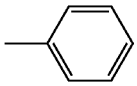 | 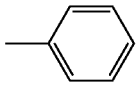 | H | 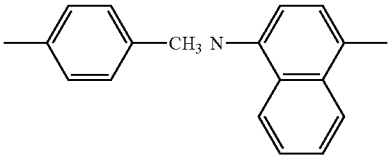 | 1 |

TABLE 2-continued
| | | | | | |
|---|---|---|---|---|---|
| 9 | 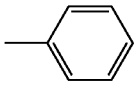 | 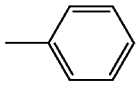 | H | 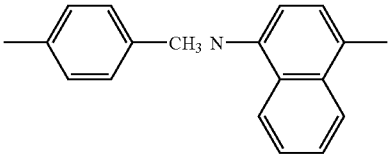 | 1 |
| 10 | 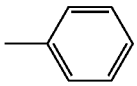 | 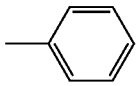 | H | 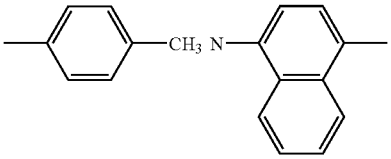 | 1 |
| 11 | 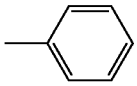 | 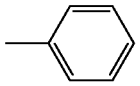 | H | 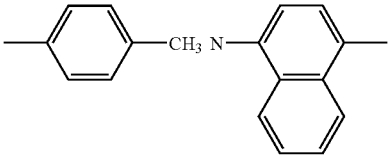 | 1 |
| 12 | 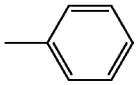 | 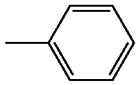 | H | 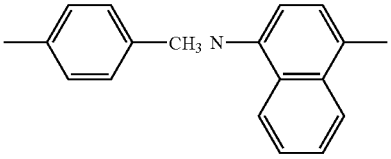 | 1 |
| 13 | 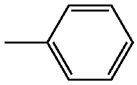 | 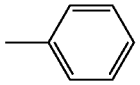 | H | 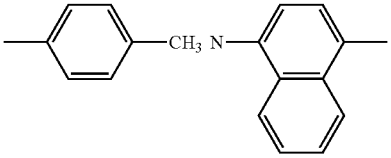 | 1 |
| 14 | 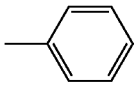 | 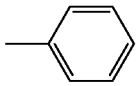 | H | 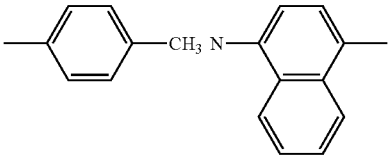 | 1 |
| Compound No. | $-(CR^2=CR^3)_n-$ | $R^4$ | $Ar^4$ | $Ar^5$ |
|---|---|---|---|---|
| 8 | CH=CH | H | H | 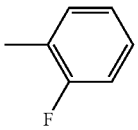 |
| 9 | CH=CH | H | $-CH_3$ | 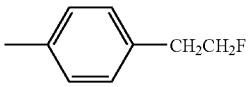 |
| 10 | CH=CH | H | $-CH_3$ | 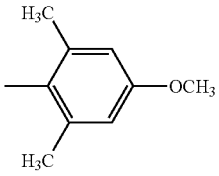 |

TABLE 2-continued
| | | | | |
|---|---|---|---|---|
| 11 | CH═CH | H | H | 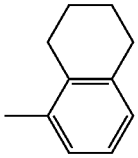 |
| 12 | CH═CH | H | H | 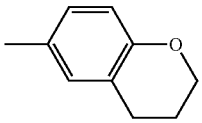 |
| 13 | CH═CH | H | H | 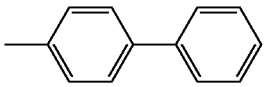 |
| 14 | CH═CH | H | H | 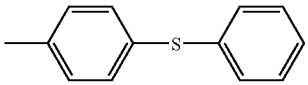 |
TABLE 3
| Compound No. | $Ar^1$ | $Ar^2$ | $R^1$ | $Ar^3$ | 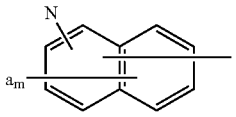 | n |
|---|---|---|---|---|---|---|
| 15 | 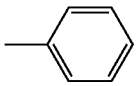 | 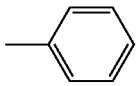 | H | 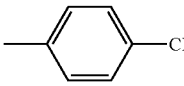 | 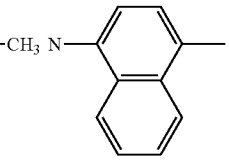 | 1 |
| 16 | 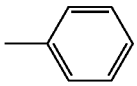 | 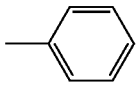 | H | 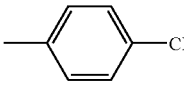 | 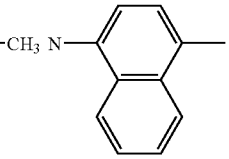 | 1 |
| 17 | 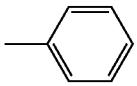 | 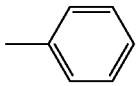 | H | 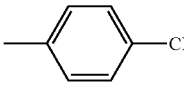 | 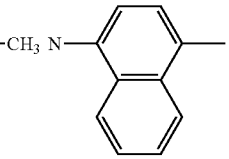 | 1 |
| 18 | 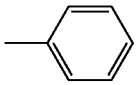 | 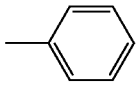 | H | 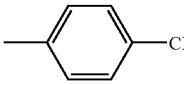 | 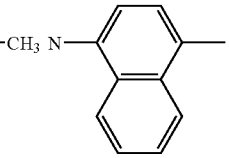 | 1 |
| 19 | 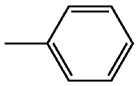 | 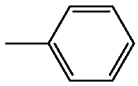 | H | 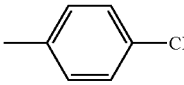 | 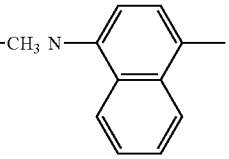 | 1 |

TABLE 3-continued
| | | | | |
|---|---|---|---|---|
| 20 | 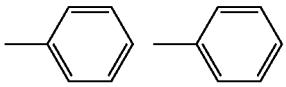 | H | 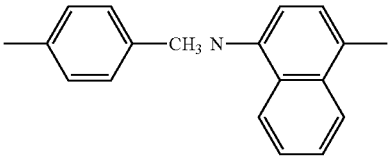 | 1 |
| 21 | 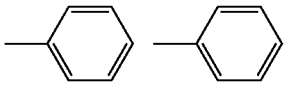 | H | 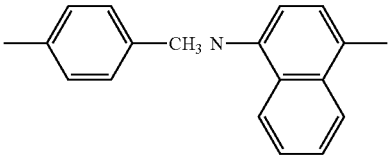 | 1 |
| Compound No. | $-(CR^2=CR^3)_n-$ | $R^4$ | $Ar^4$ | $Ar^5$ |
|---|---|---|---|---|
| 15 | CH═CH | H | H | 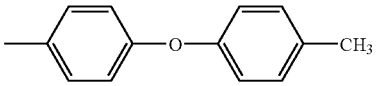 |
| 16 | CH═CH | H | —$CH_3$ | 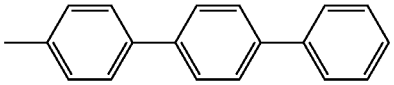 |
| 17 | CH═CH | H | H | 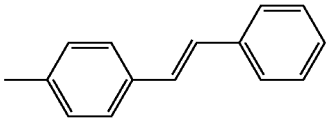 |
| 18 | CH═CH | H | —$CH_3$ | 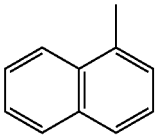 |
| 19 | CH═CH | H | H | 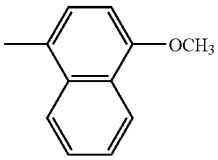 |
| 20 | CH═CH | H | H | 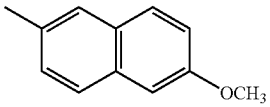 |
| 21 | CH═CH | H | H | 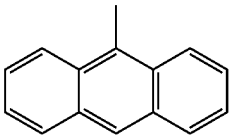 |

TABLE 4
| Compound No. | $Ar^1$ | $Ar^2$ | $R^1$ | $Ar^3$ | 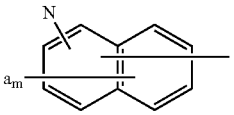 | n |
|---|---|---|---|---|---|---|
| 22 | 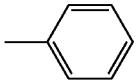 | 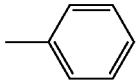 | H | 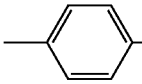 | $CH_3$ N 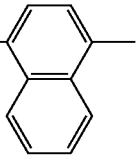 | 1 |
| 23 | 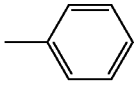 | 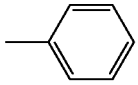 | H | 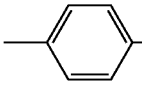 | $CH_3$ N 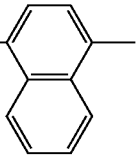 | 1 |
| 24 | 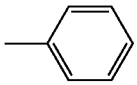 | 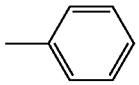 | H | 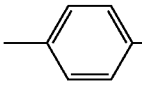 | $CH_3$ N 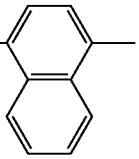 | 1 |
| 25 | 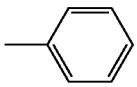 | 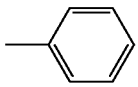 | H | 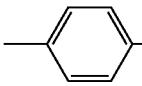 | $CH_3$ N 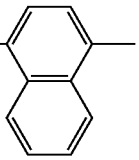 | 1 |
| 26 | 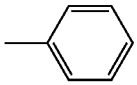 | 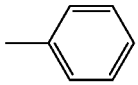 | H | 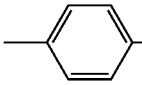 | $CH_3$ N 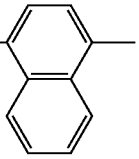 | 1 |
| 27 | 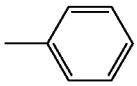 | 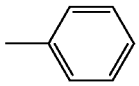 | H | 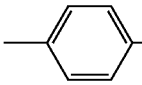 | $CH_3$ N 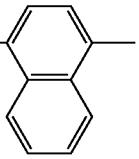 | 1 |
| 28 | 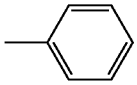 | 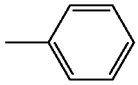 | H | 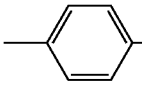 | $CH_3$ N 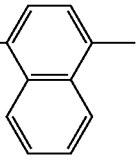 | 1 |
| Compound No. | $-(CR^2=CR^3)_n-$ | $R^4$ | $Ar^4$ | $Ar^5$ |
|---|---|---|---|---|
| 22 | CH=CH | H | H | 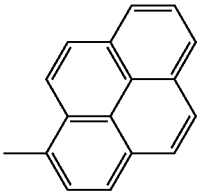 |

TABLE 4-continued
| | | | | |
|---|---|---|---|---|
| 23 | CH═CH | H | —$CH_3$ | 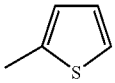 |
| 24 | CH═CH | H | —$CH_3$ | 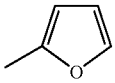 |
| 25 | CH═CH | H | H | 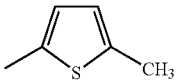 |
| 26 | CH═CH | H | H | 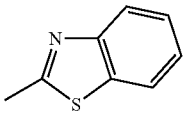 |
| 27 | CH═CH | H | H | 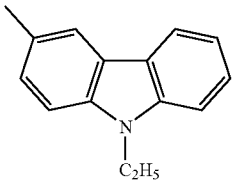 |
| 28 | CH═CH | H | 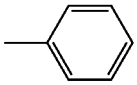 | 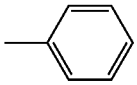 |
TABLE 5
| Compound No. | $Ar^1$ | $Ar^2$ | $R^1$ | $Ar^3$ | 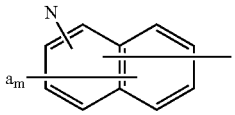 | n |
|---|---|---|---|---|---|---|
| 29 | 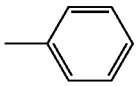 | 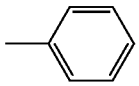 | H | 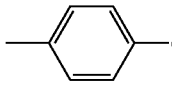 | $CH_3$ N 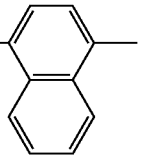 | 1 |
| 30 | 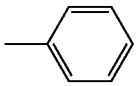 | 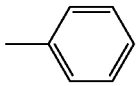 | H | 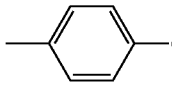 | $CH_3$ N 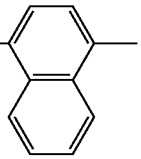 | 1 |
| 31 | 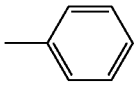 | 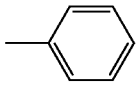 | H | 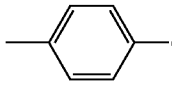 | $CH_3$ N 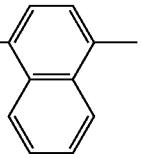 | 1 |
| 32 | 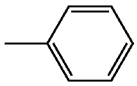 | 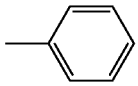 | H | 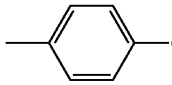 | $CH_3$ N 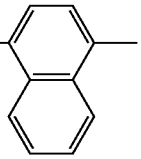 | 1 |

TABLE 5-continued
| | | | | |
|---|---|---|---|---|
| 33 | 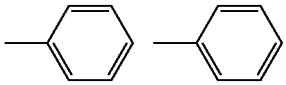 | H | 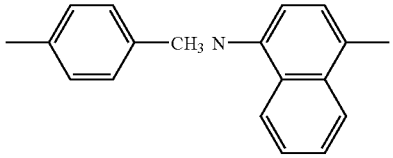 | 1 |
| 34 | 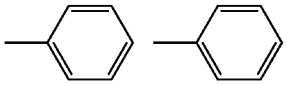 | H | 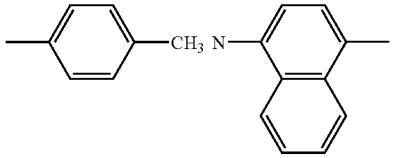 | 1 |
| 35 | 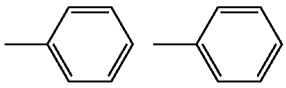 | H | 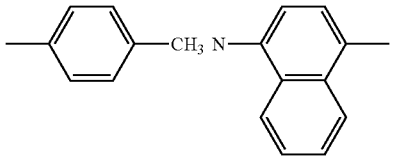 | 1 |
| Compound No. | $-(CR^2=CR^3)_n-$ | $R^4$ | $Ar^4$ | $Ar^5$ |
|---|---|---|---|---|
| 29 | CH=CH | H | 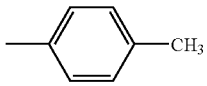 | 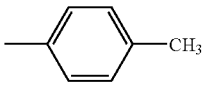 |
| 30 | CH=CH | H | 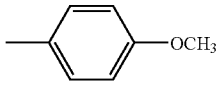 | 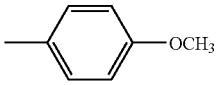 |
| 31 | CH=CH | H | 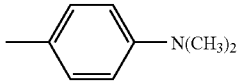 | 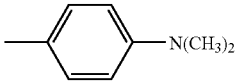 |
| 32 | CH=CH | H | 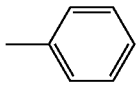 | 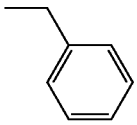 |
| 33 | CH=CH | H | 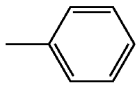 | 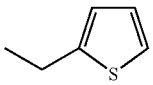 |
| 34 | CH=CH | H | | 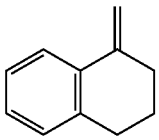 |
| 35 | CH=CH | H | | 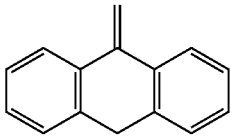 |

TABLE 6
| Compound No. | $Ar^1$ | $Ar^2$ | $R^1$ | $Ar^3$ | 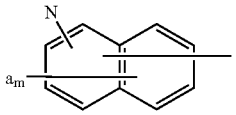 | n |
|---|---|---|---|---|---|---|
| 36 | 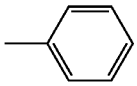 | 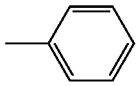 | H | 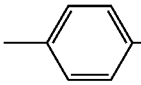 | $CH_3$ N 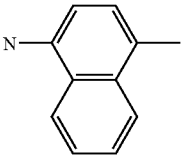 | 1 |
| 37 | 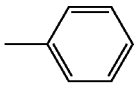 | 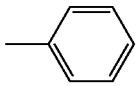 | H | 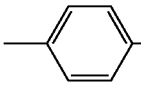 | $CH_3$ N 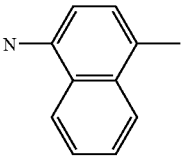 | 1 |
| 38 | 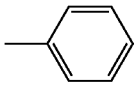 | 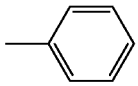 | H | 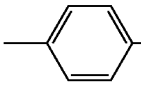 | $CH_3$ N 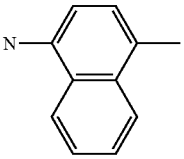 | 1 |
| 39 | 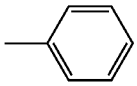 | 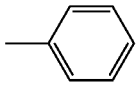 | H | 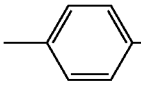 | $CH_3$ N 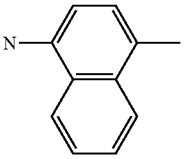 | 1 |
| 40 | 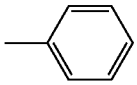 | 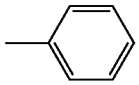 | H | 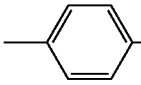 | $CH_3$ N 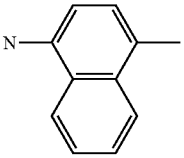 | 1 |
| 41 | 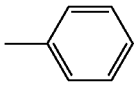 | 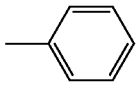 | H | 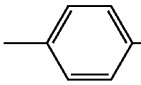 | $CH_3$ N 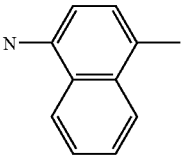 | 1 |
| 42 | 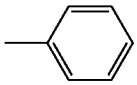 | 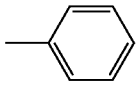 | H | 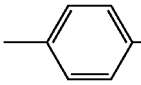 | $CH_3$ N 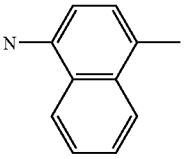 | 1 |
| Compound No. | $-(CR^2=CR^3)_n-$ | $R^4$ | $Ar^4$ | $Ar^5$ |
|---|---|---|---|---|
| 36 | CH=CH | H | 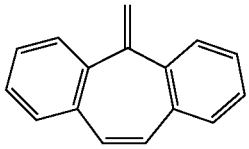 | |

TABLE 6-continued
| | | | | |
|---|---|---|---|---|
| 37 | CH═CH | H | | 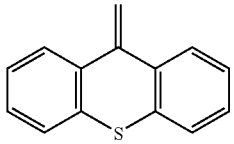 |
| 38 | CH═CH | H | | 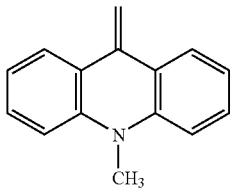 |
| 39 | CH═CH | —$CH_3$ | H | 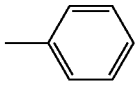 |
| 40 | CH═CH | 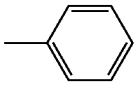 | H | 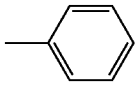 |
| 41 | $CH_2F$ HC═C | H | H | 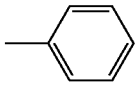 |
| 42 | 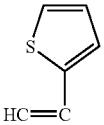 | H | H | 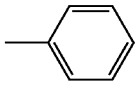 |
TABLE 7
| Compound No. | $Ar^1$ | $Ar^2$ | $R^1$ | $Ar^3$ | 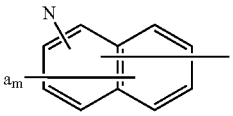 | n |
|---|---|---|---|---|---|---|
| 43 | 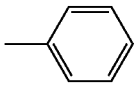 | 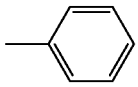 | H | 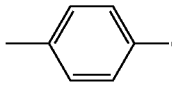 | $CH_3$ N 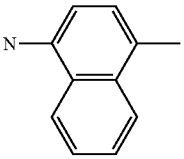 | 1 |
| 44 | 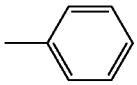 | 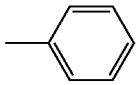 | H | 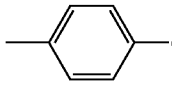 | $CH_3$ N 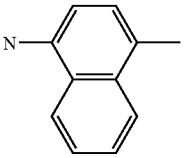 | 1 |
| 45 | 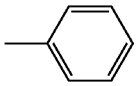 | 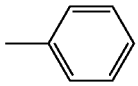 | H | 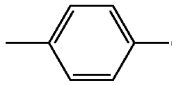 | $CH_3$ N 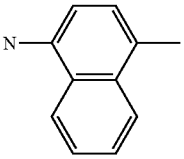 | 1 |

TABLE 7-continued
| | | | | | |
|---|---|---|---|---|---|
| 46 | 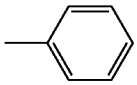 | 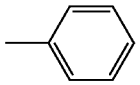 | H | 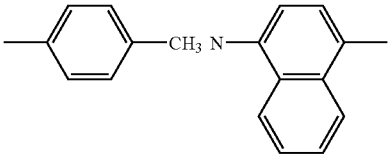 | 2 |
| 47 | 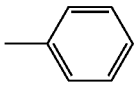 | 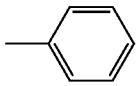 | H | 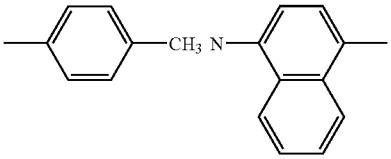 | 2 |
| 48 | 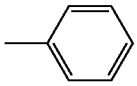 | 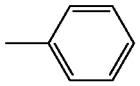 | H | 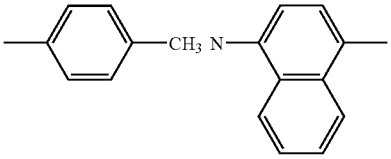 | 2 |
| 49 | 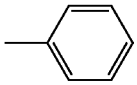 | 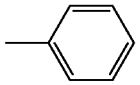 | H | 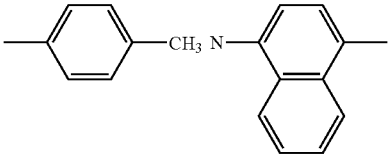 | 2 |
| Compound No. | $-(CR^2{=}CR^3)_n-$ | $R^4$ | $Ar^4$ | $Ar^5$ |
|---|---|---|---|---|
| 43 | 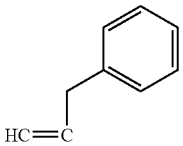 | H | H | 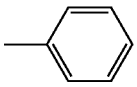 |
| 44 | $CH_3$ \| $C{=}CH$ | H | H | 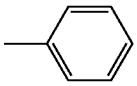 |
| 45 | $CH_3$ \| $HC{=}C$ | 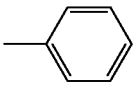 | H | 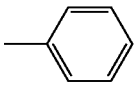 |
| 46 | CH═CH—CH═CH | H | H | 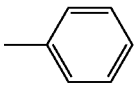 |
| 47 | CH═CH—CH═CH | H | H | 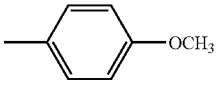 $OCH_3$ |
| 48 | CH═CH—CH═CH | H | $—CH_3$ | 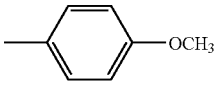 $OCH_3$ |
| 49 | CH═CH—CH═CH | H | $—CH_3$ | 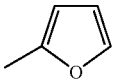 |

TABLE 8
| Compound No. | $Ar^1$ | $Ar^2$ | $R^1$ | $Ar^3$ | | n |
|---|---|---|---|---|---|---|
| 50 | 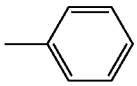 | 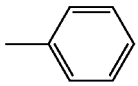 | H | 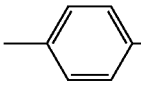 | 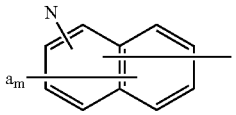 | 2 |
| 51 | 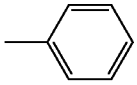 | 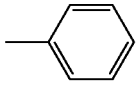 | H | 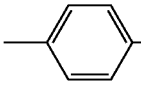 | 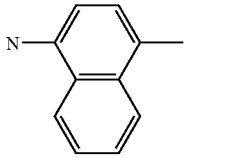 | 2 |
| 52 | 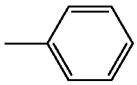 | 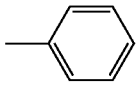 | H | 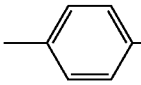 | 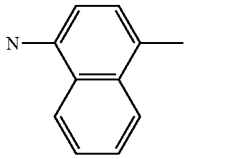 | 2 |
| 53 | 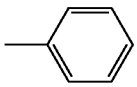 | 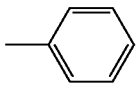 | H | 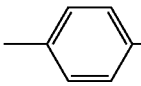 | 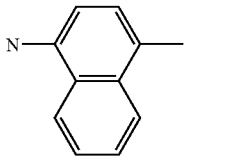 | 2 |
| 54 | 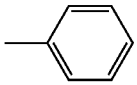 | 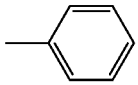 | H | 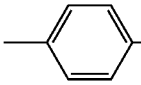 | 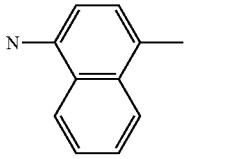 | 3 |
| 55 | 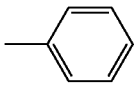 | 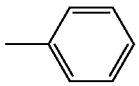 | H | 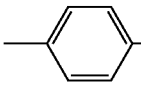 | 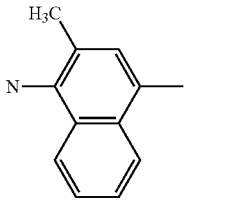 | 1 |
| 56 | 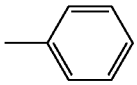 | 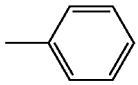 | H | 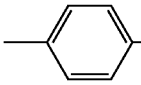 | 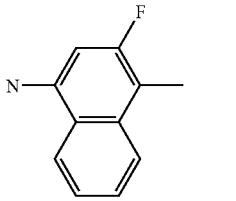 | 1 |
| Compound No. | $-(CR^2=CR^3)_n-$ | $R^4$ | $Ar^4$ | $Ar^5$ |
|---|---|---|---|---|
| 50 | CH=CH—CH=CH | H | $-CH_3$ | 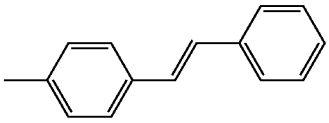 |

TABLE 8-continued
| | | | | |
|---|---|---|---|---|
| 51 | CH═CH—CH═CH | H | —$CH_3$ | 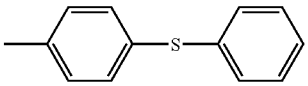 |
| 52 | 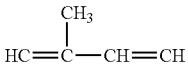 | H | H | 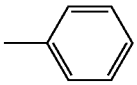 |
| 53 | 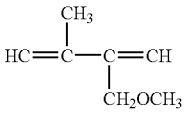 | H | H | 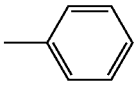 |
| 54 | —(HC═CH)$_3$— | H | H | 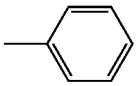 |
| 55 | CH═CH | H | H | 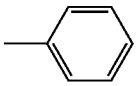 |
| 56 | CH═CH | H | H | 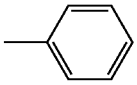 |
TABLE 9
| Compound No. | $Ar^1$ | $Ar^2$ | $R^1$ | $Ar^3$ | 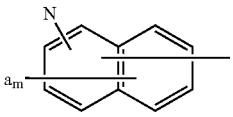 | n |
|---|---|---|---|---|---|---|
| 57 | 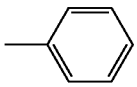 | 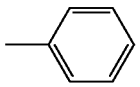 | H | 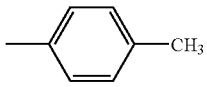 | 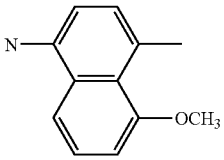 | 1 |
| 58 | 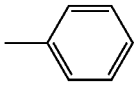 | 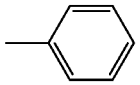 | H | 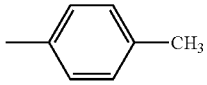 | 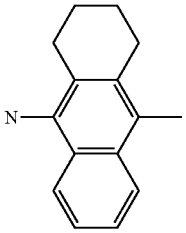 | 1 |
| 59 | 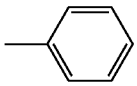 | 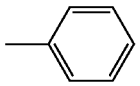 | H | 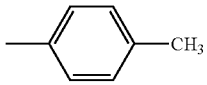 | 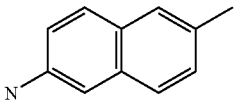 | 1 |
| 60 | 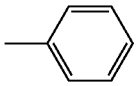 | 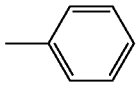 | H | 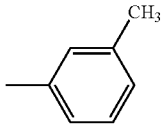 | 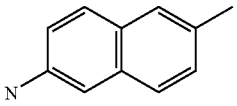 | 1 |

TABLE 9-continued
| | | | | | |
|---|---|---|---|---|---|
| 61 | 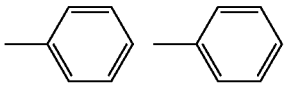 |  | H | 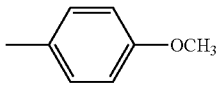 | 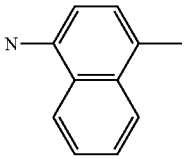 | 1 |
| 62 | 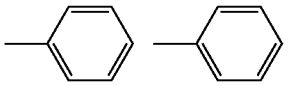 |  | H | 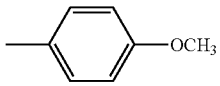 | 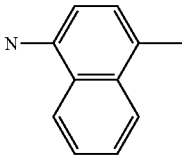 | 1 |
| 63 | 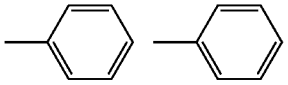 |  | H | 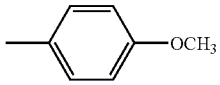 | 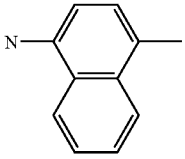 | 1 |
| Compound No. | $-(CR^2=CR^3)_n-$ | $R^4$ | $Ar^4$ | $Ar^5$ |
|---|---|---|---|---|
| 57 | CH=CH | H | H | 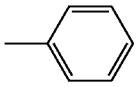 |
| 58 | CH=CH | H | H | 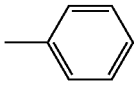 |
| 59 | CH=CH | H | H | 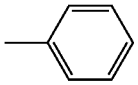 |
| 60 | CH=CH | H | H | 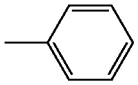 |
| 61 | CH=CH | H | H | 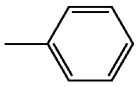 |
| 62 | CH=CH | H | H | 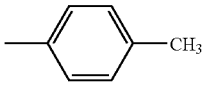 $CH_3$ |
| 63 | CH=CH | H | $-CH_3$ | 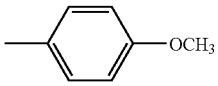 $OCH_3$ |

TABLE 10
| Compound No. | $Ar^1$ | $Ar^2$ | $R^1$ | $Ar^3$ | 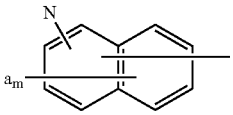 | n |
|---|---|---|---|---|---|---|
| 64 | 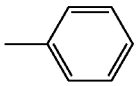 | 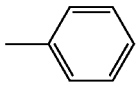 | H | 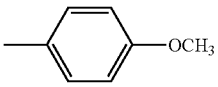 | 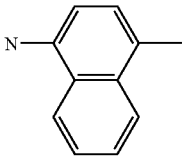 | 1 |
| 65 | 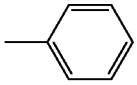 | 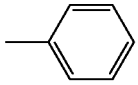 | H | 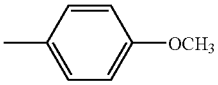 | 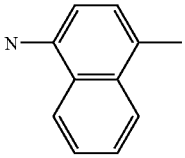 | 1 |
| 66 | 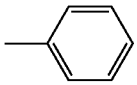 | 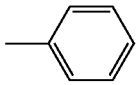 | H | 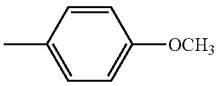 | 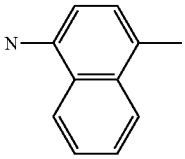 | 1 |
| 67 | 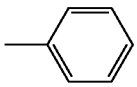 | 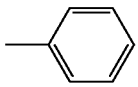 | H | 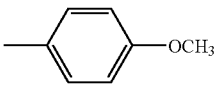 | 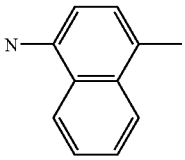 | 1 |
| 68 | 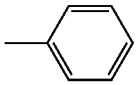 | 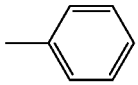 | H | 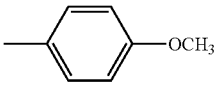 | 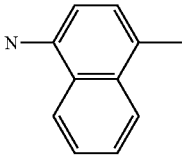 | 1 |
| 69 | 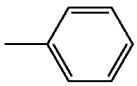 | 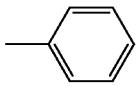 | H | 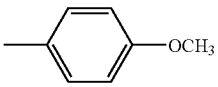 | 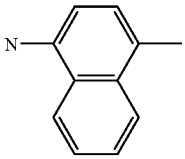 | 1 |
| 70 | 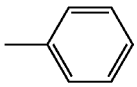 | 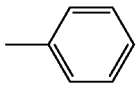 | H | 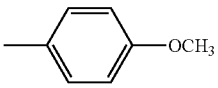 | 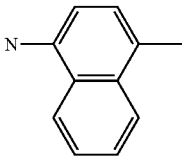 | 1 |
| Compound No. | $-(CR^2=CR^3)_n-$ | $R^4$ | $Ar^4$ | $Ar^5$ |
|---|---|---|---|---|
| 64 | CH=CH | H | H | 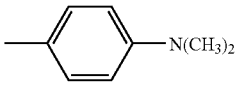 |
| 65 | CH=CH | H | H | 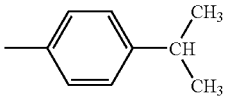 |

TABLE 10-continued
| | | | | |
|---|---|---|---|---|
| 66 | CH═CH | H | —$CH_3$ | 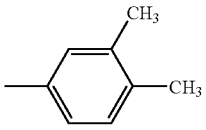 |
| 67 | CH═CH | H | H | 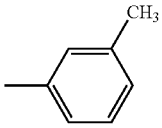 |
| 68 | CH═CH | H | H | 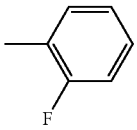 |
| 69 | CH═CH | H | H | 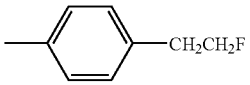 |
| 70 | CH═CH | H | H | 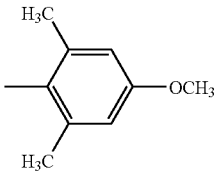 |
TABLE 11
| Compound No. | $Ar^1$ | $Ar^2$ | $R^1$ | $Ar^3$ | 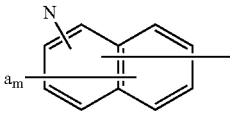 | n |
|---|---|---|---|---|---|---|
| 71 | 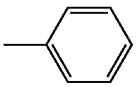 | 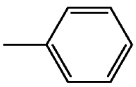 | H | 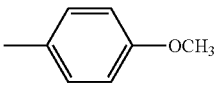 | 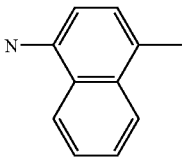 | 1 |
| 72 | 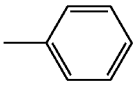 | 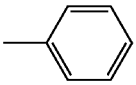 | H | 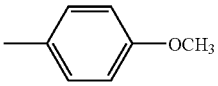 | 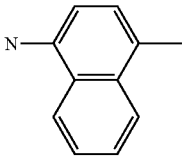 | 1 |
| 73 | 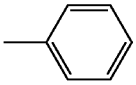 | 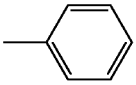 | H | 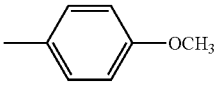 | 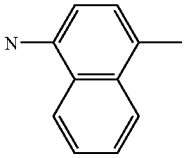 | 1 |
| 74 | 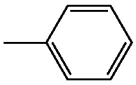 | 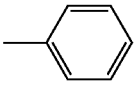 | H | 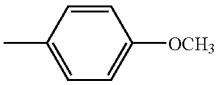 | 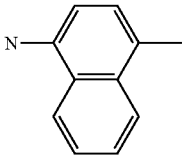 | 1 |

TABLE 11-continued
| | | | | |
|---|---|---|---|---|
| 75 | 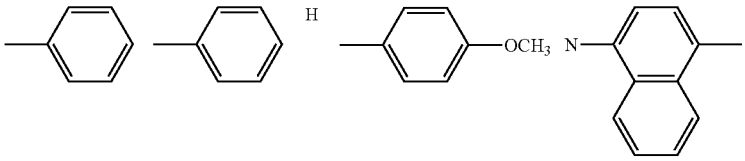 | H | | 1 |
| 76 | 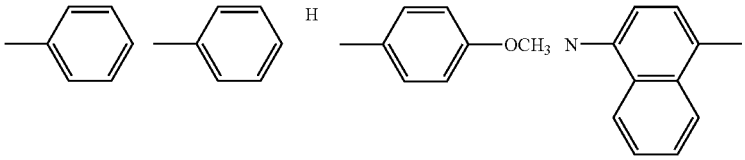 | H | | 1 |
| 77 | 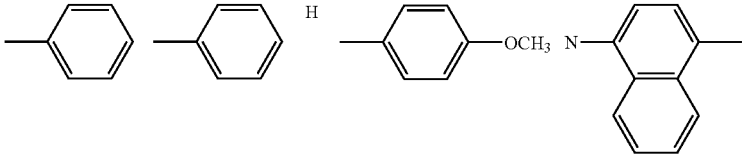 | H | | 1 |
| Compound No. | $-(CR^2=CR^3)_n-$ | $R^4$ | $Ar^4$ | $Ar^5$ |
|---|---|---|---|---|
| 71 | CH=CH | H | H | 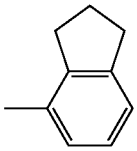 |
| 72 | CH=CH | H | H | 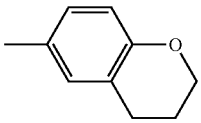 |
| 73 | CH=CH | H | H | 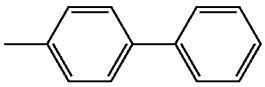 |
| 74 | CH=CH | H | H | 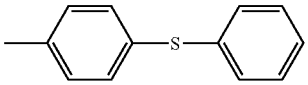 |
| 75 | CH=CH | H | H | 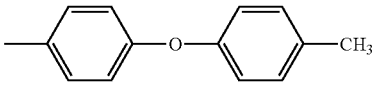 |
| 76 | CH=CH | H | H | 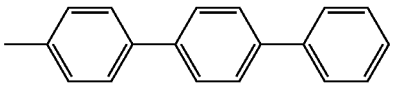 |
| 77 | CH=CH | H | H | 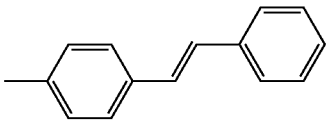 |

TABLE 12
| Compound No. | $Ar^1$ | $Ar^2$ | $R^1$ | $Ar^3$ | 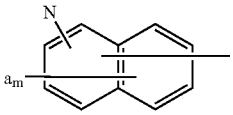 | n |
|---|---|---|---|---|---|---|
| 78 | 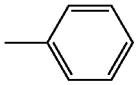 | 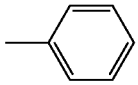 | H | 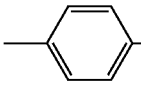 $OCH_3$ | 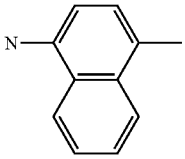 | 1 |
| 79 | 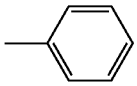 | 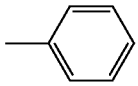 | H | 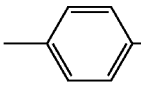 $OCH_3$ | 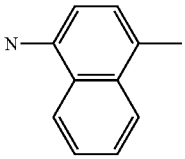 | 1 |
| 80 | 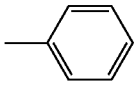 | 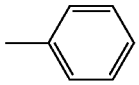 | H | 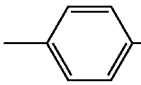 $OCH_3$ | 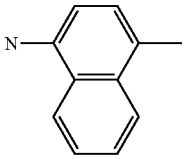 | 1 |
| 81 | 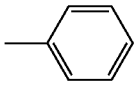 | 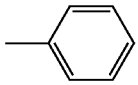 | H | 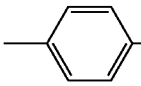 $OCH_3$ | 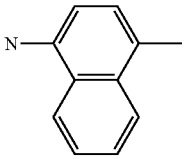 | 1 |
| 82 | 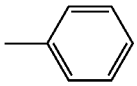 | 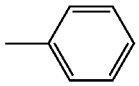 | H | 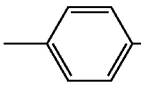 $OCH_3$ | 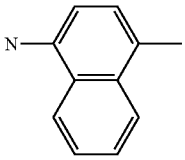 | 1 |
| 83 | 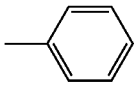 | 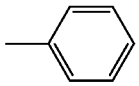 | H | 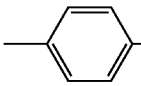 $OCH_3$ | 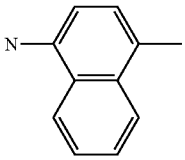 | 1 |
| 84 | 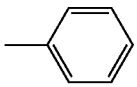 | 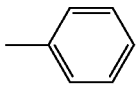 | H | 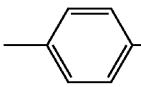 $OCH_3$ | 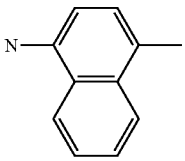 | 1 |
| Compound No. | $-(CR^2{=}CR^3)_n-$ | $R^4$ | $Ar^4$ | $Ar^5$ |
|---|---|---|---|---|
| 78 | CH═CH | H | H | 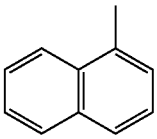 |

TABLE 12-continued
| | | | | |
|---|---|---|---|---|
| 79 | CH═CH | H | H | 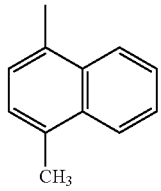 |
| 80 | CH═CH | H | H | 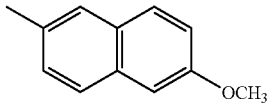 |
| 81 | CH═CH | H | H | 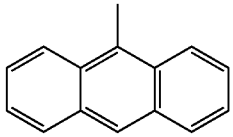 |
| 82 | CH═CH | H | H | 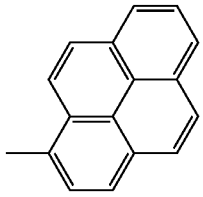 |
| 83 | CH═CH | H | H | 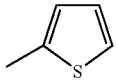 |
| 84 | CH═CH | H | H | 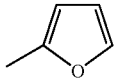 |
TABLE 13
| Compound No. | $Ar^1$ | $Ar^2$ | $R^1$ | $Ar^3$ | 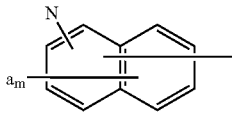 | n |
|---|---|---|---|---|---|---|
| 85 | 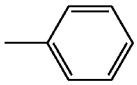 | 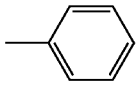 | H | 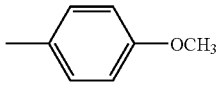 | 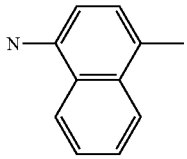 | 1 |
| 86 | 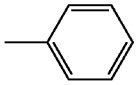 | 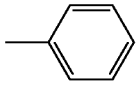 | H | 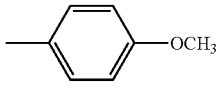 | 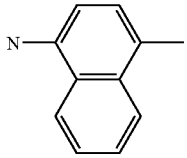 | 1 |
| 87 | 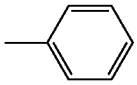 | 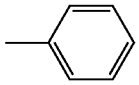 | H | 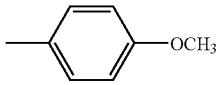 | 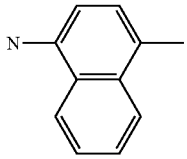 | 1 |

TABLE 13-continued
| | | | | |
|---|---|---|---|---|
| 88 | 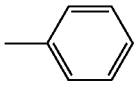 | 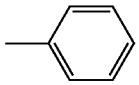 | H | 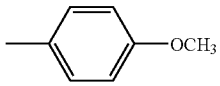  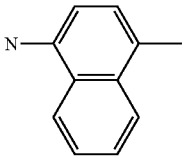  | 1 |
| 89 | 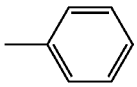 | 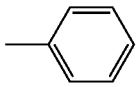 | H | 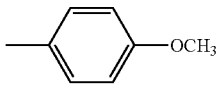  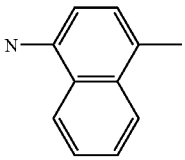  | 1 |
| 90 | 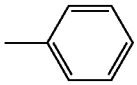 | 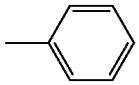 | H | 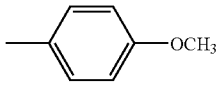  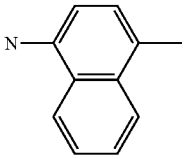  | 1 |
| 91 | 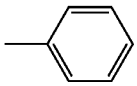 | 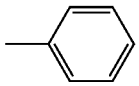 | H | 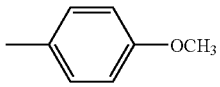  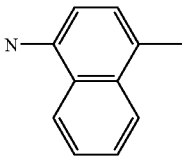  | 1 |
| Compound No. | $-(CR^2=CR^3)_n-$ | $R^4$ | $Ar^4$ | $Ar^5$ |
|---|---|---|---|---|
| 85 | CH=CH | H | $-CH_3$ | 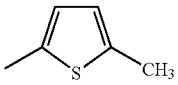  |
| 86 | CH=CH | H | $-CH_3$ | 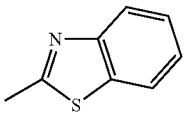  |
| 87 | CH=CH | H | $-CH_3$ | 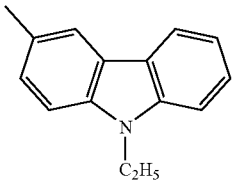  |
| 88 | CH=CH | H | 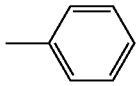 | 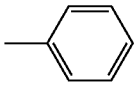 |
| 89 | CH=CH | H | 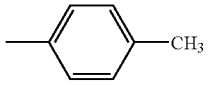  | 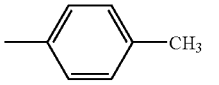  |
| 90 | CH=CH | H | 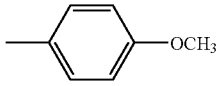  | 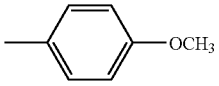  |
| 91 | CH=CH | H | 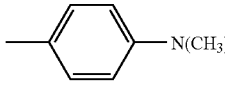  | 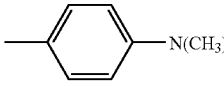  |

TABLE 14
| Compound No. | $Ar^1$ | $Ar^2$ | $R^1$ | $Ar^3$ | 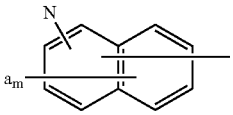 | n |
|---|---|---|---|---|---|---|
| 92 | 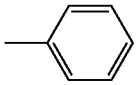 | 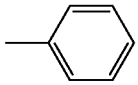 | H | 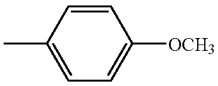 | 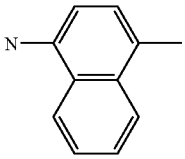 | 1 |
| 93 | 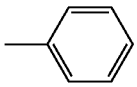 | 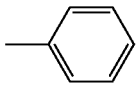 | H | 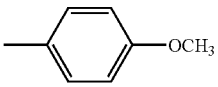 | 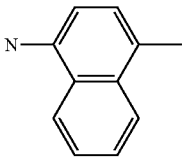 | 1 |
| 94 | 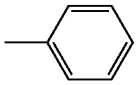 | 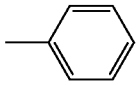 | H | 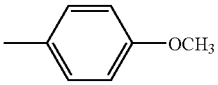 | 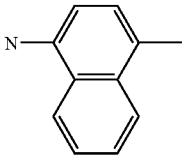 | 1 |
| 95 | 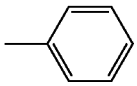 | 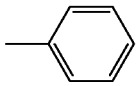 | H | 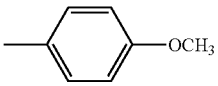 | 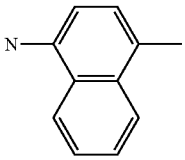 | 1 |
| 96 | 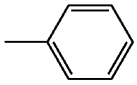 | 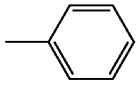 | H | 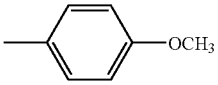 | 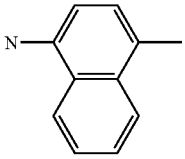 | 1 |
| 97 | 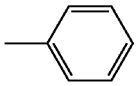 | 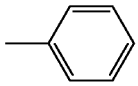 | H | 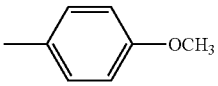 | 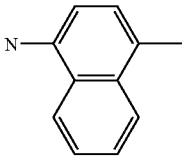 | 1 |
| 98 | 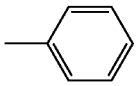 | 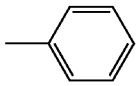 | H | 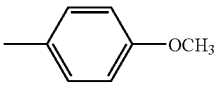 | 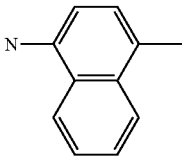 | 1 |
| Compound No. | $-(CR^2=CR^3)_n-$ | $R^4$ | $Ar^4$ | $Ar^5$ |
|---|---|---|---|---|
| 92 | CH=CH | H | 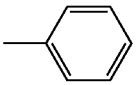 | 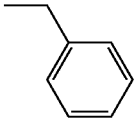 |
| 93 | CH=CH | H | 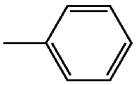 | 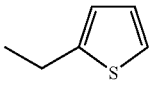 |

TABLE 14-continued
| | | | |
|---|---|---|---|
| 94 | CH═CH | H | 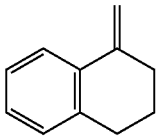 |
| 95 | CH═CH | H | 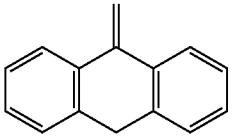 |
| 96 | CH═CH | H | 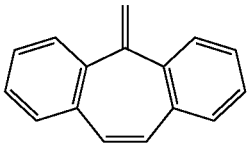 |
| 97 | CH═CH | H | 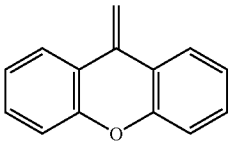 |
| 98 | CH═CH | H | 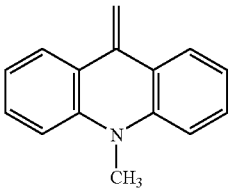 |
TABLE 15
| Compound No. | $Ar^1$ | $Ar^2$ | $R^1$ | $Ar^3$ | 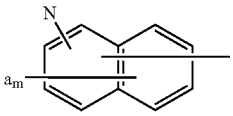 | n |
|---|---|---|---|---|---|---|
| 99 | 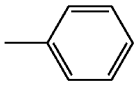 | 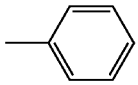 | H | 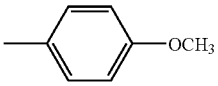 | 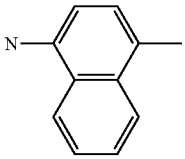 | 1 |
| 100 | 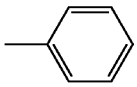 | 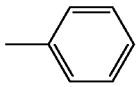 | H | 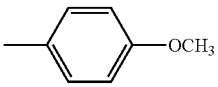 | 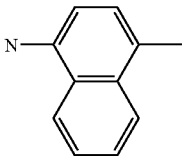 | 1 |
| 101 | 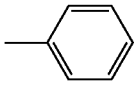 | 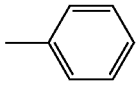 | H | 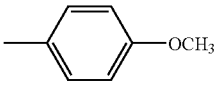 | 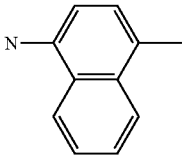 | 1 |

TABLE 15-continued
| | | | | | |
|---|---|---|---|---|---|
| 102 | 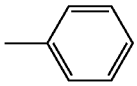 | 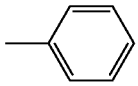 | H | 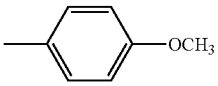 | 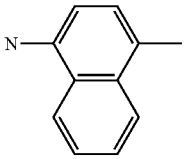 | 1 |
| 103 | 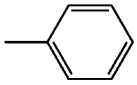 | 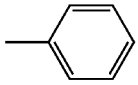 | H | 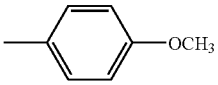 | 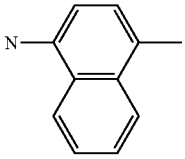 | 1 |
| 104 | 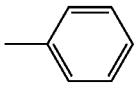 | 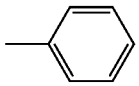 | H | 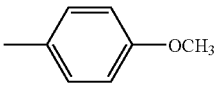 | 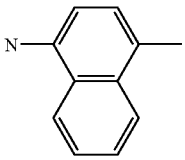 | 1 |
| 105 | 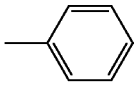 | 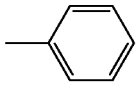 | H | 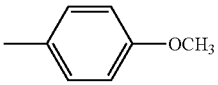 | 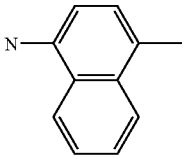 | 1 |
| Compound No. | $-(CR^2=CR^3)_n-$ | $R^4$ | $Ar^4$ | $Ar^5$ |
|---|---|---|---|---|
| 99 | CH=CH | $-CH_3$ | H | 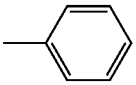 |
| 100 | CH=CH | 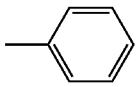 | H | 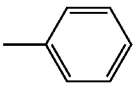 |
| 101 | 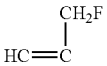 | H | H | 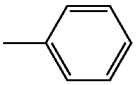 |
| 102 | 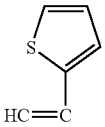 | H | H | 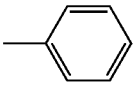 |
| 103 | 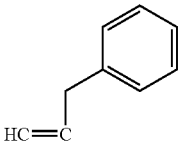 | H | H | 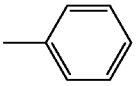 |
| 104 | 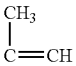 | H | H | 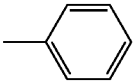 |
| 105 | 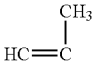 | 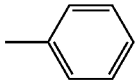 | H | 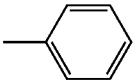 |

TABLE 16
| Compound No. | $Ar^1$ | $Ar^2$ | $R^1$ | $Ar^3$ | 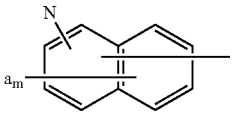 | n |
|---|---|---|---|---|---|---|
| 106 | 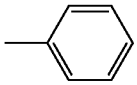 | 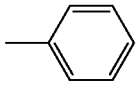 | H | 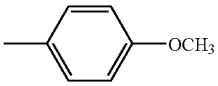 | 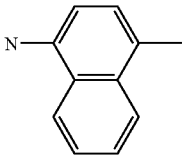 | 2 |
| 107 | 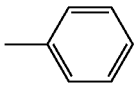 | 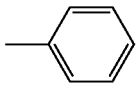 | H | 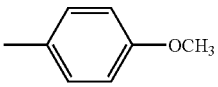 | 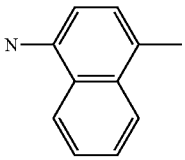 | 2 |
| 108 | 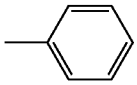 | 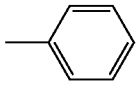 | H | 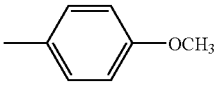 | 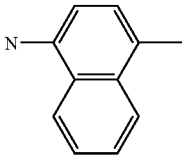 | 2 |
| 109 | 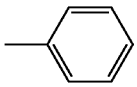 | 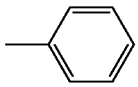 | H | 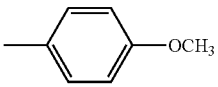 | 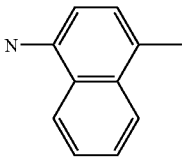 | 2 |
| 110 | 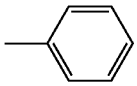 | 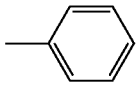 | H | 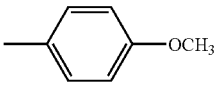 | 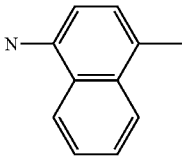 | 2 |
| 111 | 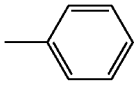 | 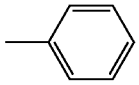 | H | 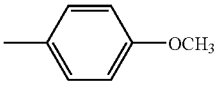 | 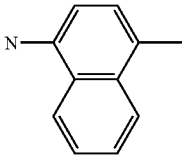 | 2 |
| 112 | 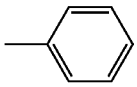 | 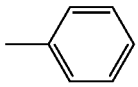 | H | 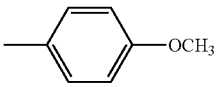 | 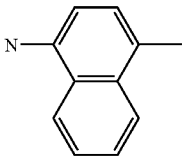 | 2 |
| Compound No. | $-(CR^2=CR^3)_n-$ | $R^4$ | $Ar^4$ | $Ar^5$ |
|---|---|---|---|---|
| 106 | CH═CH—CH═CH | H | H | 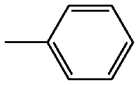 |
| 107 | CH═CH—CH═CH | H | H | 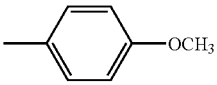 |

TABLE 16-continued
| | | | | |
|---|---|---|---|---|
| 108 | CH═CH—CH═CH | H | —$CH_3$ | 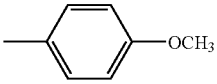 |
| 109 | CH═CH—CH═CH | H | —$CH_3$ | 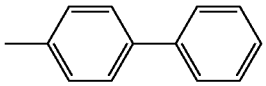 |
| 110 | CH═CH—CH═CH | H | —$CH_3$ | 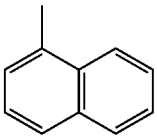 |
| 111 | CH═CH—CH═CH | H | —$CH_3$ | 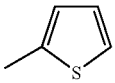 |
| 112 | CH═CH—CH═CH | H | H | 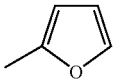 |
TABLE 17
| Compound No. | $Ar^1$ | $Ar^2$ | $R^1$ | $Ar^3$ | 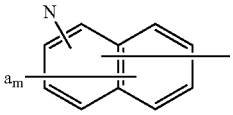 | n |
|---|---|---|---|---|---|---|
| 113 | 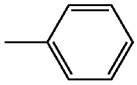 | 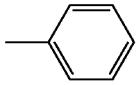 | H | 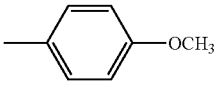 | 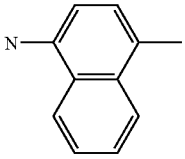 | 2 |
| 114 | 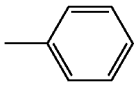 | 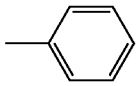 | H | 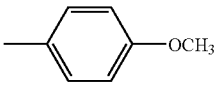 | 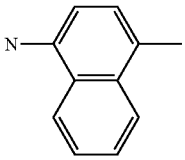 | 2 |
| 115 | 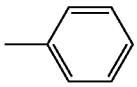 | 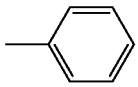 | H | 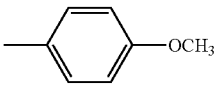 | 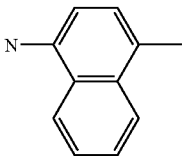 | 3 |
| 116 | 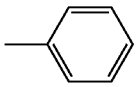 | 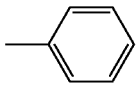 | H | 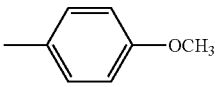 | 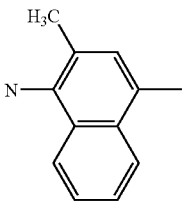 | 1 |

TABLE 17-continued
| | | | | | |
|---|---|---|---|---|---|
| 117 | 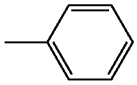 | 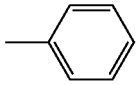 | H | 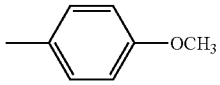 | 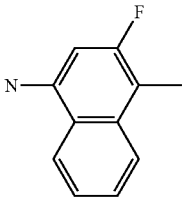 | 1 |
| 118 | 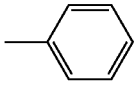 | 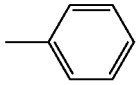 | H | 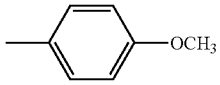 | 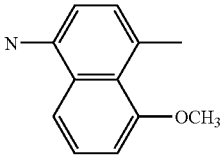 | 1 |
| 119 | 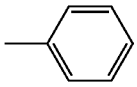 | 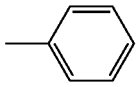 | H | 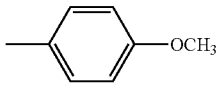 | 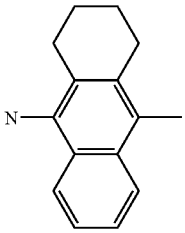 | 1 |
| Compound No. | $-(CR^2{=}CR^3)_n-$ | $R^4$ | $Ar^4$ | $Ar^5$ |
|---|---|---|---|---|
| 113 | 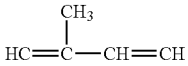 | H | H | 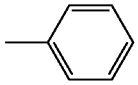 |
| 114 | 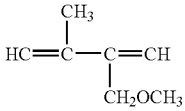 | H | H | 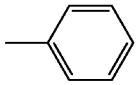 |
| 115 | $-(HC{=}CH)_3-$ | H | H | 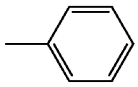 |
| 116 | CH═CH | H | H | 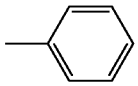 |
| 117 | CH═CH | H | H | 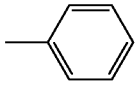 |
| 118 | CH═CH | H | H | 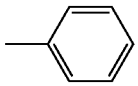 |
| 119 | CH═CH | H | H | 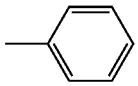 |

TABLE 18
| Compound No. | $Ar^1$ | $Ar^2$ | $R^1$ | $Ar^3$ | $a_m$ | n |
|---|---|---|---|---|---|---|
| 120 | 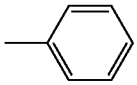 | 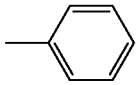 | H | 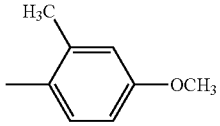 | 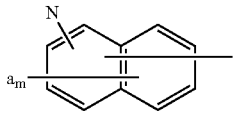 | 1 |
| 121 | 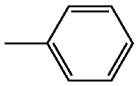 | 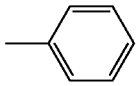 | H | 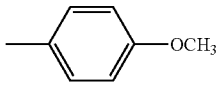 | 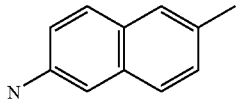 | 1 |
| 122 | 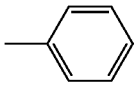 | 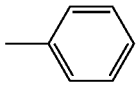 | H | 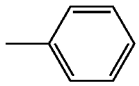 | 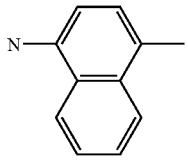 | 1 |
| 123 | 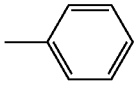 | 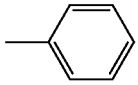 | H | 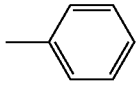 | 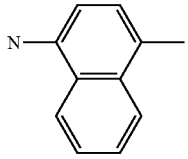 | 1 |
| 124 | 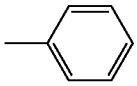 | 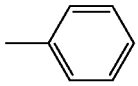 | H | 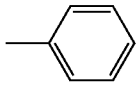 | 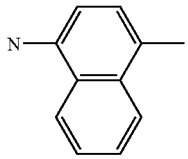 | 1 |
| 125 | 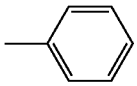 | 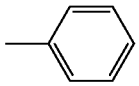 | H | 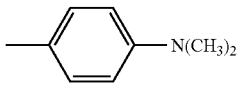 | 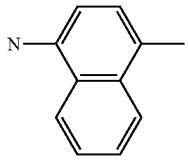 | 1 |
| 126 | 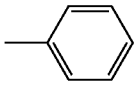 | 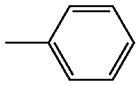 | H | 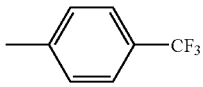 | 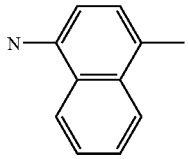 | 1 |
| Compound No. | $-(CR^2{=}CR^3)_n-$ | $R^4$ | $Ar^4$ | $Ar^5$ |
|---|---|---|---|---|
| 120 | CH═CH | H | H | 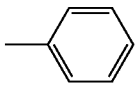 |
| 121 | CH═CH | H | H | 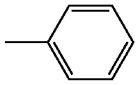 |
| 122 | CH═CH | H | H | 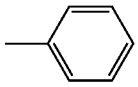 |

TABLE 18-continued
| | | | | |
|---|---|---|---|---|
| 123 | CH═CH | H | —$CH_3$ | 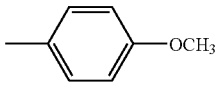 |
| 124 | CH═CH | H | 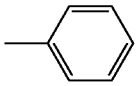 | 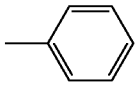 |
| 125 | CH═CH | H | H | 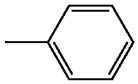 |
| 126 | CH═CH | H | H | 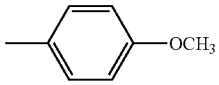 |
TABLE 19
| Compound No. | $Ar^1$ | $Ar^2$ | $R^1$ | $Ar^3$ | 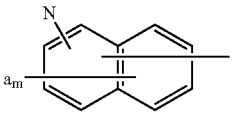 | n |
|---|---|---|---|---|---|---|
| 127 | 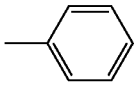 | 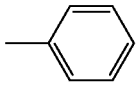 | H | 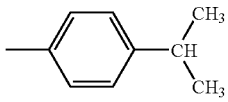 | 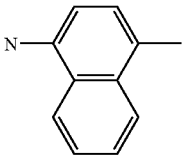 | 1 |
| 128 | 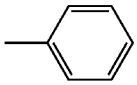 | 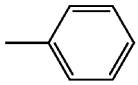 | H | 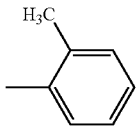 | 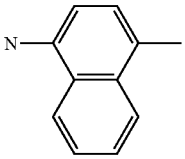 | 1 |
| 129 | 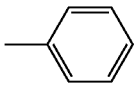 | 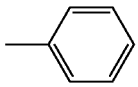 | H | 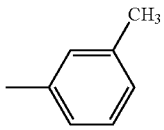 | 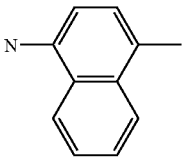 | 1 |
| 130 | 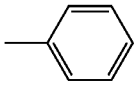 | 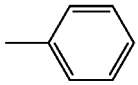 | H | 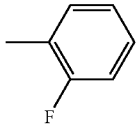 | 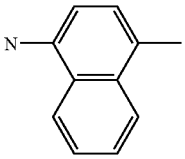 | 1 |
| 131 | 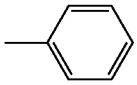 | 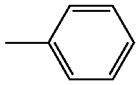 | H | 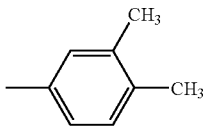 | 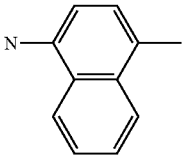 | 1 |

TABLE 19-continued
| | | | | | |
|---|---|---|---|---|---|
| 132 | 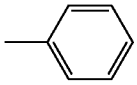 | 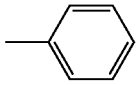 | H | 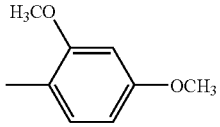 | 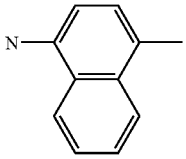 | 1 |
| 133 | 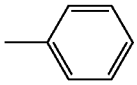 | 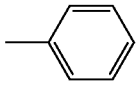 | H | 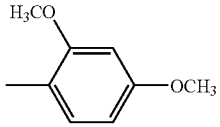 | 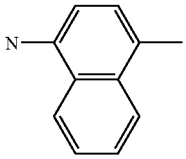 | 1 |
| Compound No. | $-(CR^2=CR^3)_n-$ | $R^4$ | $Ar^4$ | $Ar^5$ |
|---|---|---|---|---|
| 127 | CH═CH | H | 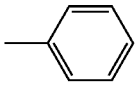 | 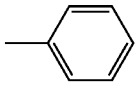 |
| 128 | CH═CH | H | H | 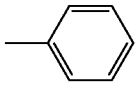 |
| 129 | CH═CH | H | H | 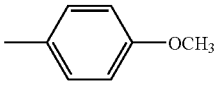 |
| 130 | CH═CH | H | 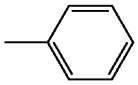 | 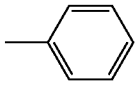 |
| 131 | CH═CH | H | H | 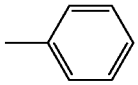 |
| 132 | CH═CH | H | $-CH_3$ | 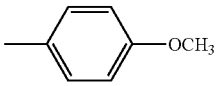 |
| 133 | CH═CH | H | 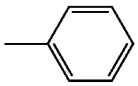 | 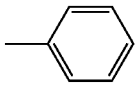 |
TABLE 20
| Compound No. | $Ar^1$ | $Ar^2$ | $R^1$ | $Ar^3$ | 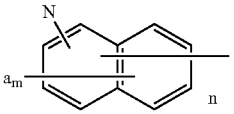 |
|---|---|---|---|---|---|
| 134 | 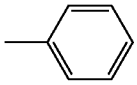 | 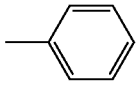 | H | 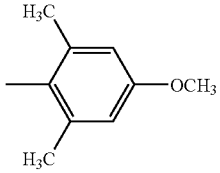 | 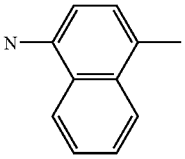 |

TABLE 20-continued
| | | | | |
|---|---|---|---|---|
| 135 | 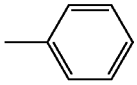 | 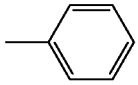 | H | 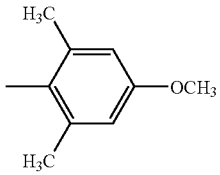  | 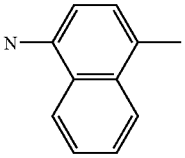  |
| 136 | 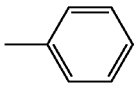 | 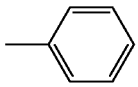 | H | 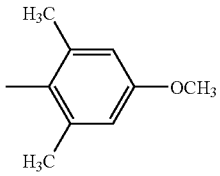  | 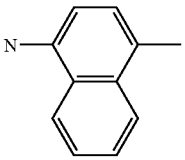  |
| 137 | 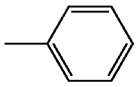 | 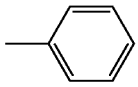 | H | 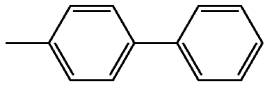 | 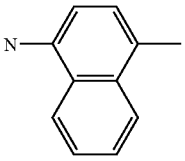  |
| 138 | 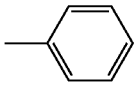 | 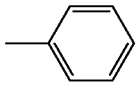 | H | 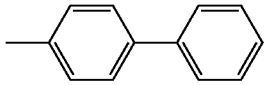 | 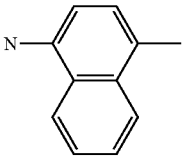  |
| 139 | 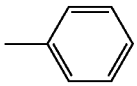 | 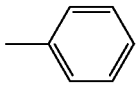 | H | 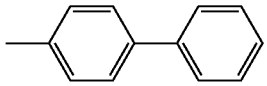 | 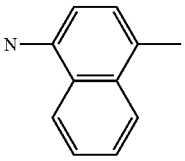  |
| 140 | 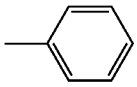 | 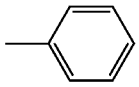 | H | 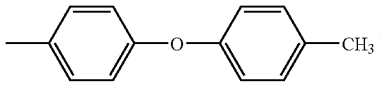  | 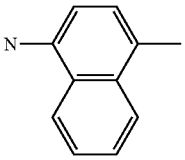  |
| Compound No. | n | $-(CR^2=CR^3)_n-$ | $R^4$ | $Ar^4$ | $Ar^5$ |
|---|---|---|---|---|---|
| 134 | 1 | CH=CH | H | H | 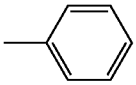 |
| 135 | 1 | CH=CH | H | H | 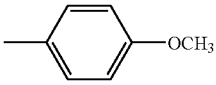  |
| 136 | 1 | CH=CH | H | 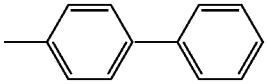 | |
| 137 | 1 | CH=CH | H | H | 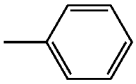 |

TABLE 20-continued
| | | | | | |
|---|---|---|---|---|---|
| 138 | 1 | CH═CH | H | —$CH_3$ | 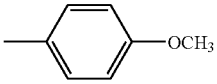 |
| 139 | 1 | CH═CH | H | | 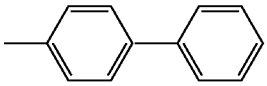 |
| 140 | 1 | CH═CH | H | H | 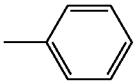 |
TABLE 21
| Compound No. | $Ar^1$ | $Ar^2$ | $R^1$ | $Ar^3$ | 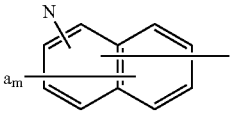 | n |
|---|---|---|---|---|---|---|
| 141 | 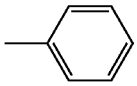 | 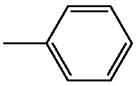 | H | 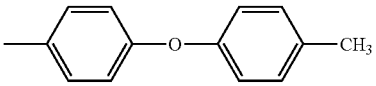 | 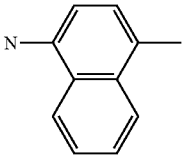 | 1 |
| 142 | 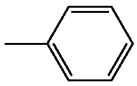 | 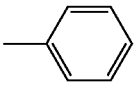 | H | 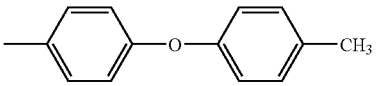 | 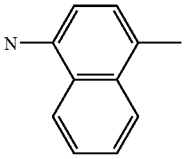 | 1 |
| 143 | 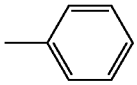 | 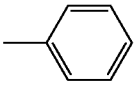 | H | 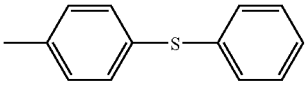 | 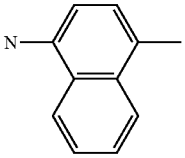 | 1 |
| 144 | 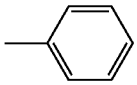 | 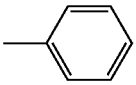 | H | 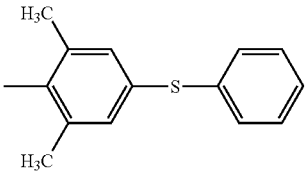 | 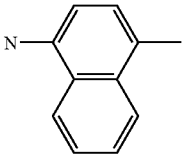 | 1 |
| 145 | 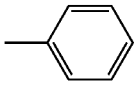 | 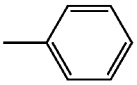 | H | 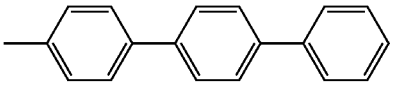 | 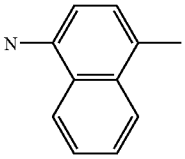 | 1 |
| 146 | 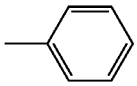 | 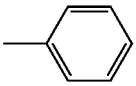 | H | 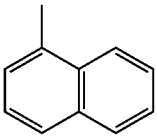 | 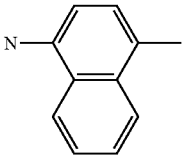 | 1 |

TABLE 21-continued
| | | | | | |
|---|---|---|---|---|---|
| 147 | 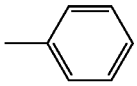 | 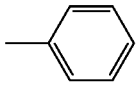 | H | 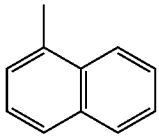 | 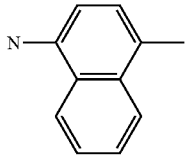 1 |
| Compound No. | —(CR²=CR³)ₙ— | R⁴ | Ar⁴ | Ar⁵ |
|---|---|---|---|---|
| 141 | CH=CH | H | H | 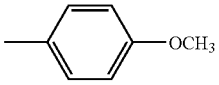 |
| 142 | CH=CH | H | —CH₃ | 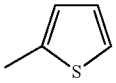 |
| 143 | CH=CH | H | H | 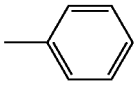 |
| 144 | CH=CH | H | —CH₃ | 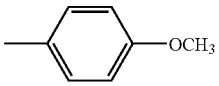 |
| 145 | CH=CH | H | —CH₃ | 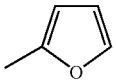 |
| 146 | CH=CH | H | H | 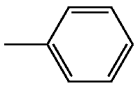 |
| 147 | CH=CH | H | —CH₃ | 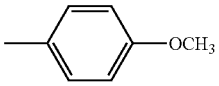 |
TABLE 22
| Compound No. | Ar¹ | Ar² | R¹ | Ar³ | 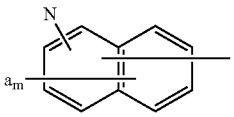 | n |
|---|---|---|---|---|---|---|
| 148 | 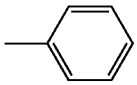 | 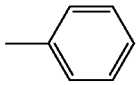 | H | 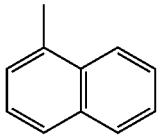 | 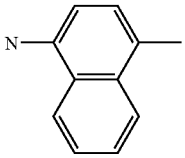 | 1 |
| 149 | 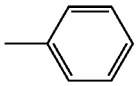 | 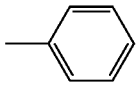 | H | 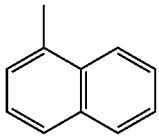 | 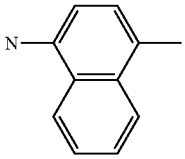 | 1 |

TABLE 22-continued
| | | | | | |
|---|---|---|---|---|---|
| 150 | 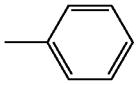 | 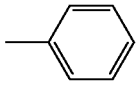 | H | 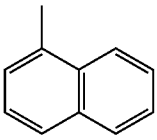 | 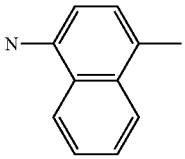 | 1 |
| 151 | 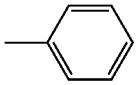 | 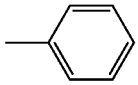 | H | 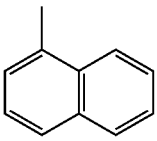 | 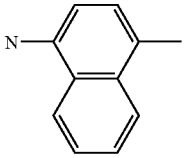 | 1 |
| 152 | 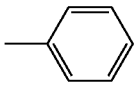 | 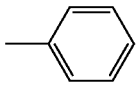 | H | 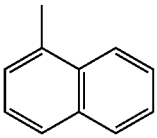 | 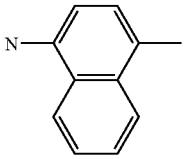 | 1 |
| 153 | 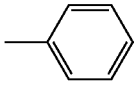 | 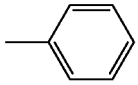 | H | 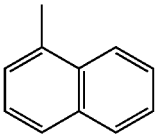 | 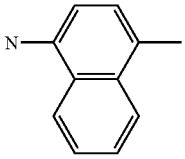 | 1 |
| 154 | 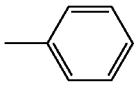 | 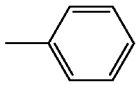 | H | 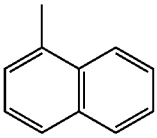 | 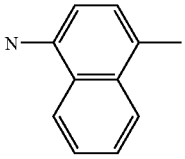 | 1 |
| Compound No. | $-(CR^2=CR^3)_n-$ | $R^4$ | $Ar^4$ | $Ar^5$ |
|---|---|---|---|---|
| 148 | CH═CH | H | H | 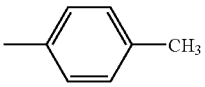 |
| 149 | CH═CH | H | —$CH_3$ | 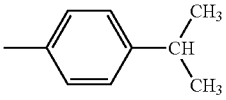 |
| 150 | CH═CH | H | H | 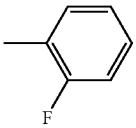 |
| 151 | CH═CH | H | —$CH_3$ | 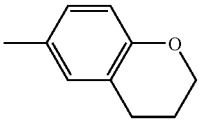 |
| 152 | CH═CH | H | —$CH_3$ | 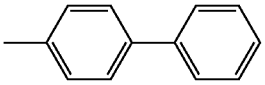 |
| 153 | CH═CH | H | —$CH_3$ | 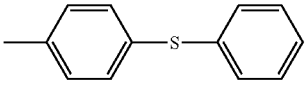 |

TABLE 22-continued
| | | | | |
|---|---|---|---|---|
| 154 | CH═CH | H | H | 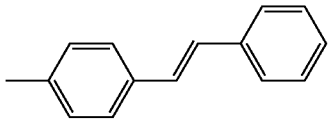 |
TABLE 23
| Compound No. | $Ar^1$ | $Ar^2$ | $R^1$ | $Ar^3$ | 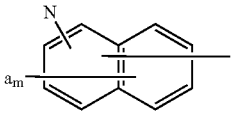 | n |
|---|---|---|---|---|---|---|
| 155 | 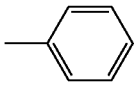 | 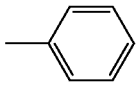 | H | 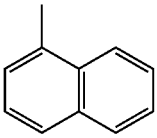 | 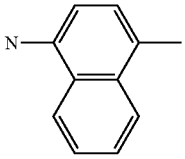 | 1 |
| 156 | 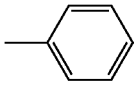 | 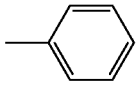 | H | 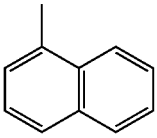 | 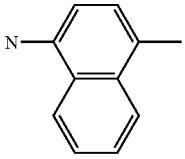 | 1 |
| 157 | 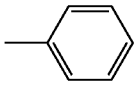 | 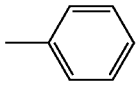 | H | 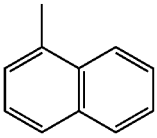 | 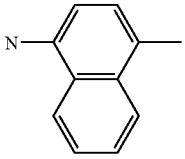 | 1 |
| 158 | 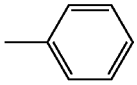 | 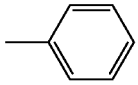 | H | 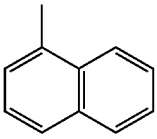 | 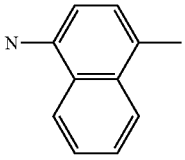 | 1 |
| 159 | 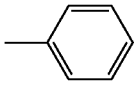 | 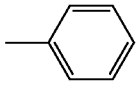 | H | 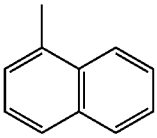 | 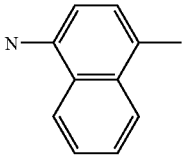 | 1 |
| 160 | 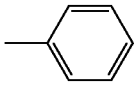 | 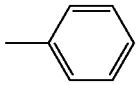 | H | 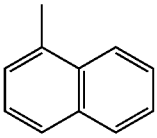 | 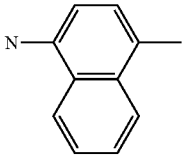 | 1 |
| 161 | 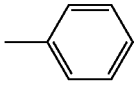 | 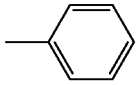 | H | 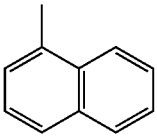 | 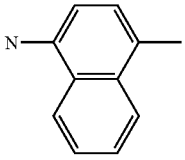 | 1 |

TABLE 23-continued

| Compound No. | $-(CR^2=CR^3)_n-$ | $R^4$ | $Ar^4$ | $Ar^5$ |
|---|---|---|---|---|
| 155 | CH=CH | H | $-CH_3$ | |
| 156 | CH=CH | H | $-CH_3$ | |
| 157 | CH=CH | H | $-CH_3$ | |
| 158 | CH=CH | H | H | |
| 159 | CH=CH | H | | |
| 160 | CH=CH | H | $CH_3$ | $CH_3$ |
| 161 | CH=CH | H | | |

TABLE 24

| Compound No. | $Ar^1$ | $Ar^2$ | $R^1$ | $Ar^3$ | $a_m$ | n |
|---|---|---|---|---|---|---|
| 162 | | | H | | N | 1 |
| 163 | | | H | | N | 1 |

TABLE 24-continued
| | | | | | |
|---|---|---|---|---|---|
| 164 | 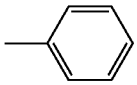 | 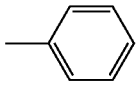 | H | 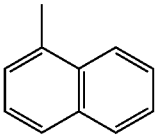 | 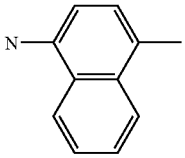 | 1 |
| 165 | 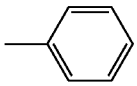 | 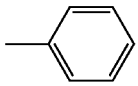 | H | 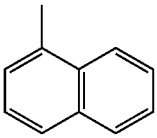 | 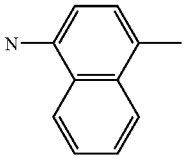 | 2 |
| 166 | 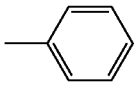 | 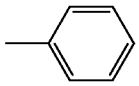 | H | 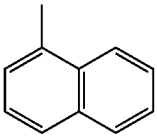 | 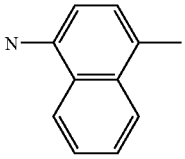 | 2 |
| 167 | 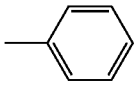 | 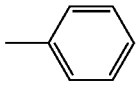 | H | 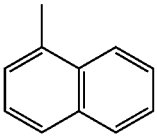 | 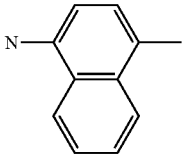 | 2 |
| 168 | 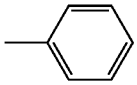 | 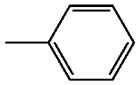 | H | 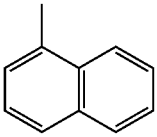 | 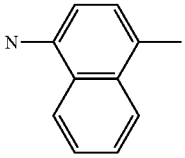 | 3 |
| Compound No. | $-(CR^2=CR^3)_n-$ | $R^4$ | $Ar^4$ | $Ar^5$ |
|---|---|---|---|---|
| 162 | CH═CH | H | | 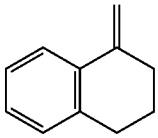 |
| 163 | CH═CH | H | | 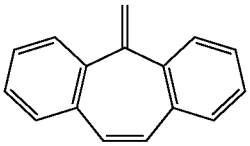 |
| 164 | CH═CH | H | | 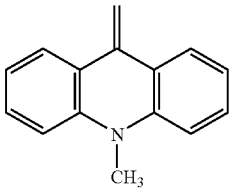 |
| 165 | CH═CH—CH═CH | H | H | 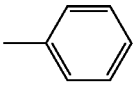 |

TABLE 24-continued
| | | | | |
|---|---|---|---|---|
| 166 | CH═CH—CH═CH | H | —$CH_3$ | 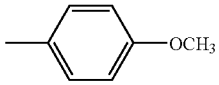 |
| 167 | CH═CH—CH═CH | H | —$CH_3$ | 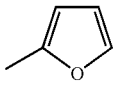 |
| 168 | —(HC═CH)$_3$— | H | H | 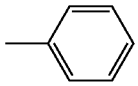 |
TABLE 25
| Compound No. | $Ar^1$ | $Ar^2$ | $R^1$ | $Ar^3$ | 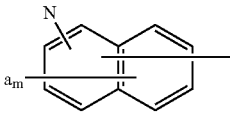 | n |
|---|---|---|---|---|---|---|
| 169 | 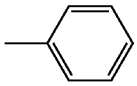 | 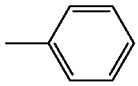 | H | 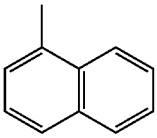 | 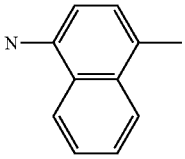 | 1 |
| 170 | 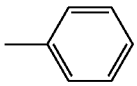 | 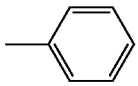 | H | 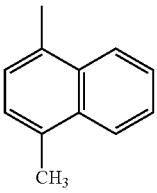 | 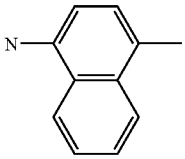 | 1 |
| 171 | 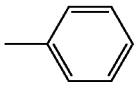 | 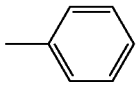 | H | 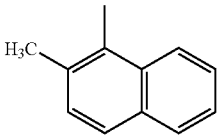 | 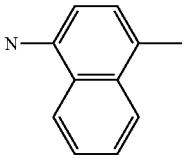 | 1 |
| 172 | 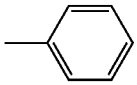 | 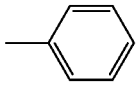 | H | 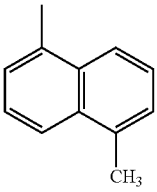 | 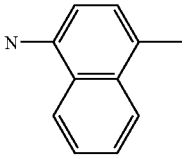 | 1 |
| 173 | 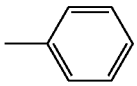 | 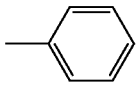 | H | 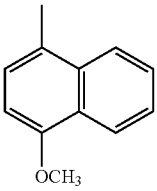 | 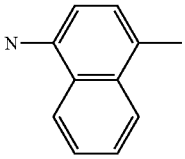 | 1 |

TABLE 25-continued
| | | | | | | |
|---|---|---|---|---|---|---|
| 174 | 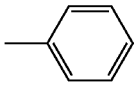 | 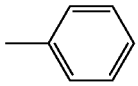 | H | 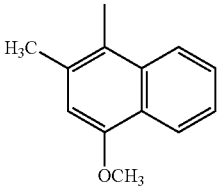 | 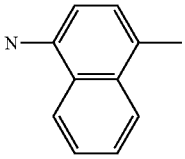 | 1 |
| 175 | 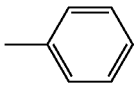 | 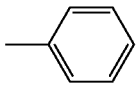 | H | 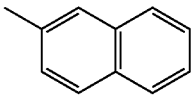 | 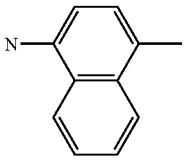 | 1 |
| Compound No. | $-(CR^2=CR^3)_n-$ | $R^4$ | $Ar^4$ | $Ar^5$ |
|---|---|---|---|---|
| 169 | CH═CH | H | H | 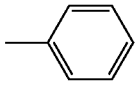 |
| 170 | CH═CH | H | H | 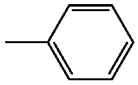 |
| 171 | CH═CH | H | H | 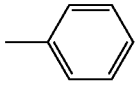 |
| 172 | CH═CH | H | H | 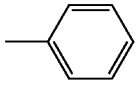 |
| 173 | CH═CH | H | H | 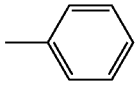 |
| 174 | CH═CH | H | H | 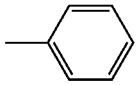 |
| 175 | CH═CH | H | H | 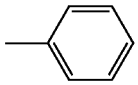 |
TABLE 26
| Compound No. | $Ar^1$ | $Ar^2$ | $R^1$ | $Ar^3$ | 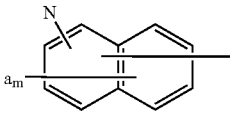 | n |
|---|---|---|---|---|---|---|
| 176 | 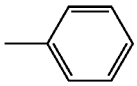 | 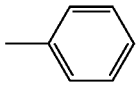 | H | 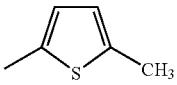 | 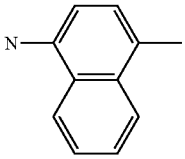 | 1 |

TABLE 26-continued
| | | | | | |
|---|---|---|---|---|---|
| 177 | 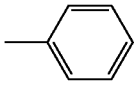 | 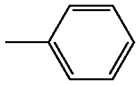 | H | 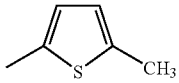 | 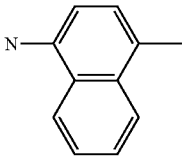 | 1 |
| 178 | 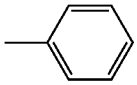 | 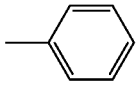 | H | 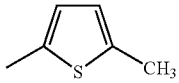 | 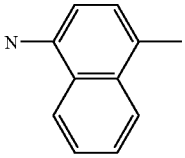 | 1 |
| 179 | 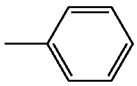 | 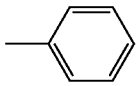 | H | 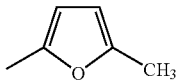 | 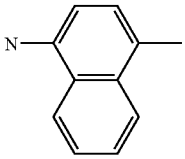 | 1 |
| 180 | 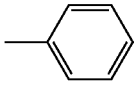 | 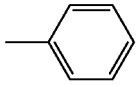 | H | 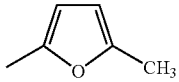 | 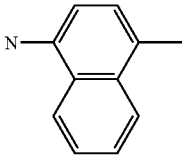 | 1 |
| 181 | 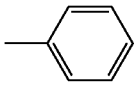 | 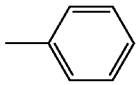 | H | 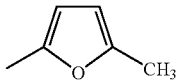 | 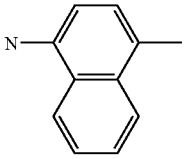 | 1 |
| 182 | 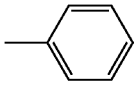 | 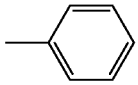 | H | 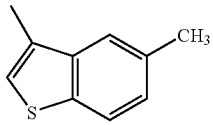 | 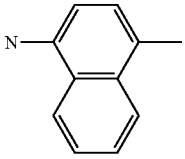 | 1 |
| Compound No. | $-(CR^2=CR^3)_n-$ | $R^4$ | $Ar^4$ | $Ar^5$ |
|---|---|---|---|---|
| 176 | CH=CH | H | H | 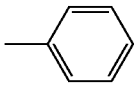 |
| 177 | CH=CH | H | H | 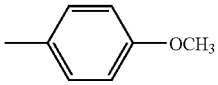 |
| 178 | CH=CH | H | 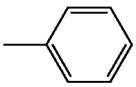 | 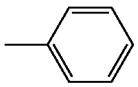 |
| 179 | CH=CH | H | H | 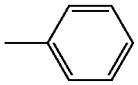 |
| 180 | CH=CH | H | $-CH_3$ | 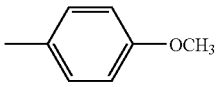 |

TABLE 26-continued

| | | | | |
|---|---|---|---|---|
| 181 | CH═CH | H | | |
| 182 | CH═CH | H | H | |

TABLE 27

| Compound No. | $Ar^1$ | $Ar^2$ | $R^1$ | $Ar^3$ | $a_m$ | n |
|---|---|---|---|---|---|---|
| 183 | | | H | | | 1 |
| 184 | | | H | | | 1 |
| 185 | | | H | | | 1 |
| 186 | | | H | | | 1 |
| 187 | | | H | | | 1 |
| 188 | | | H | | | 0 |

TABLE 27-continued
| | | | | | | |
|---|---|---|---|---|---|---|
| 189 | 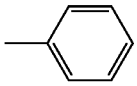 | 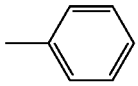 | H | 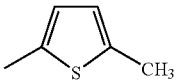 | 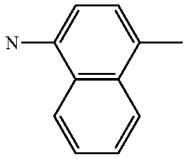 | 0 |
| Compound No. | $-(CR^2{=}CR^3)_n-$ | $R^4$ | $Ar^4$ | $Ar^5$ |
|---|---|---|---|---|
| 183 | CH═CH | H | —$CH_3$ | 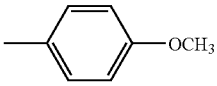 |
| 184 | CH═CH | H | 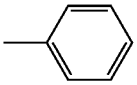 | 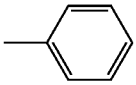 |
| 185 | CH═CH | H | H | 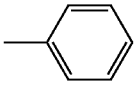 |
| 186 | CH═CH | H | H | 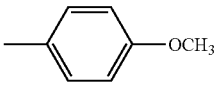 |
| 187 | CH═CH | H | 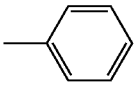 | 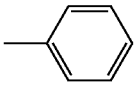 |
| 188 | — | H | H | 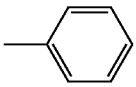 |
| 189 | — | H | H | 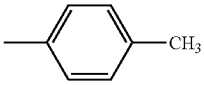 |
TABLE 28
| Compound No. | $Ar^1$ | $Ar^2$ | $R^1$ | $Ar^3$ | 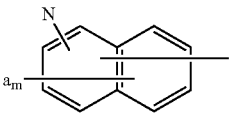 | n |
|---|---|---|---|---|---|---|
| 190 | 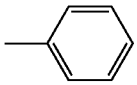 | 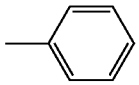 | H | 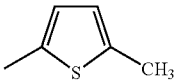 | 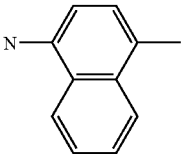 | 0 |
| 191 | 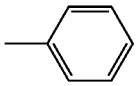 | 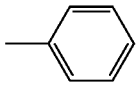 | H | 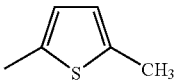 | 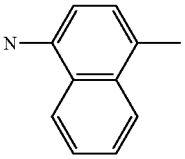 | 0 |

TABLE 28-continued
| | | | | | |
|---|---|---|---|---|---|
| 192 | 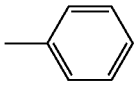 | 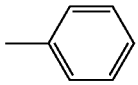 | H | 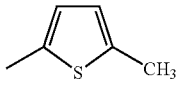 | 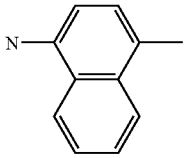 | 0 |
| 193 | 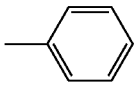 | 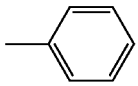 | H | 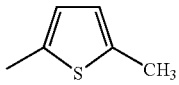 | 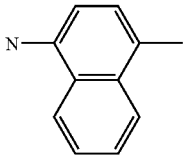 | 0 |
| 194 | 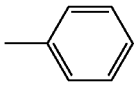 | 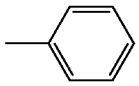 | H | 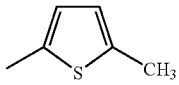 | 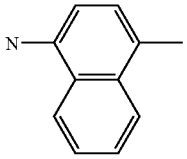 | 0 |
| 195 | 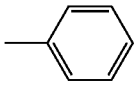 | 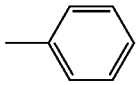 | H | 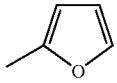 | 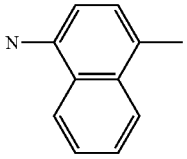 | 0 |
| 196 | 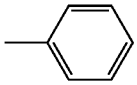 | 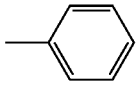 | H | 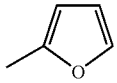 | 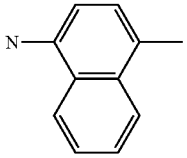 | 0 |
| Compound No. | $-(CR^2=CR^3)_n-$ | $R^4$ | $Ar^4$ | $Ar^5$ |
|---|---|---|---|---|
| 190 | — | H | H | 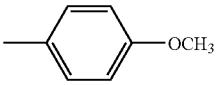 |
| 191 | — | H | H | 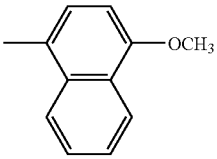 |
| 192 | — | H | H | 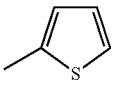 |
| 193 | — | H | H | 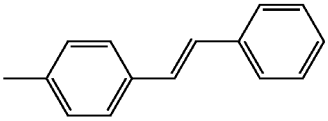 |
| 194 | — | H | 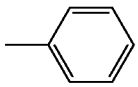 | 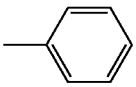 |

TABLE 28-continued
| | | | | |
|---|---|---|---|---|
| 195 | — | H | H | 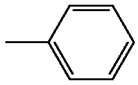 |
| 196 | — | H | H | 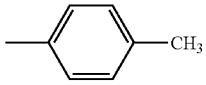 |
TABLE 29
| Compound No. | $Ar^1$ | $Ar^2$ | $R^1$ | $Ar^3$ | 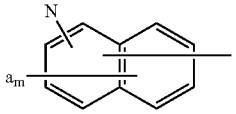 | n |
|---|---|---|---|---|---|---|
| 197 | 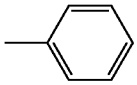 | 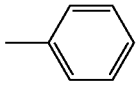 | H | 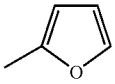 | 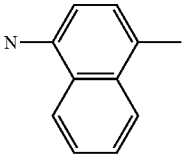 | 0 |
| 198 | 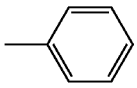 | 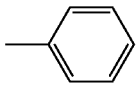 | H | 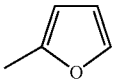 | 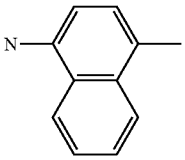 | 0 |
| 199 | 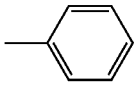 | 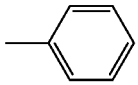 | H | 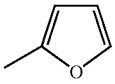 | 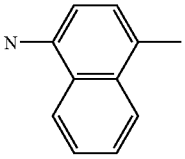 | 0 |
| 200 | 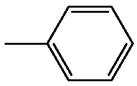 | 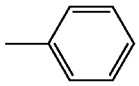 | H | 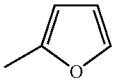 | 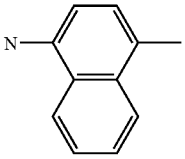 | 0 |
| 201 | 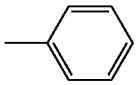 | 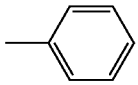 | H | 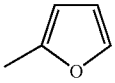 | 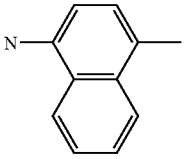 | 0 |
| 202 | 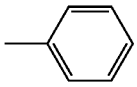 | 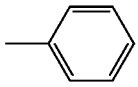 | H | 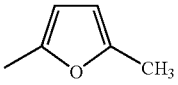 | 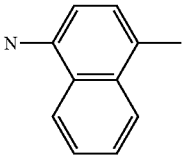 | 0 |

TABLE 29-continued
| | | | | | |
|---|---|---|---|---|---|
| 203 | 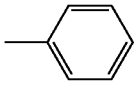 | 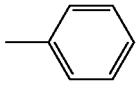 | H | 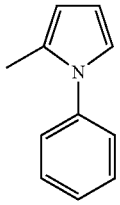 | 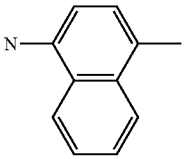 | 0 |
| Compound No. | $-(CR^2=CR^3)_n-$ | $R^4$ | $Ar^4$ | $Ar^5$ |
|---|---|---|---|---|
| 197 | — | H | H | 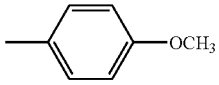 |
| 198 | — | H | H | 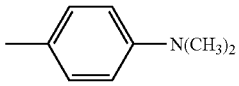 |
| 199 | — | H | H | 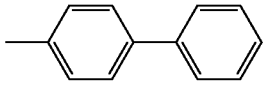 |
| 200 | — | H | H | 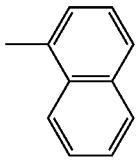 |
| 201 | — | H | 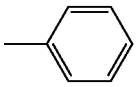 | 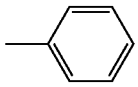 |
| 202 | — | H | H | 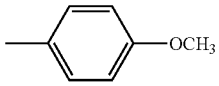 |
| 203 | — | H | H | 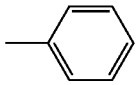 |
TABLE 30
| Compound No. | $Ar^1$ | $Ar^2$ | $R^1$ | $Ar^3$ | 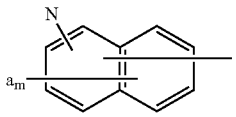 | n |
|---|---|---|---|---|---|---|
| 204 | 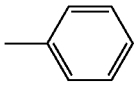 | 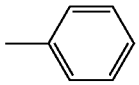 | H | 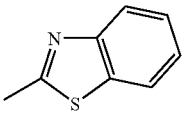 | 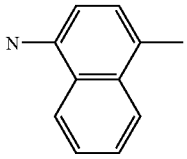 | 0 |
| 205 | 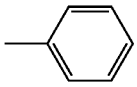 | 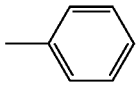 | H | 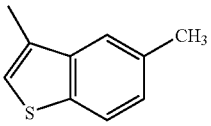 | 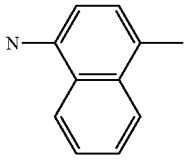 | 0 |

TABLE 30-continued
| | | | | | |
|---|---|---|---|---|---|
| 206 | 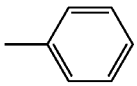 | 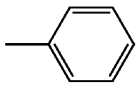 | H | 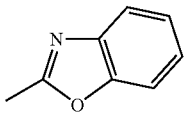 | 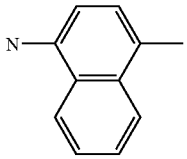 | 0 |
| 207 | 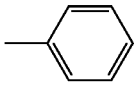 | 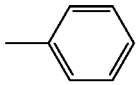 | H | 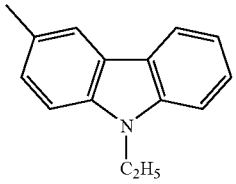 | 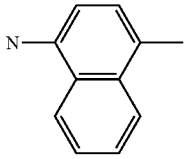 | 0 |
| 208 | 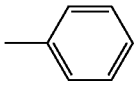 | 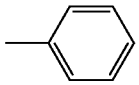 | H | 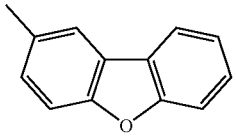 | 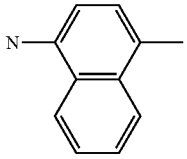 | 0 |
| 209 | 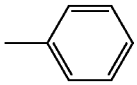 | 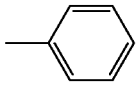 | $CH_3$ | 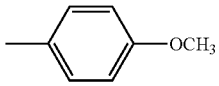 | 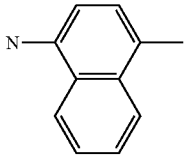 | 1 |
| 210 | 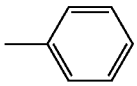 | 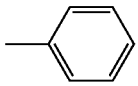 | $CH_2CF_3$ | 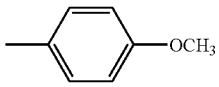 | 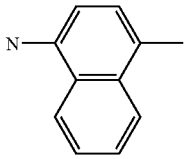 | 1 |
| Compound No. | $-(CR^2=CR^3)_n-$ | $R^4$ | $Ar^4$ | $Ar^5$ |
|---|---|---|---|---|
| 204 | — | H | H | 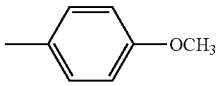 |
| 205 | — | H | 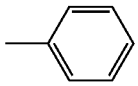 | 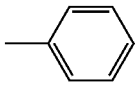 |
| 206 | — | H | H | 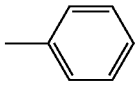 |
| 207 | — | H | H | 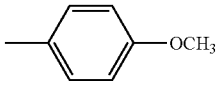 |
| 208 | — | H | 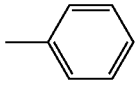 | 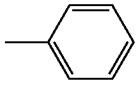 |
| 209 | CH═CH | H | H | 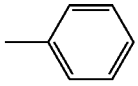 |

TABLE 30-continued
| | | | | | |
|---|---|---|---|---|---|
| 210 | CH═CH | | H | H | 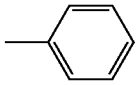 |
TABLE 31
| Compound No. | $Ar^1$ | $Ar^2$ | $R^1$ | $Ar^3$ | 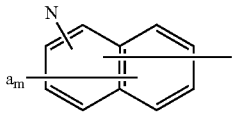 |
|---|---|---|---|---|---|
| 211 | 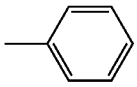 | 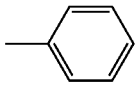 | $CH(CH_3)_2$ | 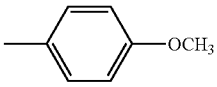 | 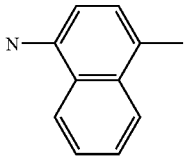 |
| 212 | 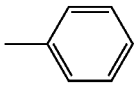 | 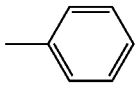 | F | 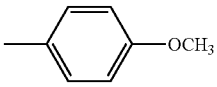 | 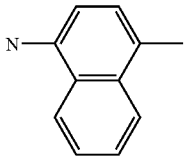 |
| 213 | 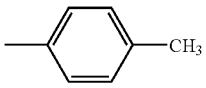 | 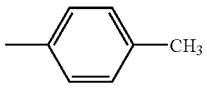 | H | 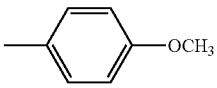 | 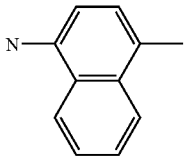 |
| 214 | 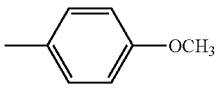 | 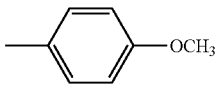 | H | 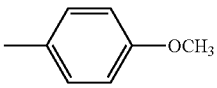 | 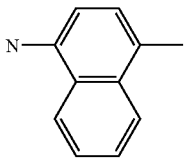 |
| 215 | 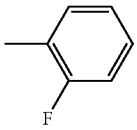 | 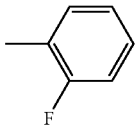 | H | 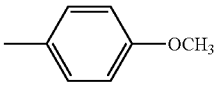 | 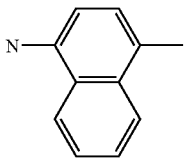 |
| 216 | 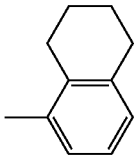 | 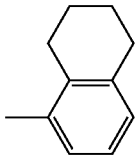 | H | 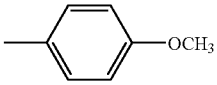 | 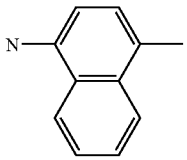 |
| 217 | 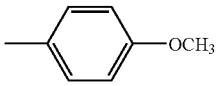 | 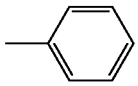 | H | 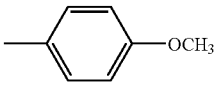 | 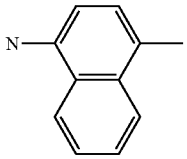 |

TABLE 31-continued
| Compound No. | n | $-(CR^2=CR^3)_n-$ | $R^4$ | $Ar^4$ | $Ar^5$ |
|---|---|---|---|---|---|
| 211 | 1 | CH=CH | H | H | 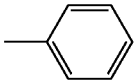 |
| 212 | 1 | CH=CH | H | H | 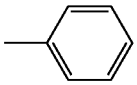 |
| 213 | 1 | CH=CH | H | H | 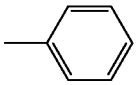 |
| 214 | 1 | CH=CH | H | H | 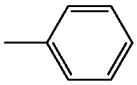 |
| 215 | 1 | CH=CH | H | H | 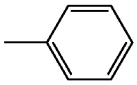 |
| 216 | 1 | CH=CH | H | H | 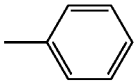 |
| 217 | 1 | CH=CH | H | H | 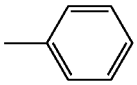 |
TABLE 32
| Compound No. | $Ar^1$ | $Ar^2$ | $R^1$ | $Ar^3$ | 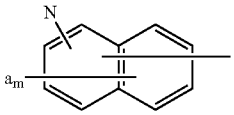 |
|---|---|---|---|---|---|
| 218 | 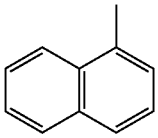 | 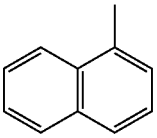 | H | 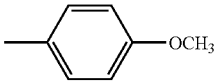 | 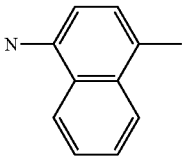 |
| 219 | 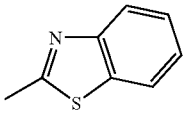 | 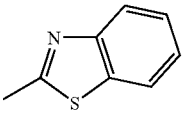 | H | 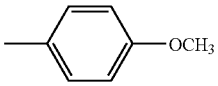 | 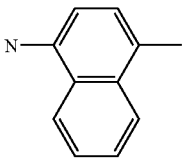 |
| 220 | 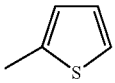 | 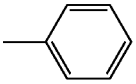 | H | 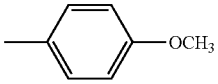 | 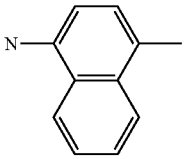 |

TABLE 32-continued

| Compound No. | n | $-(CR^2=CR^3)_n-$ | $R^4$ | $Ar^4$ | $Ar^5$ |
|---|---|---|---|---|---|
| 218 | 1 | CH=CH | H | H | 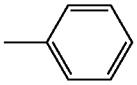 |
| 219 | 1 | CH=CH | H | H | 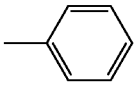 |
| 220 | 1 | CH=CH | H | H | 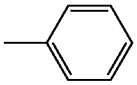 |

The enamine compound represented by formula (1) may be produced, for example, as follows:

First, an aldehyde compound or a ketone compound represented by formula (3) is reacted with a secondary amine compound represented by formula (4) through dehydrating condensation to give an enamine intermediate represented by formula (5):

(3)

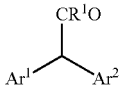

wherein $Ar^1$, $Ar^2$ and $R^1$ represent the same meanings as those defined in formula (1).

(4)

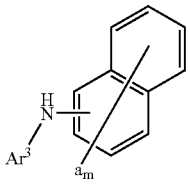

wherein $Ar^3$, a and m represent the same as those defined in formula (1).

(5)

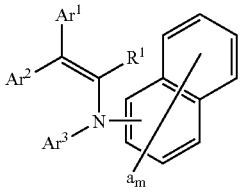

wherein $Ar^1$, $Ar^2$, $Ar^3$, $R^1$, a and m represent the same as those defined in formula (1).

The dehydrating condensation is effected, for example, as follows: an aldehyde or ketone compound represented by formula (3) and a secondary amine compound represented by formula (4) are, approximately in a ratio of 1/1 by mol, dissolved in a solvent of, for example, aromatic solvents, alcohols or ethers to prepare a solution. Specific examples of the usable solvent are toluene, xylene, chlorobenzene, butanol and diethylene glycol dimethyl ether. To the thus-prepared solution, added is a catalyst, for example, an acid catalyst such as p-toluenesulfonic acid, camphorsulfonic acid or pyridinium-p-toluenesulfonate acid, and reacted under heat. The amount of the catalyst to be added is preferably in a ratio by molar equivalent of from 1/10 to 1/1000 to the amount of the aldehyde or ketone compound represented by formula (3), more preferably from 1/25 to 1/500, most preferably from 1/50 to 1/200. During the reaction, water is formed and it interferes with the reaction. Therefore, the water formed is removed out of the system through azeotropic evaporation with the solvent used. As a result, the enamine intermediate represented by formula (5) is produced at high yield.

The enamine intermediate represented by formula (5) is formylated through Vilsmeier reaction or is acylated through Friedel-Crafts reaction to give an enamine-carbonyl intermediate of the following general formula (6). The formylation through Vilsmeier reaction gives an enamine-aldehyde intermediate, a type of enamine-carbonyl intermediate represented by formula (6) where $R^5$ is a hydrogen atom; and the acylation through Friedel-Crafts reaction gives an enamine-keto intermediate, a type of enamine-carbonyl intermediate represented by formula (6) where $R^5$ is a group except hydrogen atom.

(6)

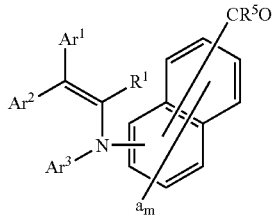

wherein $R^5$ is $R^4$ when n in formula (1) is 0, but is $R^2$ when n is 1, 2 or 3; and $Ar^1$, $Ar^2$, $Ar^3$, $R^1$, $R^2$, $R^4$ a, m and n are the same as defined in formula (1).

The Vilsmeier reaction is effected, for example, as follows: Phosphorus oxychloride and N,N-dimethylformamide (DMF), or phosphorus oxychloride and N-methyl-N-phenylformamide, or phosphorus oxychloride and N,N-diphenylformamide are added to a solvent such as N,N-dimethylformamide or 1,2-dichloroethane to prepare a Vilsmeier reagent.

1.0 equivalent of an enamine intermediate represented by formula (5) is added to from 1.0 to 1.3 equivalents of the thus-prepared Vilsmeier reagent, and stirred for 2 to 8 hours under heat at 60 to 110° C. Next, this is hydrolyzed with an aqueous alkaline solution such as 1 to 8 N aqueous sodium hydroxide or potassium hydroxide solution. This gives an enamine-aldehyde intermediate, a type of enamine-carbonyl intermediate represented by formula (6) where $R^5$ is a hydrogen atom, at high yield.

The Friedel-Crafts reaction is effected, for example, as follows: From 1.0 to 1.3 equivalents of a reagent prepared from aluminum chloride and an acid chloride, and 1.0 equivalent of an enamine intermediate represented by formula (5) are added to a solvent such as 1,2-dichloroethane, and stirred for 2 to 8 hours at −40 to 80° C. As the case may be, the reaction system is heated. Next, this is hydrolyzed with an aqueous alkaline solution such as 1 to 8 N aqueous sodium hydroxide or potassium hydroxide solution. This gives an enamine-keto intermediate, a type of enamine-carbonyl intermediate represented by formula (6) where $R^5$ is a group except hydrogen atom, at high yield.

Finally, the enamine-carbonyl intermediate represented by formula (6) is processed with a Wittig reagent of the following general formula (7-1) or (7-2) through Wittig-Horner reaction under basic condition to obtain an enamine compound represented by formula (1). In this step, when a Wittig reagent represented by formula (7-1) is used, it gives an enamine compound represented by formula (1) where n is 0; and when a Wittig reagent represented by formula (7-2) is used, it gives an enamine compound represented by formula (1) where n is 1, 2 or 3.

(7-1)

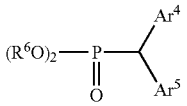

wherein $R^6$ represents an optionally-substituted alkyl group or an optionally-substituted aryl group; and $Ar^4$ and $Ar^5$ have the same meanings as those defined in formula (1).

(7-2)

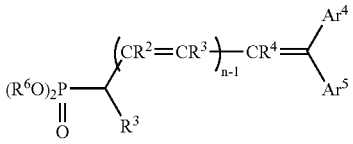

wherein $R^6$ represents an optionally-substituted alkyl group or an optionally-substituted aryl group; n indicates an integer of from 1 to 3; and $Ar^4$, $Ar^5$, $R^2$, $R^3$ and $R^4$ have the same meanings as those defined in formula (1).

The Wittig-Horner reaction is effected, for example, as follows: 1.0 equivalent of an enamine-carbonyl intermediate represented by formula (6), from 1.0 to 1.20 equivalents of a Wittig reagent represented by formula (7-1) or (7-2), and from 1.0 to 1.5 equivalents of a metal alkoxide base such as potassium t-butoxide, sodium ethoxide or sodium methoxide are added to a solvent such as toluene, xylene, diethyl ether, tetrahydrofuran (THF), ethylene glycol dimethyl ether, N,N-dimethylformamide or dimethylsulfoxide, and stirred for 2 to 8 hours at room temperature or under heat at 30 to 60° C. This gives an enamine compound represented by formula (1) at high yield.

As the enamine compound represented by the general formula (1), for example, one or more of materials selected from the group consisting of the exemplified compounds shown in Table 1 to Table 32 is used alone or as a mixture.

The enamine compound represented by the general formula (1) may also be used with other charge-transporting substance as a mixture. Other charge-transporting substance to be used in admixture with the enamine compound represented by the general formula (1) can include, for example, carbazole derivatives, oxazole derivatives, oxadiazole derivatives, thiazole derivatives, thiadiazole derivatives, triazole derivatives, imidazole derivatives, imidazolone compound, imidazolidine derivatives, bisimidazolidine derivatives, styryl derivatives, hydrazone compound, polycyclic aromatic compound, indole derivatives, pyrazoline derivatives, oxazolone derivatives, benzimidazole derivatives, quinazoline derivatives, benzofuran derivatives, acrydine derivatives, phenadine derivatives, aminostylbene derivatives, triarylamine derivatives, triarylmethane derivatives, phenylene diamine derivatives, stylbene derivatives and benzidine derivatives. In addition, a polymer having a group generated from those compounds in a main chain or a side chain, for example, poly(N-vinyl carbazole), poly(1-vinylpyrene) and poly(9-vinylanthracene) and the like are included.

In a case of using the enamine compound represented by the general formula (1) with other charge-transporting substance as a mixture, when the ratio of the charge-transporting substance other than the enamine compound represented by the general formula (1) is excessive. Sometimes the charge-transporting ability of the charge-transporting layer 13 becomes insufficient and the sensitivity and the light responsiveness of the photoreceptor 1 can not be obtained sufficiently. Thus, it is preferred to use a mixture containing the enamine compound represented by the general formula (1) as a main component for the charge-transporting substance.

For the binder resin constituting charge-transporting layer 13, those having excellent compatibility with the charge-transporting substance are selected. Specific examples of them can include, for example, a vinyl polymer resin such as polymethyl methacrylate resin, polystyrene resin or polyvinyl chloride resin, and a copolymer resin containing two or more repetitive units constituting them, and polycarbonate resin, polyester resin, polyester carbonate resin, polysulfone resin, phenoxy resin, epoxy resin, silicone resin, polyacrylate resin, polyamide resin, polyether resin, polyurethane resin and polyacrylamide resin and phenol resin. In addition, they can include thermosetting resins formed by partially crosslinking the resins. The resins may be used alone or two or more of them may be used as a mixture. Among the resins described above, polystyrene resins, polycarbonate resins, polyacrylate resins or polyphenyl oxides are used suitably, since they have a volumic resistivity of $10^{13}$ Ω·cm or more, and they are excellent in electric insulation property, and also excellent in the film-forming property and potential characteristics.

In the charge-transporting layer 13, a ratio A/B between the weight A of the enamine compound represented by the general formula (1) contained as a charge-transporting substance and the weight B of the binder resin is preferably 10/30 or more and 10/12 or less. By determining the ratio A/B to 10/30 or more and 10/12 or less and incorporating the binder resin at a high ratio in the charge-transporting layer 13, the abrasion resistance of the charge-transporting layer 13 can be improved to improve the durability of the photoreceptor 1.

In a case where the ratio A/B is determined as 10/12 or less and the ratio of the binder resin is increased, the ratio of the enamine compound represented by the general formula (1) contained as the charge-transporting substance is lowered as a result. In a case of using a charge-transporting substance known so far, when the ratio between the weight of the charge-transporting substance and the weight of the binder resin in the charge-transporting layer 13 (charge-transporting substance/binder resin) is determined as 10/12 or less in the same manner, the light responsiveness becomes insufficient and image defects sometimes occur. Since the enamine compound represented by the general formula (1) has, however, high charge-transporting ability, even when the ratio A/B is determined as 10/12 or less and the ratio of the enamine compound represented by the general formula (1) is lowered, the photoreceptor 1 can provide an image having sufficiently high light responsiveness and high image quality.

Accordingly, the photoreceptor 1 having high sensitivity and light responsiveness and excellent durability can be obtained by determining the ratio A/B as 10/30 or more and 10/12 or less.

Further, in a case where the ratio A/B is larger than 10/12 and the ratio of the binder resin becomes insufficient, the abrasion amount of the photosensitive layer 14 is increased to lower the chargeability of the photoreceptor 1. Alternatively, in a case where the ratio A/B is less than 10/30, and the ratio of the binder resin becomes excessive, the sensitivity of the photoreceptor 1 is lowered. Further, in a case where the charge-transporting layer 13 is formed by a dip coating method, since the viscosity of the coating liquid is increased to lower the coating velocity, the productivity is extremely worsened. Further, in a case where the amount of a solvent in the coating liquid is increased in order to suppress the increase of the viscosity of the coating liquid, brushing phenomenon occurs to cause clouding in the formed charge-transporting layer 13. Accordingly, a preferred range for the ratio A/B is determined as 10/30 or more and 10/12 or less.

In the charge-transporting layer 13, various kinds of additives may optionally be added. For example, in order to improve film-forming property, flexibility or surface smoothness, a plasticizer or a leveling agent or the like may be added to the charge-transporting layer 13. The plasticizer can include, for example, dibasic acid esters such as phthalic acid ester, fatty acid esters, phosphoric acid esters, chlorinated paraffins and epoxy plasticizers. The leveling agent can include, for example, a silicone-based leveling agent.

In order to enhance mechanical strength and improve electric characteristics, fine particles of inorganic compound or organic compound may be added to the charge-transporting layer 13.

The charge-transporting layer 13 is formed by dissolving or dispersing the charge-transporting substance containing the enamine compound represented by the general formula (1), a binder resin and, optionally, the additive described above in an appropriate solvent to prepare a coating liquid for charge-transporting layer and coating the obtained coating liquid on the charge-generating layer 12, in the same manner as forming the charge-generating layer 12 by coating.

The solvent for the coating liquid for charge-transporting layer can include, for example, aromatic hydrocarbons such as benzene, toluene, xylene and monochlorbenzene, halogenated hydrocarbons such as dichloromethane and dichloroethane, ethers such as tetrahydrofuran, dioxane and dimethoxy methylether, and aprotonic polar solvents such as N,N-dimethyl formamide or the like. The solvents may be used alone or two or more of them may be used as a mixture. In addition, the solvent may be used optionally with addition of a solvent such as alcohols, acetonitrile or methyl ethyl ketone. Among the solvents, non-halogen organic solvents are preferably used in view of the global environment.

The coating method for the coating liquid for charge-transporting layer can include, for example, spray methods, bar coating methods, roll coating methods, blade methods, ring methods and dip coating methods. Among the coating methods, since the dip coating method is particularly excellent in various points as described above, it has been used frequently in a case of forming the charge-transporting layer 13.

The thickness of the charge-transporting layer 13 is preferably 5 μm or more and 50 μm or less, more preferably, 10 μm or more and 40 μm or less. In a case where the thickness of the charge-transporting layer 13 is less than 5 μm, the charge retainability is lowered. In a case where the thickness of the charge-transporting layer 13 exceeds 50 μm, the resolution of the photoreceptor 1 is lowered. Accordingly, the preferred range for the thickness of the charge-transporting layer 13 is determined as 5 μm or more and 50 μm or less.

By laminating the charge-generating layer 12 and the charge-transporting layer 13 thus formed, a photosensitive layer 14 is constituted. Since a charge-generating function and a charge-transporting function are thus allotted on separate layers and an optimal material can be selected for each of the charge-generating function and the charge-transporting function as a material constituting each layer, the photoreceptor 1 having particularly high sensitivity can be obtained.

For each layer of the photosensitive layer 14, namely, the charge-generating layer 12 and the charge-transporting layer 13, one or more electron accepting substances and sensitizers such as dyes may be added in order to improve the sensitivity suppress the increase of the residual potential and fatigues due to repetitive use.

As the electron accepting substance, for example, acid anhydrides such as succinic acid anhydride, maleic acid anhydride, phthalic acid anhydride and 4-chloronaphthalic acid anhydride, etc., cyano compounds such as tetracyano ethylene, terephthal malone dinitrile, aldehydes such as 4-nitrobenzaldehyde, etc., anthraquinones such as anthraquinone and 1-nitroanthraquinone, polycyclic or heterocyclic nitro compounds such as 2,4,7-trinitrofluolenone, 2,4,5,7-tetranitrofluolenone, etc. or electron attracting materials such as diphenoquinone compounds can also be used. In addition, those electron attracting materials, which are polymerized, can also be used.

As the dye, organic photoconductive compounds such as xanthene dyes, thiazine dyes, triphenylmethane dyes, quinoline dyes or copper phthalocyanine can be used. The organic photoconductive compounds function as optical sensitizers.

In addition, an antioxidant or an ultraviolet absorber may be added to each layer of 12 and 13 of the photosensitive layer 14. Particularly, it is preferred to add an antioxidant or an ultraviolet absorber to the charge-transporting layer 13. This can improve the potential characteristics. Further, stability of the coating liquid upon forming each of the layers by coating can be enhanced. In addition, fatigue of the photoreceptor 1 due to repetitive use can be moderated to improve the durability.

As the antioxidant, phenol compounds, hydroquinone compounds, tocopherol compounds or amine compounds are used. Among them, hindered phenol derivatives or hindered amine derivatives or mixtures thereof are preferably used. The total amount of the antioxidant to be used is preferably 0.1 parts by weight or more and 50 parts by weight or less based on 100 parts by weight of the charge-transporting substance. In a case where the amount of the charge-transporting substance is less than 0.1 parts by weight based on 100 parts by weight of the charge-transporting substance, no sufficient effects can be obtained for improving the stability of the coating liquid and improving the durability of the photoreceptor. In a case where it is more than 50 parts by weight, this gives undesired effects on the characteristics of the photoreceptor. Accordingly, the preferred range for the amount of the antioxidant to be used is determined as 0.1 parts by weight or more and 50 parts by weight or less based on 100 parts by weight of the charge-transporting substance.

Figure 2:
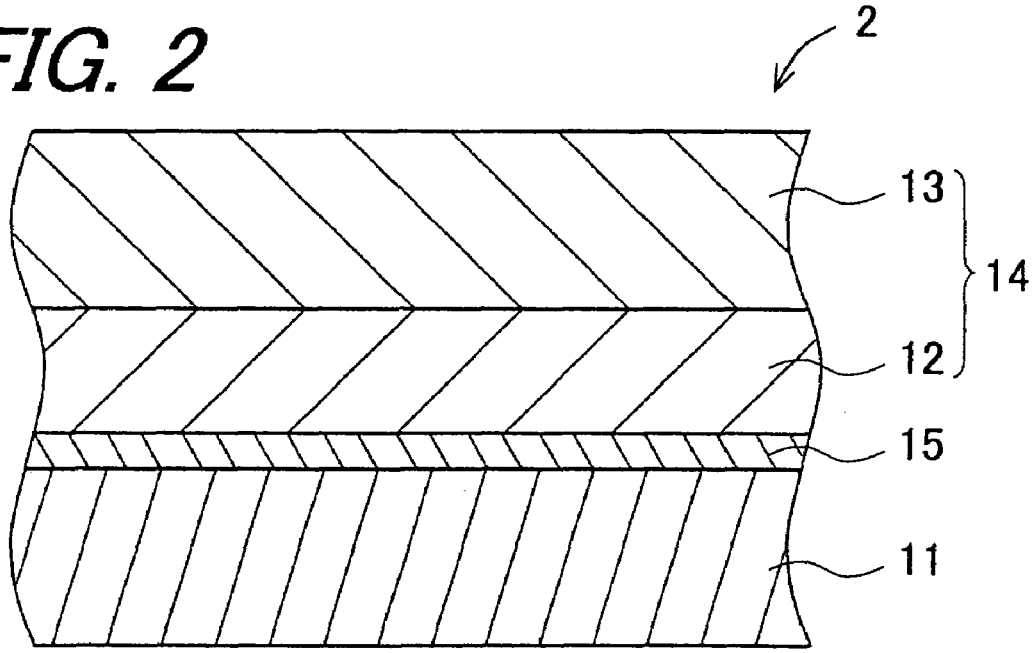
FIG. 2 is a partial cross sectional view schematically showing the constitution of an electrophotographic photoreceptor according to a second embodiment of the invention.

FIG. 2 is a fragmentary cross sectional view schematically showing the constitution of an electrophotographic photoreceptor 2 as a second embodiment of the invention. The electrophotographic photoreceptor 2 of this embodiment is similar with the electrophotographic photoreceptor 1 of the first embodiment in which corresponding portions carry identical reference numerals, for which explanations are to be omitted.

In the electrophotographic photoreceptor 2, it is to be noted that an intermediate layer 15 is provided between a conductive base body 11 and a photosensitive layer 14.

In a case where the intermediate layer 15 is not present between the conductive base body 11 and the photoreceptor 14, charges are injected from the conductive base body 11 to the photosensitive layer 14, the chargeability of the photosensitive layer 14 is lowered, and surface charges at a portion other than the portion to be eliminated by exposure are decreased to sometimes cause defects such as fogging to images. Particularly, in a case of forming images by using a reversal development process, since toners are deposited to a portion where the surface charges are decreased by exposure to form toner images, when the surface charges are decreased by the factors other than exposure, the toners are deposited to a white background and form minute black spots to case fogging to the images referred to as black pots to sometimes deteriorate a picture quality remarkably. That is, in a case where the intermediate layer 15 is not present between the conductive base body 11 and the photosensitive layer 14, chargeability is lowered in a minute region caused by the defects of the conductive base body 11 or the photosensitive layer 14 to sometimes cause fogging of images such as black spots to result in remarkable image defects.

In the electrophotographic photoreceptor 2 of this embodiment, since the intermediate layer 15 is provided between the conductive base body 11 and the photosensitive layer 14 as described above, injection of charges from the conductive base body 11 to the photosensitive layer 14 can be prevented. Accordingly, lowering of the chargeability of the photosensitive layer 14 can be prevented, decrease of the surface charges in the portion other than the portion to be eliminated by exposure can be suppressed and formation of defects to images such as fogging can be prevented.

In addition, the intermediate layer 15 may cover the surface defects of the conductive 11 to thereby make the base body have a uniform surface, and the film-forming ability of the photosensitive layer 14 is therefore enhanced. Further, the intermediate layer 15 prevents the photosensitive layer 14 from being peeled off from the conductive base body 11, and the adhesiveness between the conductive base body 11 and the photosensitive layer 14 is thereby enhanced.

The intermediate layer 15 may be a resin layer of various resin materials or an alumite layer. The resin material to form the resin layer includes, for example, various resins such as polyethylene resins, polypropylene resins, polystyrene resins, acrylic resins, polyvinyl chloride resins, polyvinyl acetate resins, polyurethane resins, epoxy resins, polyester resins, melamine resins, silicone resins, polyvinyl butyral resins and polyamide resins; copolymer resins containing at least two repetitive units of these resins; casein, gelatin, polyvinyl alcohol, and ethyl cellulose. Of those, especially preferred are polyamide resins. Also preferred are alcohol-soluble nylon resins. Preferred examples of the alcohol-soluble nylon resins are so-called copolymer nylons prepared through copolymerization with 6-nylon, 6,6-nylon, 6,10-nylon, 11-nylon, 2-nylon, or 12-nylon; and chemically-modified nylon resins such as N-alkoxymethyl-modified nylon and N-alkoxyethyl-modified nylon.

The intermediate layer 15 may contain particles such as metal oxide particles or the like. The particles may control the volume resistivity of the intermediate layer 15 and will be effective for further preventing the charge injection from the conductive base body 11 to the photosensitive layer 14, and, in addition, they may ensure the electric properties of the photoreceptors under different conditions.

The metal oxide particles may be, for example, particles of titanium oxide, aluminum oxide, aluminum hydroxide or tin oxide.

The intermediate layer 15 is formed, for example, by dissolving or dispersing the resin described above in an appropriate solvent to prepare a coating liquid for intermediate layer, and coating the coating liquid on the surface of the conductive base body 11. In a case of particles such as metal oxide particles described above in the intermediate layer 15, for example, the intermediate layer 15 can be formed by dispersing the particles in a resin solution obtained by dissolving the resin described above in an appropriate solvent to prepare a coating liquid for intermediate layer, and coating the coating liquid on the surface of the conductive base body 11.

For the solvent of the coating liquid for intermediate layer, water or various kinds of organic solvents or mixed solvents of them may be used. For example, a single solvent of water, methanol, ethanol or butanol or a mixed solvent such as of water and alcohol, two or more kinds of alcohols, acetone or dioxolane and alcohols, and chlorine type solvent such as dichloroethane, chloroform or trichloroethane and alcohols are used. Among the solvents, non-halogen organic solvents are preferably used in view of the global environment.

For the method of dispersing the particles in a resin solution, ordinary methods including the use of using a ball mill, sand mill, attritor, vibration mill, ultrasonic wave dispersing machine or paint shaker can be used.

In the coating liquid for intermediate layer the ratio of the total content C of the resin and the metal oxide to the solvent content D of the coating liquid, C/D by weight preferably falls between 1/99 and 40/60, more preferably between 2/98 and 30/70. The ratio by weight of the content of E of the resin to the content of F of the metal oxide, E/F preferably falls between 90/10 and 1/99, more preferably between 70/30 and 5/95.

For applying the coating liquid for intermediate layer to the base body, employable is a method of spraying, bar coating, roll coating, blade coating, ring coating or dipping. As so mentioned hereinabove, a dipping method is relatively simple and favorable in point of the productivity and the production costs, and it is much utilized in forming the intermediate layer 15.

The thickness of the intermediate layer 15 is preferably from 0.01 μm to 20 μm, more preferably from 0.05 μm to 10 μm. When the intermediate layer 15 is thinner than 0.01 μm, it could not substantially function as an intermediate layer 15, or that is, it could not cover the defects of the conductive base body 11 to form a uniform surface, and it could not prevent the charge injection from the conductive base body 11 to the photosensitive layer 14. As a result, the chargeability of the photosensitive layer 14 will lower. When the intermediate layer 15 is thicker than 20 μm and when such a thick intermediate layer 15 is formed according to a dipping method, the intermediate layer 15 will be difficult to form and, in addition, a uniform photoconductive layer 14 could not be formed on the intermediate layer 15, and the sensitivity of the photoreceptor will lower. Therefore, such a thick layer is unfavorable for the intermediate layer 15. Accordingly, a preferred range for the thickness of the intermediate layer 15 is defined as 0.01 μm or more and 20 μm or less.

Also in this embodiment, various kinds of additives such as plasticizers, leveling agents, fine particles of inorganic compounds or organic compounds, sensitizers such as electron accepting substances or dyes, antioxidants or UV-ray absorbers may be added to each of the layers 12, 13 of the photosensitive layer 14 in the same manner as in the first embodiment.

Figure 3:
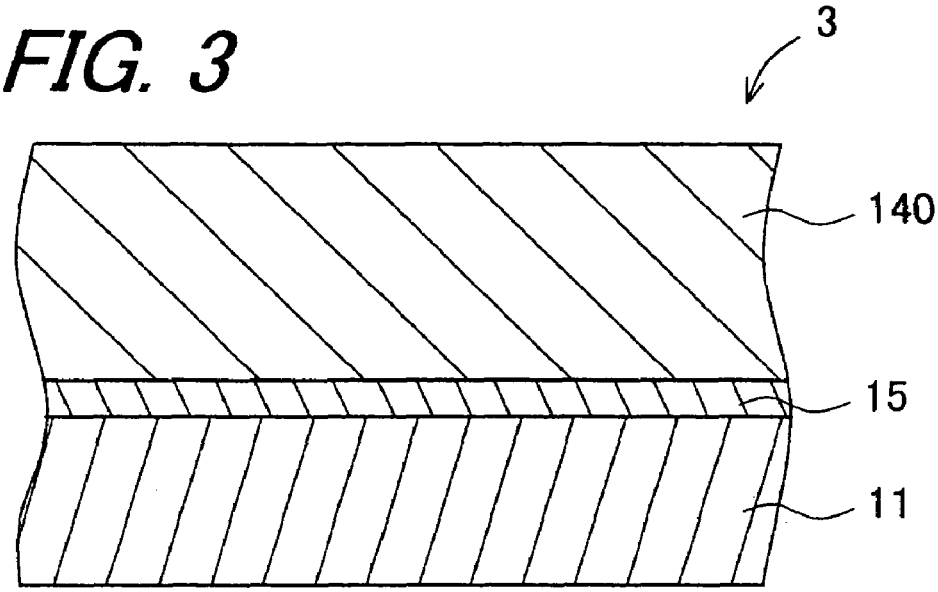
FIG. 3 is a partial cross sectional view schematically showing the constitution of an electrophotographic photoreceptor according to a third embodiment of the invention.

FIG. 3 is a fragmentary cross sectional view schematically showing the constitution of an electrophotographic photoreceptor 3 as a third embodiment of the invention. The electrophotographic photoreceptor 3 of this embodiment is similar with the electrophotographic photoreceptor 2 of the second embodiment in which corresponding portions carry identical reference numerals, for which explanations are to be omitted.

In the electrophotographic photoreceptor 3, it is to be noted that the photosensitive layer 140 is constituted with a single layer containing a charge-generating substance and a charge-transporting substance. That is, the electrophotographic photoreceptor 3 is a single layer type photoreceptor.

The single layer type photoreceptor 3 of this embodiment is suitable as a photoreceptor for use in a positively charged type image forming apparatus with less generation of ozone, and since the photosensitive layer 140 to be coated has only one layer, it is excellent compared with the stacked photoreceptor 1, 2 of the first embodiment or the second embodiment in view of the manufacturing cost and the yield.

Also in this embodiment, various kinds of additives such as plasticizers, leveling agents, fine particles of inorganic compounds or organic compounds, sensitizers such as electron accepting substances or dyes, antioxidants or UV-ray absorbers may be added to the photosensitive layer 140 in the same manner as in the photosensitive layer 14 of the first embodiment.

The photosensitive layer 140 is formed by the method identical with that for the charge-transporting layer 13 provided to the electrophotographic photoreceptor 1 of the first embodiment. For example, a coating liquid for use in the photosensitive layer is prepared by dissolving or dispersing the charge-generating substance, the charge-transporting substance containing the enamine compound represented by the general formula (1), preferably, the general formula (2), the binder resin and, optionally, the additives described above into an appropriate solvent similar with that for the coating liquid for use in the charge-transporting layer, and the photosensitive layer 140 can be formed by coating the coating liquid for use in the photosensitive layer to the surface of the intermediate layer 15, for example, by a dip coating method.

The ratio A'/B' between the weight A' for the enamine compound represented by the general formula (1) and the weight B' for the binder resin in the photosensitive layer 140 is, preferably, from 10/30 or more and 10/12 or less with the same reason as that for the ratio A/B between the weight A for the enamine compound represented by the general formula (1) and the weight B for the binder resin in the charge-transporting layer 13 of the first embodiment.

The thickness of the photosensitive layer 140 is, preferably, from 5 μm or more and 100 μm or less, more preferably, from 10 μm or more and 50 μm or less. In a case where the film thickness of the photosensitive layer 140 is less than 5 μm, the charge retainability is lowered. In a case where the thickness of the photosensitive layer 140 exceeds 100 μm, the productivity is lowered. Accordingly, a suitable range for the thickness of the photosensitive layer 140 is defined as 5 μm or more and 100 μm or less.

The surface free energy (γ) on the surface of the photoreceptors 1, 2 and 3, that is, the surface of the photosensitive layers 14, 140 in the first embodiment to the third embodiment according to the invention constituted as described above is controlled and set such that the value calculated according to the extended Forkes's theory is 20.0 mN/m or more, 35.00 mN/m or less, preferably, 28.0 mN/m or more and 35.0 mN/m or less.

In a case where the surface free energy (γ) is less than 20.0 mN/m, disadvantages caused by the decrease of the adhesion of obstacles such as toners to the photoreceptor become remarkable. One of the disadvantages is that the transfer ratio of the toners to the recording paper is increased along with decrease of the adhesion of the obstacles such as toners to the photoreceptor, which decreases the residual toners directed to the cleaning blade. As a result, the cleaning blade is not pressed to the surface of the photoreceptor sufficiently to cause reversal of the cleaning blade and so-called blade skip marks of leaving streak-like residues of the toners on the surface of the photoreceptor to lower the picture quality such as by occurrence of black streaks. Further, since the scattering of the toners is promoted along with the decrease of the adhesion, scattered toners tend to be deposited inside of the image forming apparatus and the surface of the photoreceptor to cause the effect of the scattered toners, for example, fogging of images on the surface or the rear face of the recording paper. In a case where the surface free energy (γ) exceeds 35.0 mN/m, since the adhesion of the obstacles such as toners and paper dusts to the surface of the photoreceptor increases, the obstacles are caught by the cleaning blade tending to injure the surface of the photoreceptor and the cleaning property is worsened due to the surface injury. Accordingly, the surface free energy (γ) is defined as 20.0 mN/m or more and 35.0 mN/m or less.

The control and the setting of surface free energy (γ) on the surface of the photoreceptor to the range described above is conducted as described below. This can be attained by introducing a material having a relatively low surface free energy value, for example, a fluoric material typically represented, for example, by polytetrafluoroethylene (simply referred to as PTFE), or a polysiloxane material into the photosensitive layer 14 or the photosensitive layer 140 and controlling the content thereof. Alternatively, it can be attained also by changing the kind of the charge-generating substance, the charge-transporting substance and the binder resin contained in the photosensitive layer 14 or the photosensitive layer 140, or the compositional ratio thereof. Further, this can be attained also by controlling the drying temperature upon forming the photosensitive layer 14 or the photosensitive layer 140. In a case of providing a surface protective layer comprising a resin or the like optionally on the photosensitive layers 14, 140, control for the surface free energy (γ) on the surface of the photoreceptor can be attained by changing the kind of the resin as a main component of the surface protective layer, or controlling the drying temperature the coating liquid for use in the surface protective layer of after coating.

Since the photoreceptor 1, 2 or 3 contains the enamine compound of high charge-transporting ability represented by the general formula (1), preferably, the general formula (2) as the charge-transporting substance in the charge-transporting layer 13 or the photosensitive layer 140 as described above, the surface free energy (γ) on the photoreceptor can be controlled and set to the range described above without lowering the sensitivity and the light responsiveness. Accordingly, the photoreceptors 1, 2 and 3 excellent in all of the electric characteristics, the cleaning property and the circumstantial stability can be attained. Particularly, by constituting the photosensitive layer 14 as a stacked type comprising a plurality of stacked layers as in the photoreceptor 1 of the first embodiment or the photoreceptor 2 of the second embodiment, since the degree of freedom for the materials and the combination thereof constituting each of the layers is increased, the value for the surface free energy on the surface of the photoreceptor can be set easily within a desired range.

The surface free energy (γ) on the surface of the photoreceptor 1 which is determined in this manner is obtained by measuring adhesions with known reagents used as the dipolar component, the dispersion component and the hydrogen-bonding component of the surface free energy. Specifically, contact angles to the surface of the photoreceptor 1 are measured with a contact angle meter CA-X (trade name: manufactured by Kyowa Kaimen K.K.) using pure water, methylene iodide and α-bromonaphthalene as reagents. On the basis of the measured results, the surface free energies of the respective components can be calculated by using a surface free energy analysis software EG-11 (tradename: manufactured by Kyowa Kaimen K.K.) Incidentally, the reagents are not limited to the foregoing pure water, methylene iodide and α-bromonaphthalene, and an appropriate combination of reagents can be used as the dipolar component, the dispersion component and the hydrogen-bonding component. The measuring method is not limited to the foregoing method. For example, the Wilhelmy method (hanging plate method) or the Du Nouy method is also available.

The electrophotographic photoreceptor according to the invention is not restricted to the constitutions for the electrophotographic photoreceptors 1, 2 and 3 of the first embodiment to the third embodiment shown in FIG. 1 to FIG. 3 but it may be of any other different constitutions so long as the enamine compound represented by the general formula (1) is contained in the photosensitive layer and the surface free energy (γ) on the surface of the photoreceptor is set within the range described above.

Figure 4:
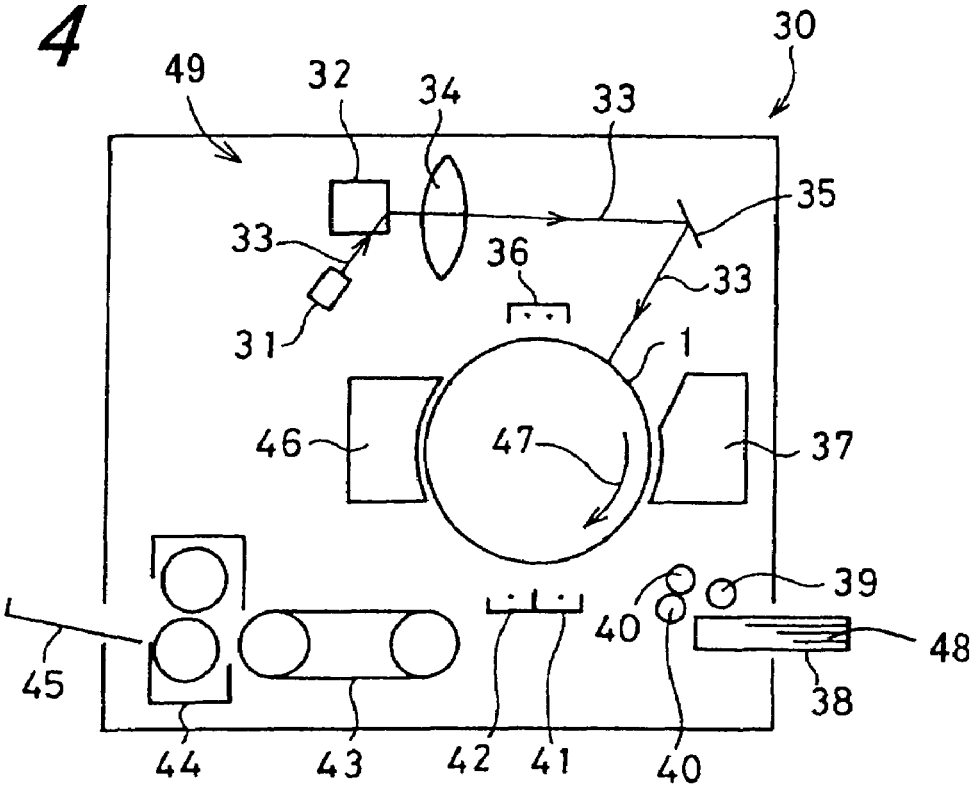
FIG. 4 is a side elevational view for arrangement schematically showing the constitution of an image forming apparatus according to a fourth embodiment of the invention.

FIG. 4 is a side elevational view for the arrangement schematically showing the constitution of an image forming apparatus 30 as a fourth embodiment according to the invention. The image forming apparatus 30 shown in FIG. 4 is a laser printer on which the photoreceptor 1 of the first embodiment according to the invention is mounted. The constitution and the image forming operation of the laser printer 30 are to be described with reference to FIG. 4. The laser printer 30 shown in FIG. 4 is an example for the invention and the image forming apparatus of the invention is not restricted by the contents of the following descriptions.

The laser printer 30 as an image forming apparatus includes a photoreceptor 1, a semiconductor laser 31, a rotational polygonal mirror 32, a focusing lens 34, a mirror 35, a corona charger 36 as a charging means, a developing device 37 as a developing means, a transfer paper cassette 38, a paper feed roller 39, a register roller 40, a transfer charger 41 as a transfer means, a separation charger 42, a conveyor belt 43, a fixing device 44 as fixing means, a paper discharge tray 45 and a cleaner 46 as cleaning means. The semiconductor laser 31, the rotational polygonal mirror 32, the focusing lens 34 and the mirror 35 constitute an exposure means 49.

The photoreceptor 1 is mounted on the laser printer 30 such that it can rotate in the direction of an arrow 47 by a driving means not illustrated. A laser beam 33 emitted from the semiconductor laser 31 is scanned repetitively by the rotational polygonal mirror 32 to the surface of the photoreceptor 1 in the longitudinal direction (main scanning direction) thereof. The image focusing lens 34 has an f-θ characteristic and the laser beam 33 is reflected on the mirror 35 and focused to the surface of the photoreceptor 1 for exposure. By scanning and focusing the laser beam 33 as described above while rotating the photoreceptor 1, electrostatic latent images corresponding to the image information are formed on the surface of the photoreceptor 1.

The corona charger 36, the developing device 37, the transfer charger 41, the separation charger 42, and the cleaner 46 are arranged in this order from the upstream to the downstream in the rotational direction of the photoreceptor 1 shown by the arrow 47. The corona charger 36 is situated upstream to the focusing point of the laser beam 33 in the rotational direction of the photoreceptor 1 to uniformly charge the surface of the photoreceptor 1. Accordingly, the laser beam 33 exposes the surface of the photoreceptor 1 charged uniformly and a difference is caused between the charged amount for the exposed by the laser beam 33 and the charged amount for the not exposed portion to form electrostatic latent images described above.

The developing device 37 is situated downstream to the focusing point of the laser beam 33 in the rotational direction of the photoreceptor 1, supplies toners to the electrostatic latent images formed on the surface of the photoreceptor 1 and develops the electrostatic latent images as toner images. Transfer paper 48 contained in the transfer paper cassette 38 is taken out one by one by the paper feed roller 39 and given by the register roller 40 to the transfer charger 41 in synchronization with exposure to the photo receptor 1. The toner images are transferred to the transfer paper 48 by the transfer charger 41. The separation charger 42 situated adjacent with the transfer charger 41 eliminates charges from the transfer paper 48 transferred with the toner images and separates the paper from the photoreceptor 1.

The transfer paper 48 separated from the photoreceptor 1 is conveyed by the conveyer belt 43 to the fixing device 44 and the toner images are fixed by the fixing device 44. The transfer paper 48 thus formed with the images is discharged to the paper discharge tray 45. The photoreceptor 1 further rotating continuously after separation of the transfer paper 48 by the separation charger 42 is cleaned off the obstacles such as toners and paper dusts remaining on the surface thereof by the cleaner 46. The photoreceptor 1 cleaned at the surface by the cleaner 46 is charge-eliminated by a not illustrated charge elimination lamp disposed together with the cleaner 46 and then rotated further, for which a series of image forming operations starting from charging of the photoreceptor 1 described above are repeated.

Since the surface free energy on the surface of the photoreceptor 1 provided to the laser printer 30 is set to the suitable range described above, toners forming the toner images in the image formation by the laser printer 30 are easily moved and transferred from the surface of the photoreceptor 1 to the transfer paper 48 with less residual toners, and paper dusts, etc. on the transfer paper 48 that contact during transfer are also less adhered to the surface of the photoreceptor 1. Further, obstacles such as toners and paper dusts adhered to the surface of the photoreceptor 1 are easily removed by the cleaning blade of the cleaner 46 disposed for cleaning the surface of the photoreceptor 1 after transferring the toner images. Accordingly, since the polishing performance of the cleaning blade can be set at a weak level, and the pressure of the cleaning blade abutting against the surface of the photoreceptor 1 can also be set to a low level, the life of the photoreceptor 1 can be extended. Further, since the surface of the photoreceptor 1 after the cleaning is free from the deposition of obstacles such as the toners and the paper dusts and can be always kept clean, images of good picture quality can be formed stably for a long period of time.

Further, since the photoreceptor 1 provided to the laser printer 30 contains the enamine compound represented by the general formula (1), preferably, the enamine compound represented by the general formula (2) in the photosensitive layer 14 and is excellent also in the electric characteristics and the circumstantial stability, the laser printer 30 can form images at high quality, for example, also under low temperature and low humidity circumstances.

Accordingly, in the laser printer 30 as the image forming apparatus according to this invention, images can be formed with no degradation of the picture quality for a long period of time under various circumstances. Further, since the photoreceptor 1 has a long life and cleaner 46 can be constituted simply and the conveniently, the image forming apparatus 30 at a reduced cost and with less maintenance frequency can be obtained. Further, since the electric characteristics of the photoreceptor 1 are not deteriorated even when exposed to light, degradation of the picture quality caused by exposure of the photoreceptor 1 to light, for example, during maintenance can be suppressed.

The laser printer 30 as the image forming apparatus according to this invention described above is not restricted to the constitution shown in FIG. 4 described above but it may be of any other different constitutions so long as the photoreceptor according to the invention can be used therefor.

For example, in a case where the outer diameter of the photoreceptor is 40 mm or less, the separation charger 42 may not be provided. Further, the photoreceptor 1 may be constituted integrally with at least one of the corona charger 36, the developing device 37 and the cleaner 46 as a process cartridge. For example, it may adopt a constitution such as a process cartridge assembled with the photoreceptor 1, the corona charge 36, the developing device 37 and the cleaner 46, a process cartridge assembled with the photoreceptor 1, the corona discharger 36 and the developing device 37, a process cartridge assembled with the photoreceptor 1 and the cleaner 46, or a process cartridge assembled with the photoreceptor 1 and the developing device 37. Use of the process cartridge in which several members are integrated can facilitate the maintenance and administration of the apparatus.

Further, the charger is not restricted to the corona charger 36 but a corotron charger, a scorotoron charger, a saw teeth charger or a roller charger can be used. As the developing device 37 at least one of contact type and non-contact type may be used. As the cleaner 46, a brush cleaner or the like may also be used. It may adopt a constitution of saving the charge elimination lamp by considering the timing for applying a high voltage such as a developing bias. Particularly, charge-elimination lamp is often saved, for example, in the apparatus with a smaller diameter of the photoreceptor or in a low end printer at low speed.

EXAMPLE

The invention is to be described more specifically by using examples but the invention is not restricted to the contents of the following descriptions.

Preparation Example

Preparation examples for the enamine compound represented by the general formula (1) are to be described.

Production Example 1

Production of Compound No. 1

Production Example 1-1

Production of Enamine Intermediate 23.3 g (1.0 equivalent) of N-(p-tolyl)-α-naphthylamine of the following structural formula (8), 20.6 g (1.05 equivalents) of diphenylacetaldehyde of the following structural formula (9), and 0.23 g (0.01 equivalents) of DL-10-camphorsulfonic acid were added to 100 ml of toluene and heated, and these were reacted for 6 hours while the side-product, water was removed out of the system through azeotropic distillation with toluene. After thus reacted, the reaction solution was concentrated to about 1/10, and gradually and dropwise added to 100 ml of hexane that was vigorously stirred, and this gave a crystal. The crystal was taken out through filtration, and washed with cold ethanol to obtain 36.2 g of a pale yellow powdery compound.

(8)

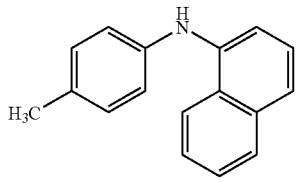

(9)

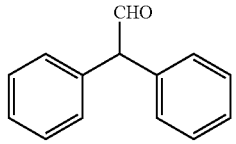

Thus obtained, the compound was analyzed through liquid chromatography-mass spectrometry (LC-MS), which gave a peak at 412.5 corresponding to the molecular ion $[M+H]^+$ of an enamine intermediate (calculated molecular weight: 411.20) of the following structural formula (10) with a proton added thereto. This confirms that the compound obtained herein is the enamine intermediate represented by formula (10) (yield: 88%). In addition, the data of LC-MS further confirm that the purity of the enamine intermediate obtained herein is 99.5%.

(10)

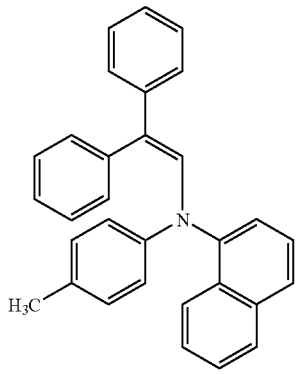

As in the above, the dehydrating condensation of N-(p-tolyl)-α-naphthylamine, a secondary amine represented by formula (8), and diphenylacetaldehyde, an aldehyde compound represented by formula (9) gives the enamine intermediate represented by formula (10).

Production Example 1-2

Production of Enamine-Aldehyde Intermediate 9.2 g (1.2 equivalents) of phosphorus oxychloride was gradually added to 100 ml of anhydrous N,N-dimethylformamide (DMF) and stirred for about 30 minutes to prepare a Vilsmeier reagent. 20.6 g (1.0 equivalent) of the enamine intermediate represented by formula (10) obtained in Production Example 1-1 was gradually added to the solution with cooling with ice. Next, this was gradually heated up to 80° C., and stirred for 3 hours while kept heated at 80° C. After thus reacted, the reaction solution was left cooled, and then this was gradually added to 800 ml of cold 4 N aqueous sodium hydroxide solution to form a precipitate. Thus formed, the precipitate was collected through filtration, well washed with water, and then recrystallized from a mixed solvent of ethanol and ethyl acetate to obtain 20.4 g of an yellow powdery compound.

Thus obtained, the compound was analyzed through LC-MS, which gave a peak at 440.5 corresponding to the molecular ion $[M+H]^+$ of an enamine-aldehyde intermediate (calculated molecular weight: 439.19) of the following structural formula (11) with a proton added thereto. This confirms that the compound obtained herein is the enamine-aldehyde intermediate represented by formula (11) (yield: 93%). In addition, the data of LC-MS further confirm that the purity of the enamine-aldehyde intermediate obtained herein is 99.7%.

(11)

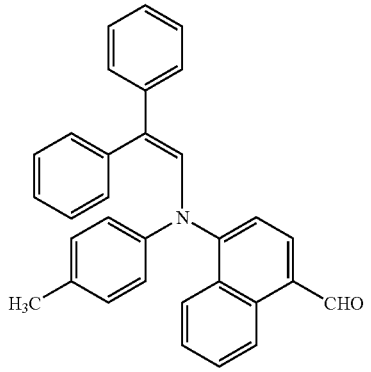

As in the above, the formylation of the enamine intermediate represented by formula (10) through Vilsmeier reaction gives the enamine-aldehyde intermediate represented by formula (11).

Production Example 1-3

Production of Compound No. 1

8.8 g (1.0 equivalent) of the enamine-aldehyde intermediate represented by formula (11) obtained in Production Example 1-2, and 6.1 g of diethyl cinnamylphosphonate of the following structural formula (12) were dissolved in 80 ml of anhydrous DMF, and 2.8 g (1.25 equivalents) of potassium t-butoxide was gradually added to the solution at room temperature, then heated up to 50° C., and stirred for 5 hours while kept heated at 50° C. The reaction mixture was left cooled, and poured into excess methanol. The deposit was collected, and dissolved in toluene to prepare a toluene solution thereof. The toluene solution was transferred into a separating funnel and washed with water, and the organic layer was taken out. Thus taken out, the organic layer was dried with magnesium sulfate. Solid matter was removed from the thus-dried organic layer, which was then concentrated and subjected to silica gel column chromatography to obtain 10.1 g of an yellow crystal.

(12)

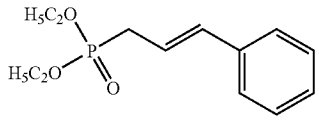

Thus obtained, the crystal was analyzed through LC-MS, which gave a peak at 540.5 corresponding to the molecular ion $[M+H]^+$ of the intended enamine compound, Compound No. 1 in Table 1 (calculated molecular weight: 539.26) with a proton added thereto.

Figure 5:
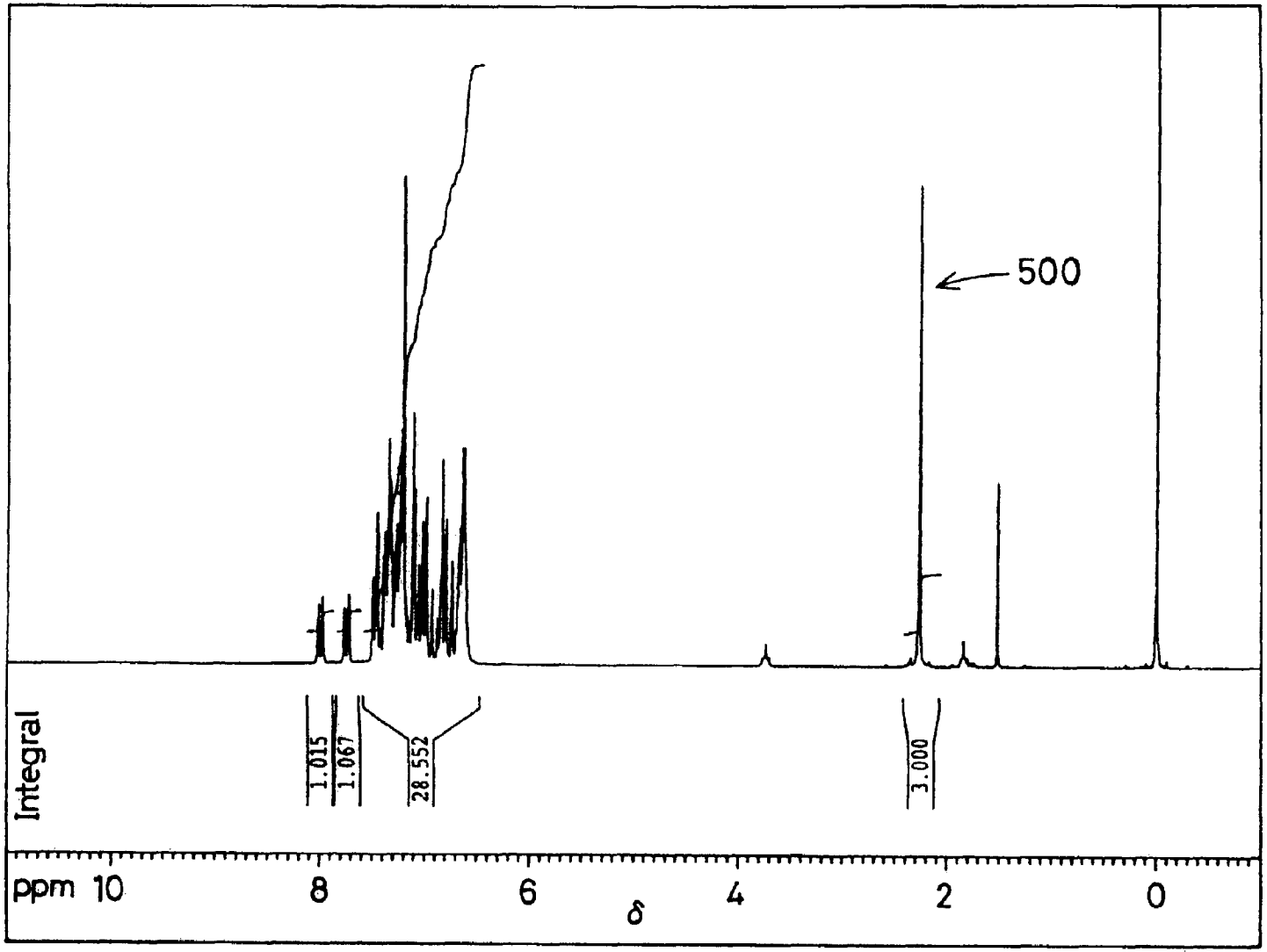
FIG. 5 is a $^{1}$H-NMR spectrum of a product in Production Example 1-3.
Figure 6:
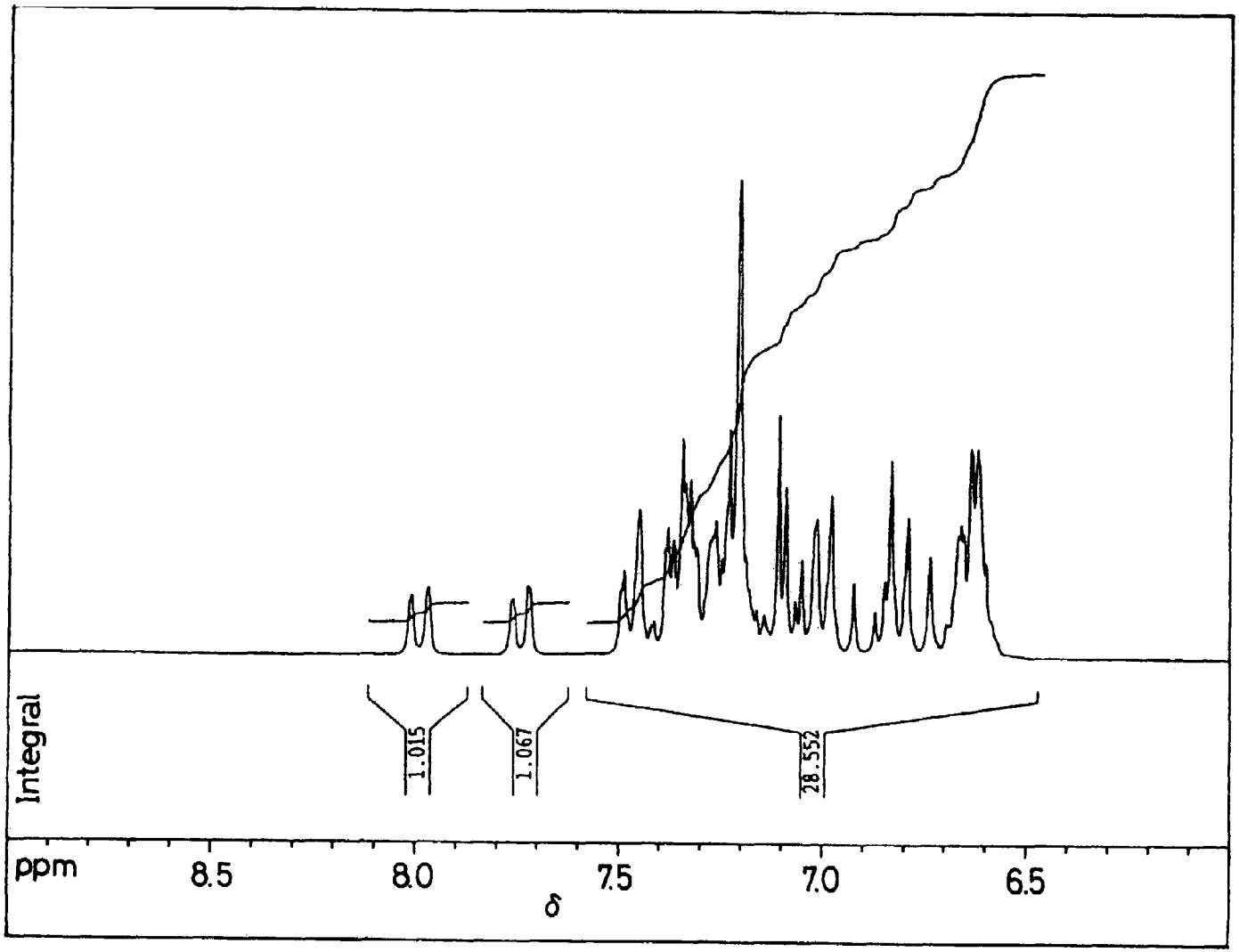
FIG. 6 is an enlarged view of the spectrum of FIG. 5 in the range of from 6 ppm to 9 ppm.
Figure 7:
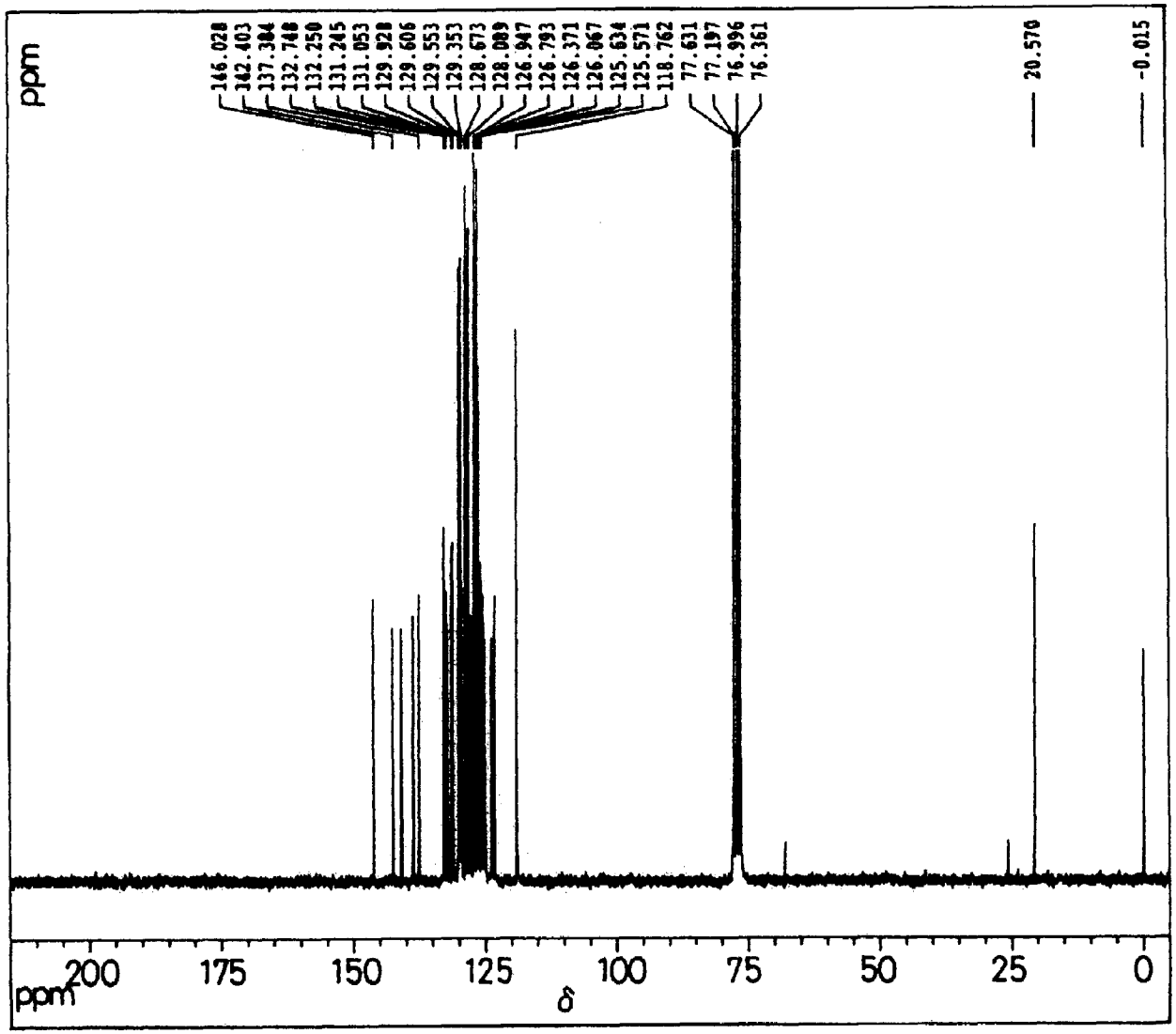
FIG. 7 is a $^{13}$C-NMR spectrum in ordinary measurement of the product in Production Example 1-3.
Figure 8:
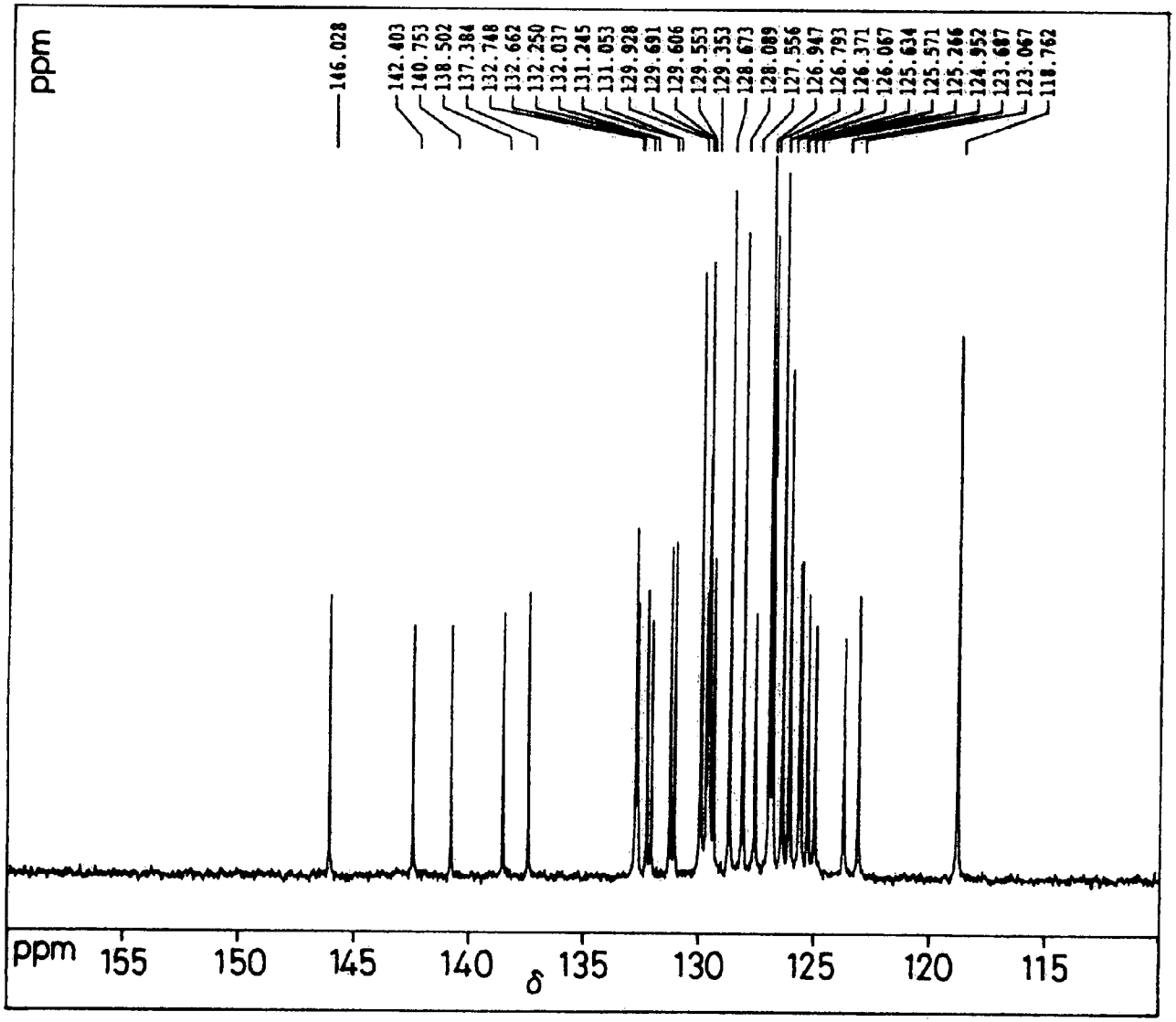
FIG. 8 is an enlarged view of the spectrum of FIG. 7 in the range of from 110 ppm to 160 ppm.
Figure 9:
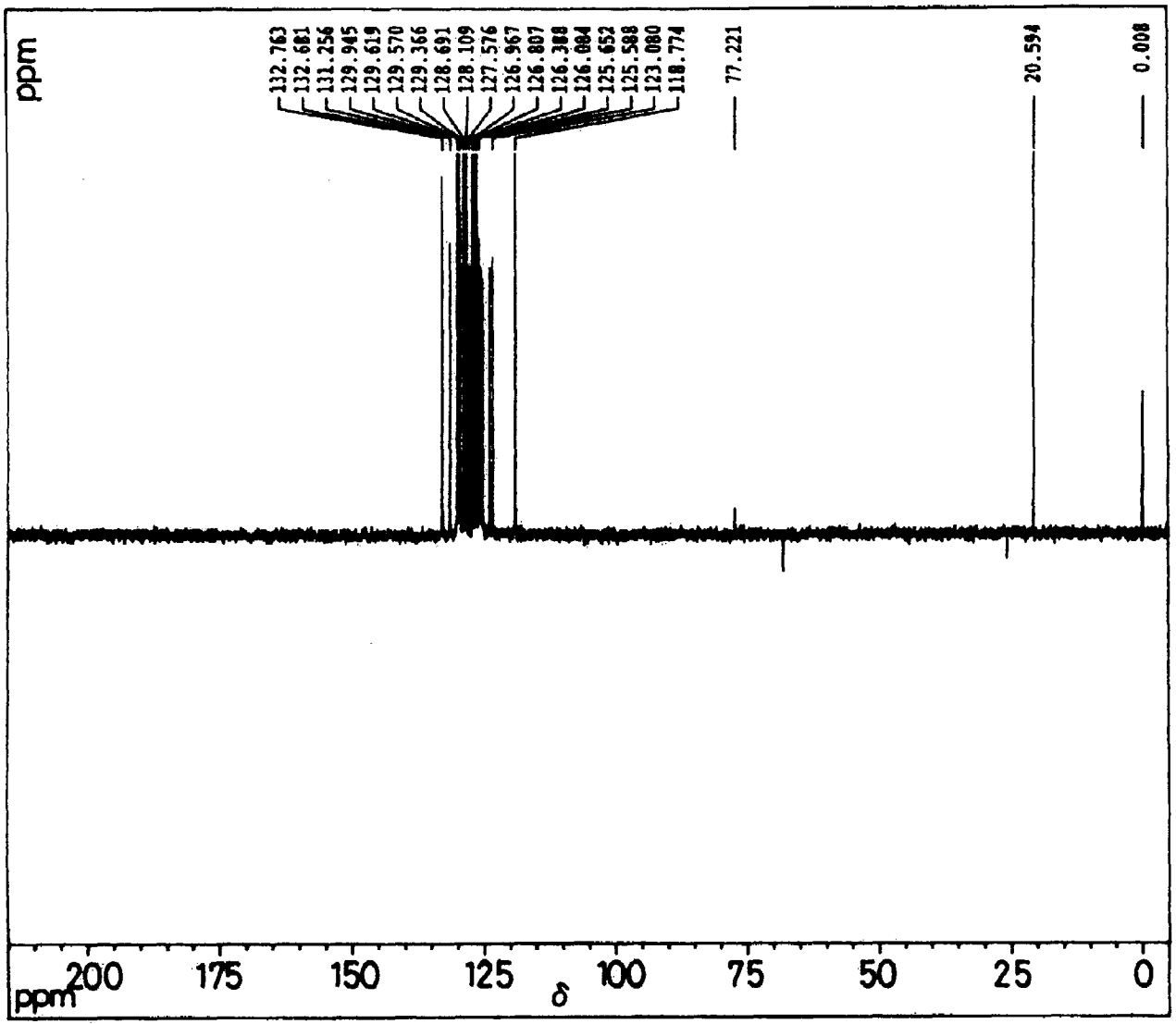
FIG. 9 is a $^{13}$C-NMR spectrum in DEPT135 measurement of the product in Production Example 1-3.
Figure 10:
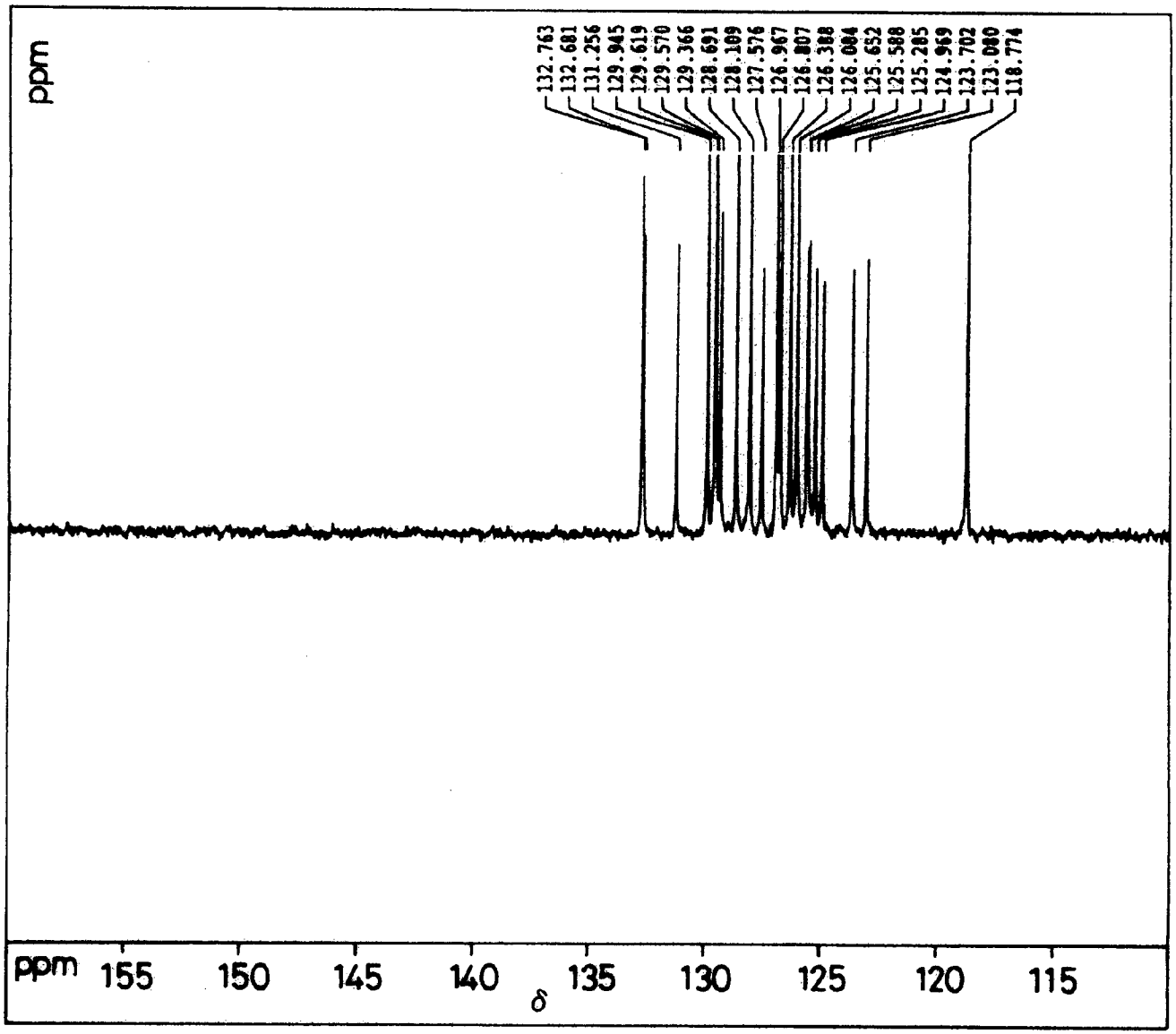
FIG. 10 is an enlarged view of the spectrum of FIG. 9 in the range of from 110 ppm to 160 ppm.

The nuclear magnetic resonance (NMR) spectrum of the crystal in heavy chloroform (chemical formula: $CDCl_3$) was measured, and this spectrum supports the structure of the enamine compound, Compound No. 1. FIG. 5 is the $^1$H-NMR spectrum of the product in this Production Example 1-3, and FIG. 6 is an enlarged view of the spectrum of FIG. 5 in the range of from 6 ppm to 9 ppm. FIG. 7 is the $^{13}$C-NMR spectrum in ordinary measurement of the product in Production Example 1-3, and FIG. 8 is an enlarged view of the spectrum of FIG. 7 in the range of from 110 ppm to 160 ppm. FIG. 9 is the $^{13}$C-NMR spectrum in DEPT135 measurement of the product in Production Example 1-3, and FIG. 10 is an enlarged view of the spectrum of FIG. 9 in the range of from 110 ppm to 160 ppm. In FIG. 5 to FIG. 10, the horizontal axis indicates the chemical shift δ (ppm) of the compound analyzed. In FIG. 5 and FIG. 6, the data written between the signals and the horizontal axis are relative integral values of the signals based on the integral value, 3, of the signal indicated by the reference numeral 500 in FIG. 5.

The data of LC-MS and the NMR spectrometry confirm that the crystal obtained herein is the enamine compound, Compound No. 1 (yield: 94%). In addition, the data of LC-MS further confirm that the purity of the enamine compound, Compound No. 1 obtained herein is 99.8%.

As in the above, the Wittig-Horner reaction of the enamine-aldehyde intermediate represented by formula (11) and the Wittig reagent, diethyl cinnamylphosphonate represented by formula (12) gives the enamine compound, Compound No. 1 shown in Table 1.

Production Example 2

Production of Compound No. 61

In the same manner as in Production Example 1 except that 4.9 g (1.0 equivalent) of N-(p-methoxyphenyl)-α-naphthylamine was used in place of 23.3 g (1.0 equivalent) of N-(p-tolyl)-α-naphthylamine represented by formula (8), an enamine intermediate was produced (yield: 94%) through dehydrating condensation and an enamine-aldehyde intermediate was produced (yield: 85%) through Vilsmeier reaction, and this was further subjected to Wittig-Horner reaction to obtain 7.9 g of an yellow powdery compound. The equivalent relationship between the reagent and the base body used in each reaction was the same as that in Production Example 1.

Thus obtained, the compound was analyzed through LC-MS, which gave a peak at 556.7 corresponding to the molecular ion $[M+H]^+$ of the intended enamine compound, Compound No. 61 in Table 9 (calculated molecular weight: 555.26) with a proton added thereto.

Figure 11:
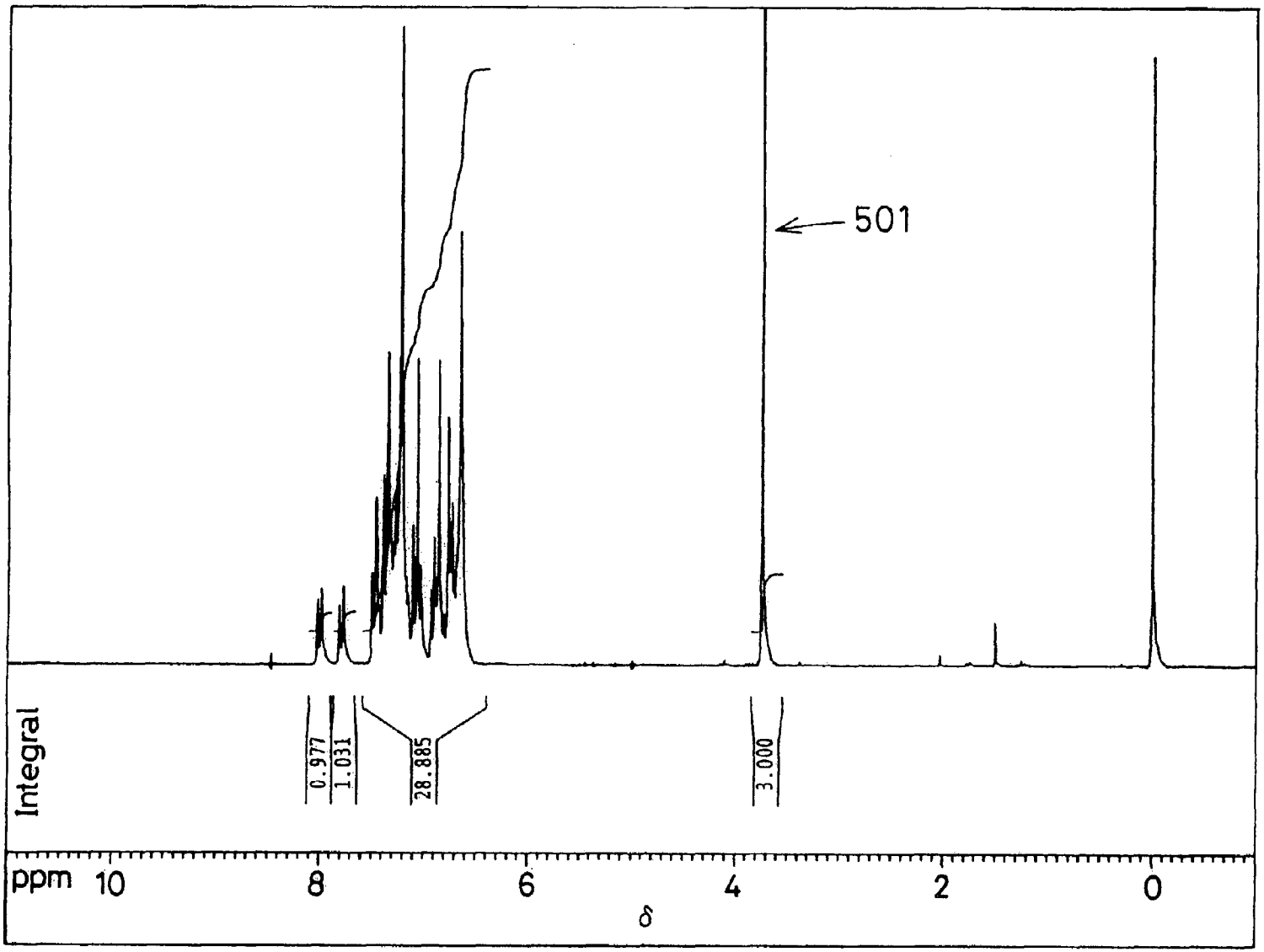
FIG. 11 is a $^{1}$H-NMR spectrum of the product in Production Example 2.
Figure 12:
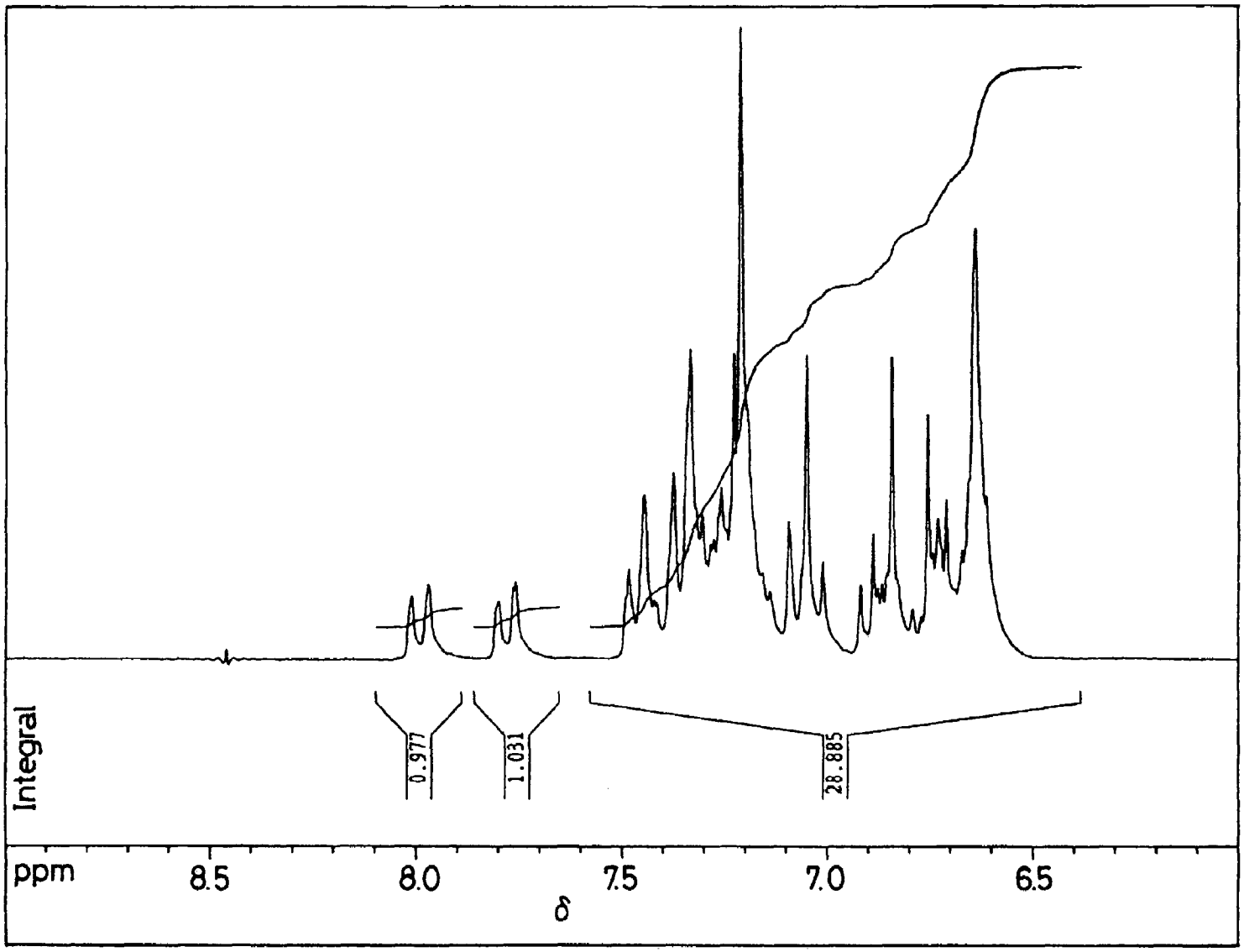
FIG. 12 is an enlarged view of the spectrum of FIG. 11 in the range of from 6 ppm to 9 ppm.
Figure 13:
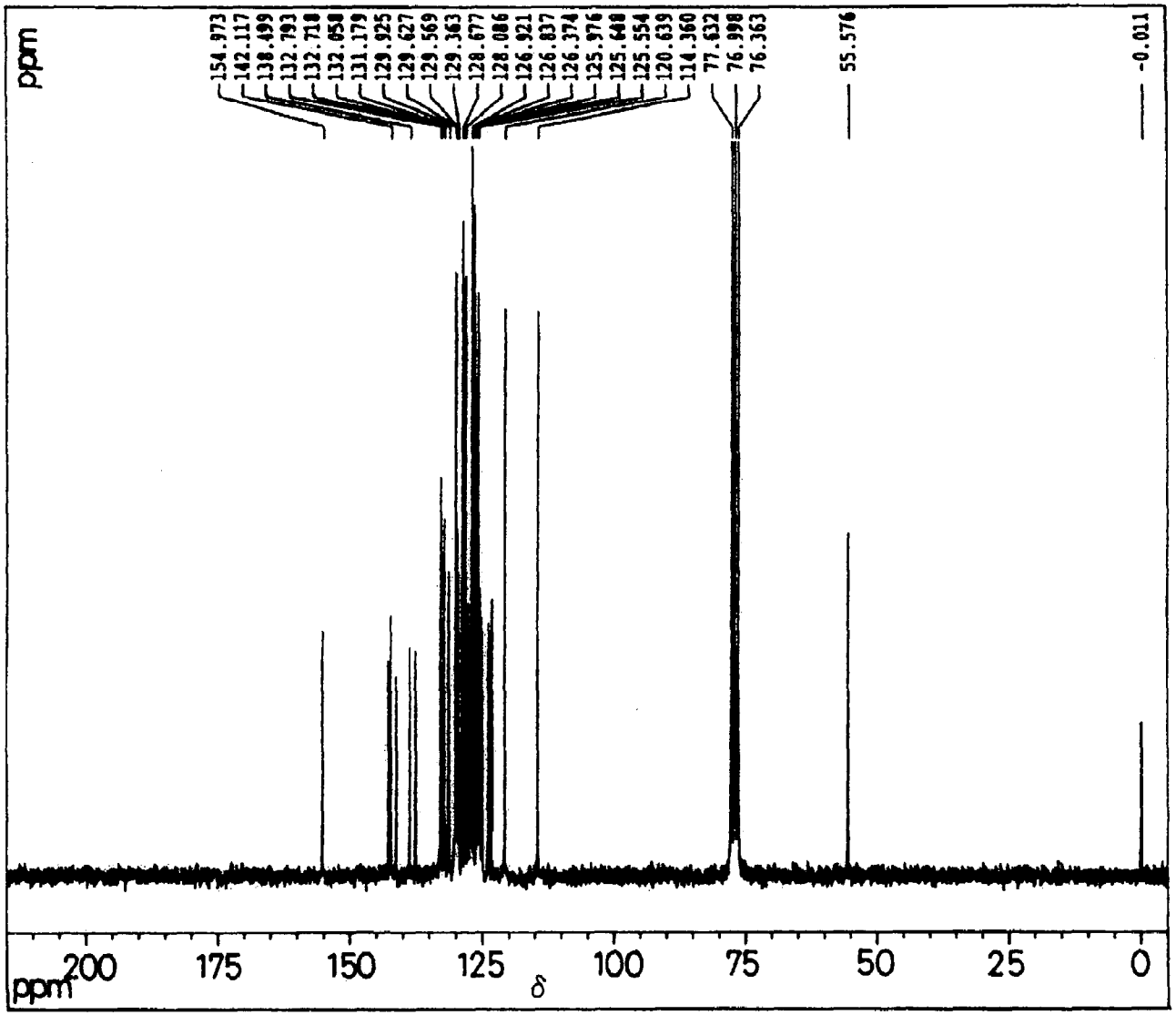
FIG. 13 is a $^{13}$C-NMR spectrum in ordinary measurement of the product in Production Example 2.
Figure 14:
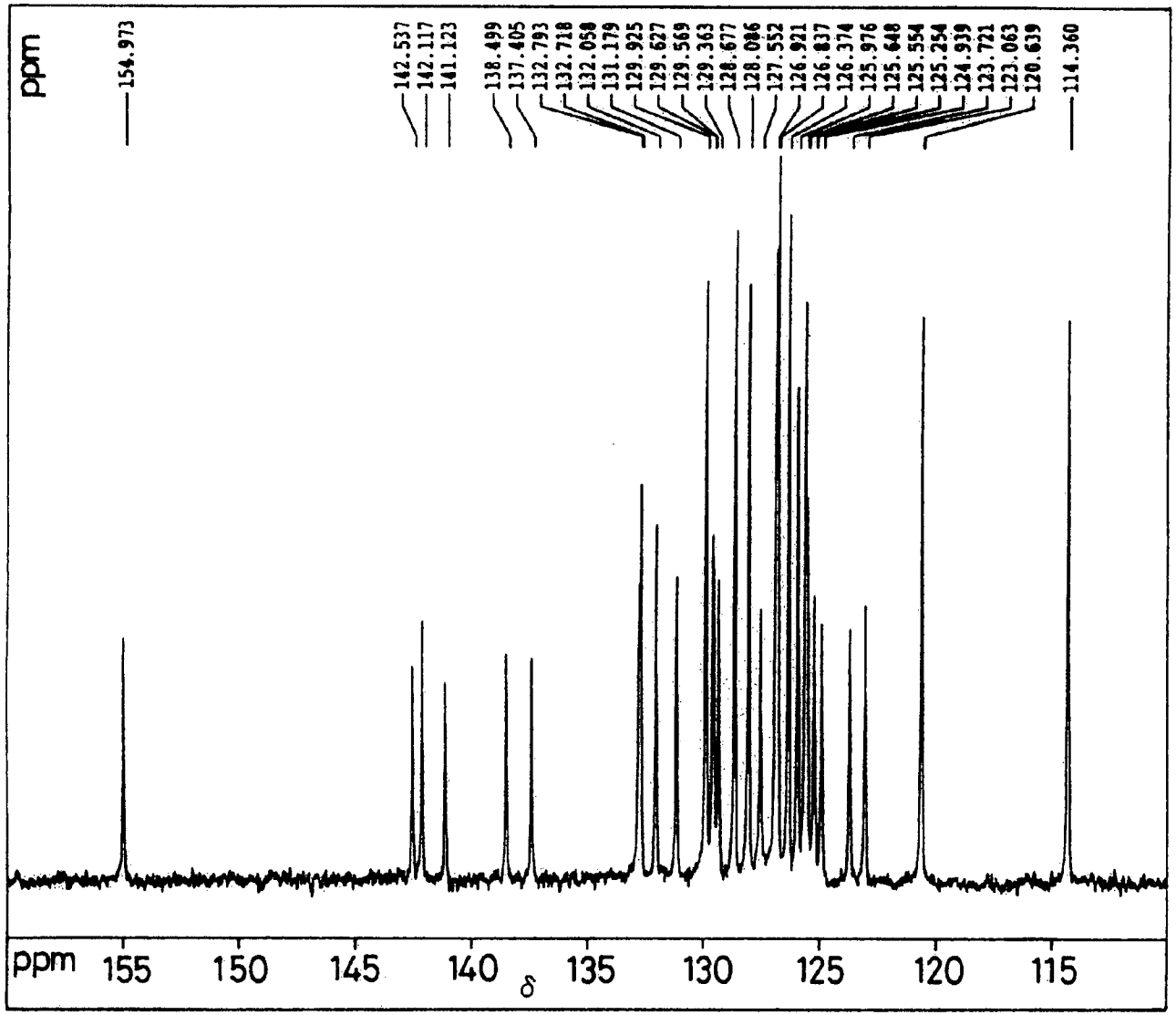
FIG. 14 is an enlarged view of the spectrum of FIG. 13 in the range of from 110 ppm to 160 ppm.
Figure 15:
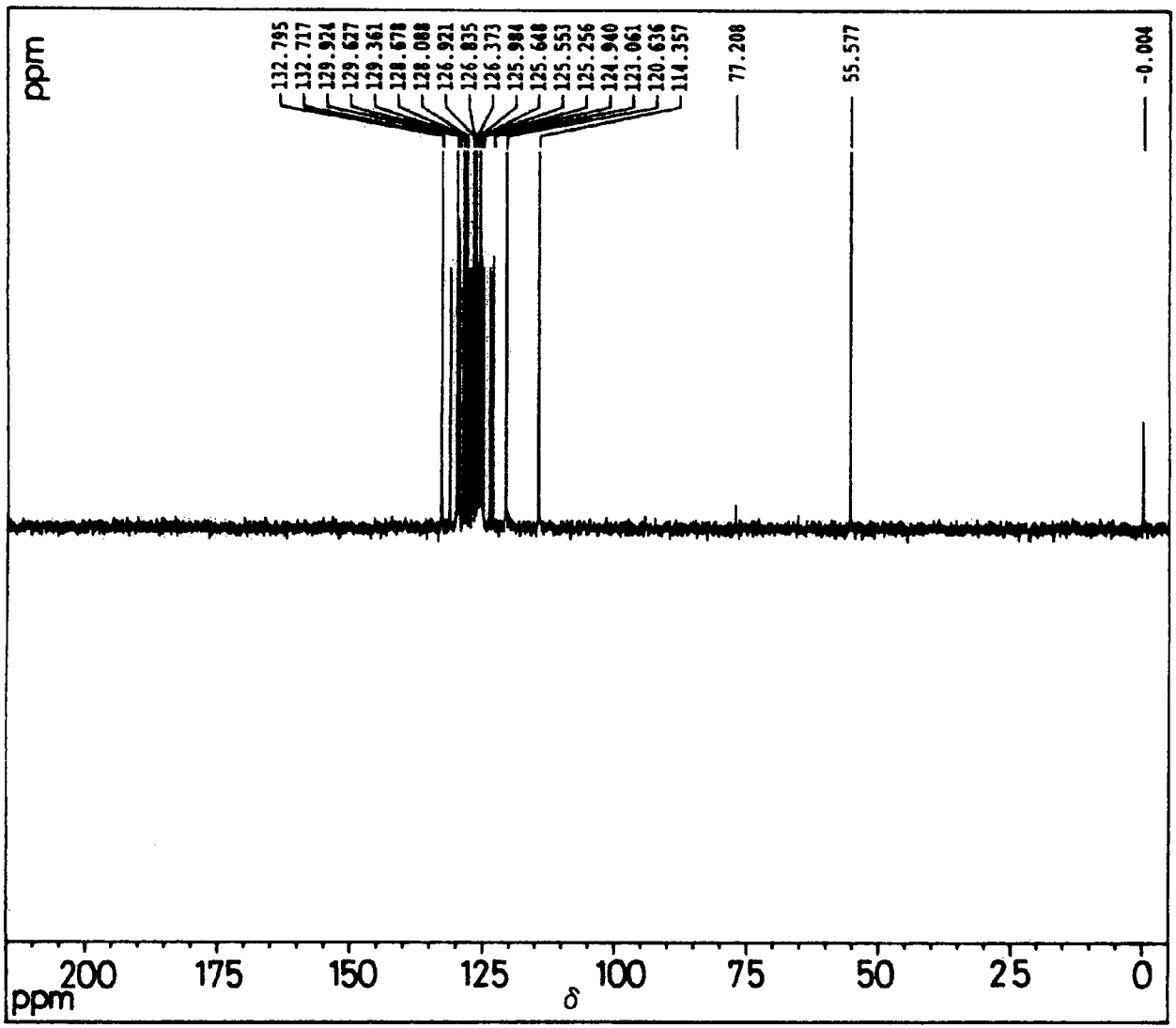
FIG. 15 is a $^{13}$C-NMR spectrum in DEPT135 measurement of the product in Production Example 2.
Figure 16:
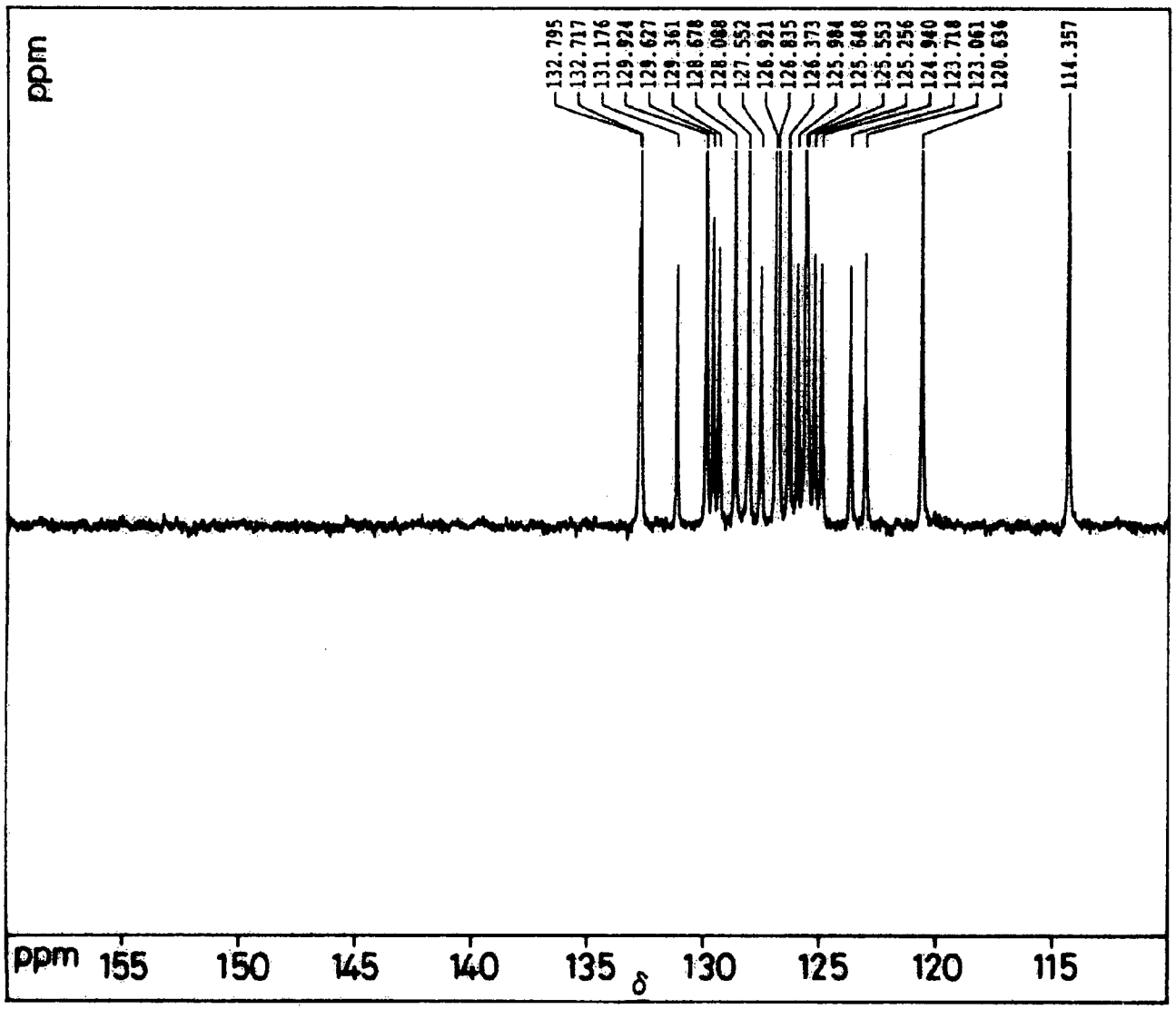
FIG. 16 is an enlarged view of the spectrum of FIG. 15 in the range of from 110 ppm to 160 ppm.
Figure 17:
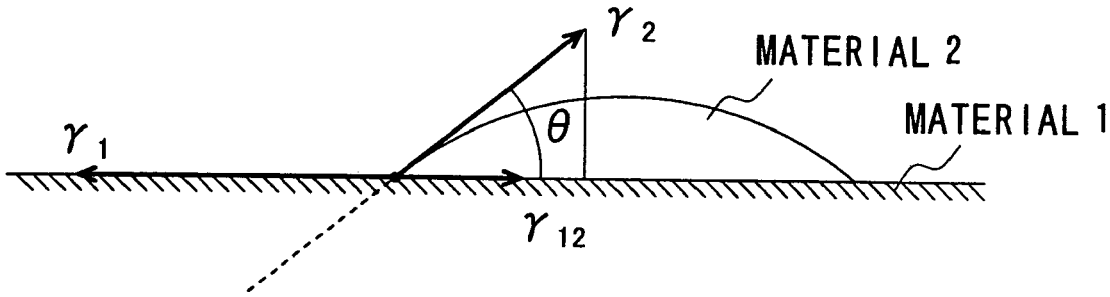
FIG. 17 is a side elevational view illustrating a state of adhesion wettability.

The NMR spectrum of the compound in heavy chloroform ($CDCl_3$) was measured, and this spectrum supports the structure of the enamine compound, Compound No. 61. FIG. 11 is the $^1$H-NMR spectrum of the product in this Production Example 2, and FIG. 12 is an enlarged view of the spectrum of FIG. 11 in the range of from 6 ppm to 9 ppm. FIG. 13 is the $^{13}$C-NMR spectrum in ordinary measurement of the product in Production Example 2, and FIG. 14 is an enlarged view of the spectrum of FIG. 13 in the range of from 110 ppm to 160 ppm. FIG. 15 is the $^{13}$C-NMR spectrum in DEPT135 measurement of the product in Production Example 2, and FIG. 16 is an enlarged view of the spectrum of FIG. 15 in the range of from 110 ppm to 160 ppm. In FIG. 11 to FIG. 16, the horizontal axis indicates the chemical shift 6 (ppm) of the compound analyzed. In FIG. 11 and FIG. 12, the data written between the signals and the horizontal axis are relative integral values of the signals based on the integral value, 3, of the signal indicated by the reference numeral 501.

The data of LC-MS and the NMR spectrometry confirm that the compound obtained herein is the enamine compound, Compound No. 61 (yield: 92%). In addition, the data of LC-MS further confirm that the purity of the enamine compound, Compound No. 61 obtained herein is 99.0%.

As in the above, the three-stage reaction process that comprises dehydrating condensation, Vilsmeier reaction and Wittig-Horner reaction gives the enamine compound, Compound No. 61 shown in Table 9, and the overall three-stage yield of the product was 73.5%.

Production Example 3

Production of Compound No. 46

2.0 g (1.0 equivalent) of the enamine-aldehyde intermediate represented by formula (11) obtained in Production Example 1-2, and 1.53 g (1.2 equivalents) of a Wittig reagent of the following structural formula (13) were dissolved in 15 ml of anhydrous DMF, and 0.71 g (1.25 equivalents) of potassium t-butoxide was gradually added to the solution at room temperature, then heated up to 50° C., and stirred for 5 hours while kept heated at 50° C. The reaction mixture was left cooled, and poured into excess methanol. The deposit was collected, and dissolved in toluene to prepare a toluene solution thereof. The toluene solution was transferred into a separating funnel and washed with water, and the organic layer was taken out. Thus taken out, the organic layer was dried with magnesium sulfate. Solid matter was removed from the thus-dried organic layer, which was then concentrated and subjected to silica gel column chromatography to obtain 2.37 g of an yellow crystal.

(13)

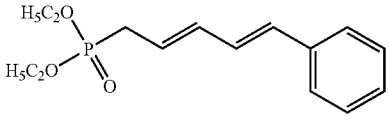

Thus obtained, the crystal was analyzed through LC-MS, which gave a peak at 566.4 corresponding to the molecular ion $[M+H]^+$ of the intended enamine compound, Compound No. 46 in Table 7 (calculated molecular weight: 565.28) with a proton added thereto. This confirms that the crystal obtained herein is the enamine compound, Compound No. 46 (yield: 92%). In addition, the data of LC-MS further confirm that the purity of the enamine compound, Compound No. 46 is 99.8%.

As in the above, the Wittig-Horner reaction of the enamine-aldehyde intermediate represented by formula (11) and the Wittig reagent represented by formula (13) gives the enamine compound, Compound No. 46 shown in Table 7.

Comparative Production Example 1

Production of Compound of Structural Formula (14)

2.0 g (1.0 equivalent) of the enamine-aldehyde intermediate represented by formula (11) obtained in Production Example 1-2 was dissolved in 15 ml of anhydrous THF, and 5.23 ml (1.15 equivalents) of a THF solution of a Grignard reagent, allyl magnesium bromide prepared from allyl bromide and metal magnesium (molar concentration: 1.0 mol/liter) was gradually added to the solution at 0° C. This was stirred at 0° C. for 0.5 hours, and then checked for the reaction progress through thin-layer chromatography, in which no definite reaction product was confirmed but some different products were found. This was post-processed, extracted and concentrated in an ordinary manner. Then, the reaction mixture was isolated and purified through silica gel column chromatography.

However, the intended compound of the following structural formula (14) could not be obtained.

(14)

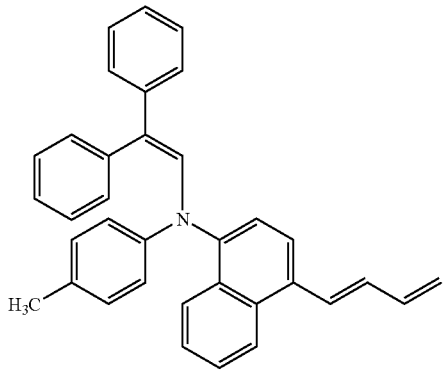

EXAMPLE

The invention is to be described by way of examples. At first description is to be made for photoreceptors provided as examples and comparative examples by forming photosensitive layers under various conditions on conductive base bodies each made of aluminum of 30 mm diameter and 340 mm length.

Example 1

7 parts by weight of titanium oxide (TTO 55A: manufactured by ISHIHARA SANGYO KAISHA LTD.) and 13 parts by weight of copolymerized nylon (CM8000, manufactured by Toray Industries Inc.) were added to a solvent mixture of 159 parts by weight of methanol and 106 parts by weight of 1,3-dioxolane, and applied with a dispersing treatment for 8 hours by a paint shaker to prepare a coating liquid for intermediate layer. The coating liquid was filled in a coating vessel, to which the conductive base body was dipped, and then pulled up and dried spontaneously to form an intermediate layer of 1 μm thickness.

Then, 2 parts by weight of crystalline oxotitanium phthalocyanine crystals showing a distinct diffraction peak at least at a Bragg angle 2θ (error: 2θ±0.2°) of 27.2° in an x-ray diffraction spectrum to Cu—Kα characteristic X-rays (wavelength: 1.54 Å) as the charge-generating substance, 1 part by weight of a butyral resin (Esrec BM-2, manufactured by Sekisui Chemical Co. Ltd.) and 97 parts by weight of methyl ethyl ketone were mixed, and dispersed by a paint shaker to prepare a coating liquid for a charge-generating layer. The coating liquid was coated on the previously formed intermediate layer by the same dip coating method as in the case of the intermediate layer and dried spontaneously to form a charge-generating layer of 0.4 μm thickness.

Then, 5 parts by weight of the enamine compound of Exemplified Compound No. 1 as the charge-transporting substance shown in Table 1, 2.4 parts by weight of polyester resin VYLON 290 (manufactured by Toyobo Co.) and 5.6 parts by weight of polycarbonate G 400 (Idemitsu Kosan Co. Ltd.) as the binder resin and 0.05 parts by weight of Smilizer BHT (manufactured by Sumitomo Chemical Co. Ltd.) as an antioxidant were mixed to prepare a coating liquid for charge transpiration layer by using 47 parts by weight of tetrahydrofuran as a solvent. The coating liquid was coated on the previously formed charge-generating layer by a dip coating method and dried at a temperature of 130° C. for 1 hour to form a charge-transporting layer of 28 μm thickness. As described above, the photoreceptor of Example 1 was prepared.

Examples 2 to 6

Photoreceptors of Examples 2 to 6 were prepared in the same manner as in Example 1 except for using the enamine compound of Exemplified Compound No. 3 shown in Table 1, Exemplified Compound No. 61 shown in Table 9, Exemplified Compound No. 106 in Table 16 and Exemplified Compound No. 146 shown in Table 21 and Exemplified Compound No. 177 shown in FIG. 26, instead of the enamine compound of Exemplified Compound No. 1, as the charge-transporting substance in the formation of the charge-transporting layer.

Example 7

A photoreceptor of Example 7 was prepared in the same manner as in Example 1 except for using only 8.0 parts by weight of polycarbonate resin G400 (manufactured by Idemitsu Kosan Co. Ltd.) as the binder resin in the formation of the charge-transporting layer.

Example 8

A photoreceptor of Example 8 was prepared in the same manner as in Example 1 except for using two kinds of polycarbonate resins, i.e., 4.0 parts by weight of G400 (manufactured by Idemitsu Kosan Co. Ltd.) and 4.0 parts by weight of GF503 (manufactured by Idemitsu Kosan Co. Ltd.) as the binder resin in the formation of the charge-transporting layer.

Examples 9, 10

An intermediate layer and a charge-generating layer were formed in the same manner as in Example 1. Then, a coating liquid for charge-transporting layer was prepared in the same manner as in Example 1 except for using polytetrafluoroethylene (PTFE) which is a resin having a low surface free energy (γ) instead of a portion of the polycarbonate resin in the formation of the charge-transporting layer. The coating liquid was coated on a previously formed charge-generating layer by a dip coating method, dried at a temperature of 120° C. for 1 hour to form a charge-transporting layer of 28 μm thickness. As described above, the photoreceptors of Example 9 and Example 10 were prepared.

The photoreceptors of Example 9 and Example 10 were each prepared so that the content ratio of PTFE in the coating liquid for charge-transporting layer in the photoreceptor of Example 10 was greater than that of the photoreceptor of Example 9, and γ of the photoreceptor of Example 10 was smaller than γ of the photoreceptor of Example 9.

Comparative Example 1

A photoreceptor of Comparative Example 1 was prepared in the same manner as in Example 1 except for using an enamine compound represented by the following structural formula (15) (hereinafter referred to as Comparative Compound A) instead of the enamine compound of the Exemplified Compound No. 1 as the charge-transporting substance. Comparative Compound A corresponds to a compound in which the naphthylene group bonded to the nitrogen atom (N) constituting the enamine skeleton in the general formula (1) is substituted with other arylene group.

(15)

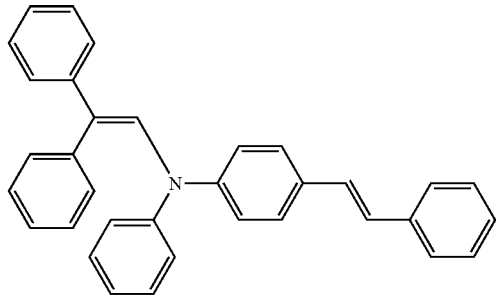

Comparatives Example 2

A photoreceptor of Comparative Example 2 was prepared in the same manner as in Example 1 except for using an enamine compound represented by the following structural formula (16) (hereinafter referred to as Comparative Compound B) instead of the enamine compound of the exemplified compound No. 1 as the charge-transporting substance. Comparative Compound B corresponds to a compound, in which n is 0 and $Ar^3$ represents a group other than a heterocyclic group in the general formula (1).

(16)

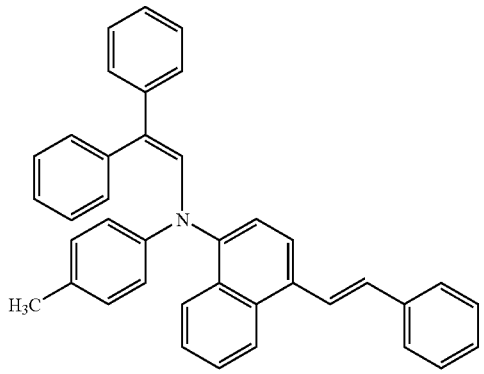

Comparative Example 3

A photoreceptor of Comparative Example 3 was prepared in the same manner as in Example 1 except for using a enamine compound represented by the following structural formula (17) (hereinafter referred to as Comparative Compound C) instead of the enamine compound of Exemplified Compound No. 1 as the charge-transporting substance. Comparative Compound C corresponds to a compound in which the naphthylene group bonded to the nitrogen atom (N) constituting the enamine skeleton is substituted other arylene group in the general formula (1).

(17)

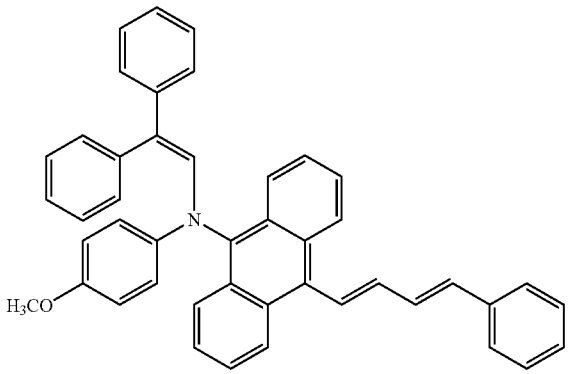

Comparative Example 4

An intermediate layer and a charge-generating layer were formed in the same manner as in Example 1. Then, a coating liquid for charge-transporting layer was prepared in the same manner as in Example 1 except for using triphenylamine dimmer (abbreviated expression: TPD) represented by the following structural formula (18) instead of the enamine compound of the exemplified compound No. 1 as the charge-transporting substance. The coating liquid was coated on the previously formed charge-generating layer by a dip-coating method, and dried at a temperature of 120° C. for 1 hour to form a charge-transporting layer of 28 μm thickness. As described above, the photoreceptor of Comparative Example 4 was prepared. TPD represented by the following structural formula (18) was hereinafter referred to as Comparative Compound D.

(18)

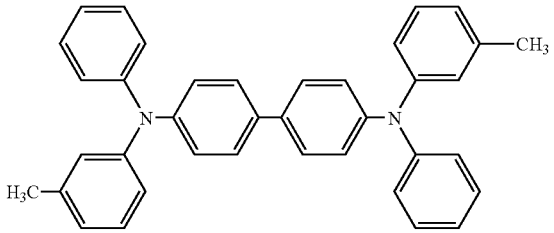

Comparative Example 5

A photoreceptor of Comparative Example 5 was prepared in the same manner as in Example 1 except for using a butadiene compound represented by the structural formula (19) (hereinafter referred to as Comparative Compound E) instead of the enamine compound of Exemplified Compound No. 1 as the charge-transporting substance in the formation of the charge-transporting layer.

(19)

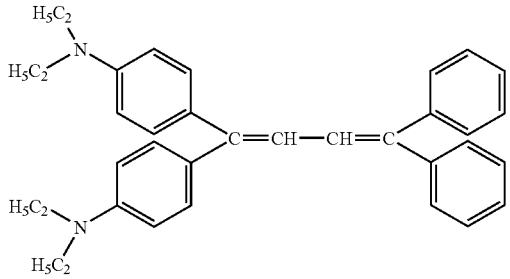

Comparative Example 6

An intermediate layer and a charge-generating layer were formed in the same manner as in Example 1. Then, a coating liquid for charge-transporting layer was prepared in the same manner as in Example 1 except for using 1.6 parts by weight of polyester resin VYLON 290 (manufactured by Toyobo Co.), two kinds of polycarbonate resins i.e., 2.4 parts by weight of G400 (manufactured by Idemitsu Kosan Co. Ltd.) and 4 parts by weight of TS 2020 (manufactured by Teijin Chemicals Ltd.) as the binder resin. The coating liquid was coated on the previously formed charge-generating layer by a dip coating method, dried at a temperature of 120° C. for 1 hour to form a charge-transporting layer at 28 μm thickness. As described above, the photoreceptor of Comparative Example 6 was prepared.

Comparative Example 7

A photoreceptor of Comparative Example 7 was prepared in the same manner as in Example 1 except for using only 8.0 parts by weight of polycarbonate resin TS2050 (manufactured by Teijin Kasei Co. Ltd.) as the binder resin in the formation of the charge-transporting layer.

Comparative Example 8

A photoreceptor of Comparative Example 8 was prepared in the same manner as in Example 1 except for using only 8.0 parts by weight of polycarbonate resin J500 (manufactured by Idemitsu Kosan Co. Ltd.) as the binder resin in the formation of the charge-transporting layer.

Comparative Example 9

An intermediate layer and a charge-generating layer were formed in the same manner as in Example 1. Then, a coating liquid for charge-transporting layer was prepared in the same manner as in Example 1 except for using polytetrafluoroethylene (PTFE) which is a resin having a low surface free energy (γ) instead of a portion of the polycarbonate resin in the formation of the charge-transporting layer. The coating liquid was coated on the previously formed charge-generating layer by a dip coating method and dried at a temperature of 120° C. for 1 hour to form a charge-transporting layer of 28 μm thickness. As described above, the photoreceptor of Comparative Example 9 was prepared.

As described above, in the preparation of each of the photoreceptors of Examples 1 to 10 and Comparative Examples 1 to 9, the kind of the charge transpiration substance and the kind and the content of the binder resin contained in the coating liquid for charge-transporting layer, were changed, and the drying temperature after the coating was changed, thereby controlling the surface free energy (γ) on the surface of the photoreceptor to a desired value. γ on the surface of the photoreceptor of Examples 1 to 10 and Comparative Examples 1 to 9 was determined by a contact angle measuring instrument CA-X (manufactured by Kyowa Kaimen Co.) and an analysis soft EG-11 (manufactured by Kyowa Kaimen Co. Ltd.).

The photoreceptors of Examples 1 to 10 and Comparative Examples 1 to 9 were mounted respectively to a test copying machine modified from a commercial digital copying machine AR-450 (manufactured by Sharp Co. Ltd.) such that the number of rotation of a photoreceptor was 65.5 rpm and the time from the exposure by a laser light to the development was 60 msec, and an evaluation test was conducted for the cleaning property, the stability of image quality, the surface roughness and the electric characteristics for each of the photoreceptors. The digital copying machine AR-450 is a negatively charged type image forming apparatus of charging the surface of a photoreceptor by a negatively charging process. Then, description is to be made to the evaluation method for each of performances.

Cleaning Property

Evaluation for the cleaning property was conducted under each of the circumstances, that is, under a Normal Temperature/Normal Humidify, N/N) circumstance at a temperature of 25° C. and at a relative humidity of 50%, and under a Low Temperature/Low Humidity (L/L) circumstance at a temperature of 5° C. and at a relative humidify of 20%, as described below.

The abutting pressure at which the cleaning blade of a cleaner equipped to a test copying machine abuts against a photoreceptor, i.e., a so-called cleaning blade pressure, was controlled to 21 gf/cm of an initial linear pressure. Using the copying machine, a character test original at 6% printing ratio was formed on test paper SF-4AM3 (manufactured by Sharp Corporation), which was used as images for evaluation at an initial stage. Then, after forming the character test original to 100,000 sheets of test paper, character test images were formed to test paper, and used as images for evaluation after forming 100,000 sheets of images. In this example, the character test original and the test paper were used in common also in other evaluation tests to be described later.

By visual observation of images for evaluation in the initial stage and after image formation of 100,000 sheets, the sharpness at the boundary between black and white two colors and the presence or absence of black streaks caused by the toner leakage in the rotational direction of the photoreceptor were tested. Further, the amount of fogging Wk was determined by an instrument to be described later thereby evaluating the cleaning property. The amount of fogging Wk for the images used for evaluation was determined by measuring the reflection density using a Z-Σ90 COLOR MEASURING SYSTEM manufactured by Nippon Denshoku Industries Co. Ltd. At first, an average reflection density Wr of the test paper before forming images was measured. Then, images used for evaluation were formed on the test paper and, after image formation, the reflection density was measured for each white portion of the test paper. Wk determined according to the following formula: $\{100\times(Wr-Ws)/Wr\}$ based on Wr described above, and the reflection density Ws for a portion judged to suffer from most fogging, namely the, most dense portion, while this was a white background portion, was defined as the amount of fogging.

The criteria of the cleanability are as follows.

◎: very good with good sharpness and no black streak. The fog amount Wk is less than 3%.

○: good with good sharpness and no black streak. The fogging amount Wk is at least 3% and less than 5%.

Δ: no problem in practical use. Sharpness is at a level which is not problematic in practical use, and a length of black streak is 2.0 mm or less and the number of black streaks is 5 or less. The fogging amount Wk is at least 5% and less than 10%.

x: actually unusable. Sharpness is problematic in practical use. Black streak exceeds the range of Δ. The fogging amount Wk is 10% or more.

Stability of Picture Quality

An evaluation test for the stability of the picture quality was conducted by forming images for 100,000 sheets in the same manner as in the evaluation for the cleaning property described above, and measuring the reflection density Dr at printed portions of the test paper with respect to the images used for evaluation in the initial stage and after forming images for 100,000 sheets by using Machbes RD 918 manufactured by Sakata Inx Corporation. ΔD determined according to the following equation: $(Dr-Ds=\Delta D)$ based on the reflection density Dr and the specified aimed lowest reflection density Ds was defined as the guaranteed image density level, and the stability of the picture quality was evaluated by the quarantined image density level ΔD.

The evaluation standards for the stability of the picture quality are as follows.

◎: very good. ΔD is 0.3 or more

○: good. ΔD is 0.1 or more and less than 0.3

Δ: somewhat poor. ΔD is −0.2 or more and less than 0.1 x: poor. ΔD is larger than −0.2 in the negative direction.

Surface Roughness

Images were formed for 100,000 sheets in the same manner as in the evaluation of the cleaning property and, after the completion of the image formation, the maximum height Rmax according to Japanese Industrial Standards (JIS) B0601 for the surface of photoreceptor was measured by using SurfCom 570A manufactured by Tokyo Seimitsu Co. Ltd. Those with smaller maximum height Rmax after the completion of image formation were evaluated as being excellent in the durability.

Electric Characteristics

A developing device was detached from the test copying machine and, instead, a surface potential meter (model 344, manufactured by Trek Japan Co.) was disposed to the developing position. By using the copying machine, the surface potential of the photoreceptor in a case of not applying exposure by a laser light was measured as a charged potential V0 (V) under a Normal temperature/Normal humidity (N/N) circumstance at a temperature of 25° C. and at a relative humidity of 50%. Further, the surface potential of a photoreceptor in a case of applying exposure by the laser light was measured as an exposure potential VL(V), and it was defined as the exposure potential $VL_N$ under the N/N circumstance. As the absolute value for the charged potential V0 was larger, it was evaluated that the chargeability was more excellent. As the absolute value for the exposure potential $VL_N$ was smaller, it was evaluated that the light responsiveness was more excellent.

Further, under a Low temperature/Low humidity (L/L) circumstance at a temperature of 5° C. and at a relative humidity of 20%, the exposure potential VL(V) was measured in the same manner as under the N/N circumstance, and it was defined as the exposure potential $VL_L$ under the L/L circumstance. The absolute value for the difference between the exposure potential $VL_N$ under the N/N circumstance and the exposure potential $VL_L$ under the L/L circumstance was determined as: potential fluctuation $\Delta VL(=|VL_L-VL_N|)$. As the potential fluctuation ΔVL was smaller, it was judged to be more excellent in the circumstantial stability.

Evaluation Result

Among the results for the evaluation of the cleaning property, the stability of the picture quality and the surface roughness, the result of evaluation under the N/N circumstance is shown in Table 33 while the result of evaluation under the L/L circumstance is shown in Table 34. Further, the result of evaluation for the electric characteristics is shown in Table 35. Table 33 to Table 35 also show the result of measurement for the surface free energy (γ) on the surface of the photoreceptor together.

TABLE 33

| | | | | Under N/N circumstance | | | | |
|---|---|---|---|---|---|---|---|---|
| | | | | Cleaning property | | Stability of image | | Surface roughness Rmax (μm) |
| | | Charge-transporting substance | γ (mN/m) | Initial stage | After 100,000 sheets | Initial state | After 100,000 sheets | After 100,000 sheets |
| Example | 1 | Exemplified compound No. 1 | 28.5 | ◎ | ◎ | ◎ | ◎ | 0.48 |
| | 2 | Exemplified compound No. 3 | 29.1 | ◎ | ◎ | ◎ | ◎ | 0.51 |
| | 3 | Exemplified compound No. 61 | 28.3 | ◎ | ◎ | ◎ | ◎ | 0.52 |
| | 4 | Exemplified compound No. 106 | 28.8 | ◎ | ◎ | ◎ | ◎ | 0.55 |
| | 5 | Exemplified compound No. 146 | 29.5 | ◎ | ◎ | ◎ | ◎ | 0.50 |
| | 6 | Exemplified compound No. 177 | 28.8 | ◎ | ◎ | ◎ | ◎ | 0.45 |
| | 7 | Exemplified compound No. 1 | 34.2 | ◎ | ◎ | ◎ | ◎ | 0.56 |
| | 8 | Exemplified compound No. 1 | 30.1 | ◎ | ◎ | ◎ | ◎ | 0.49 |
| | 9 | Exemplified compound No. 1 | 25.0 | ◎ | ○ | ◎ | ◎ | 0.60 |
| | 10 | Exemplified compound No. 1 | 21.4 | ◎ | ○ | ◎ | ◎ | 0.69 |
| Comparative Example | 1 | Comparative compound A | 28.1 | ◎ | ◎ | ◎ | ◎ | 0.47 |
| | 2 | Comparative compound B | 28.4 | ◎ | ◎ | ○ | ○ | 0.49 |
| | 3 | Comparative compound C | 28.5 | ◎ | ◎ | Δ | Δ | 0.55 |
| | 4 | Comparative compound D | 28.0 | ◎ | ◎ | ○ | ○ | 0.49 |
| | 5 | Comparative compound E | 28.2 | ◎ | ◎ | ◎ | ◎ | 0.51 |
| | 6 | Exemplified compound No. 1 | 36.1 | ◎ | Δ | ◎ | ◎ | 0.92 |
| | 7 | Exemplified compound No. 1 | 41.7 | ○ | X | ◎ | ○ | 1.65 |
| | 8 | Exemplified compound No. 1 | 46.2 | ○ | X | ◎ | Δ | 2.24 |
| | 9 | Exemplified compound No. 1 | 19.5 | Δ | X | ◎ | ◎ | 0.75 |

TABLE 34

| | | Charge-transporting substance | γ (mN/m) | Under L/L circumstance: Cleaning property: initial stage | Cleaning property: After 100,000 sheets | Stability of image: Initial stage | Stability of image: After 100,000 sheets | Surface roughness max (μm) After 100,000 sheets |
|---|---|---|---|---|---|---|---|---|
| Example | 1 | Exemplified compound No. 1 | 28.5 | ◎ | ◎ | ◎ | ◎ | 0.54 |
| | 2 | Exemplified compound No. 3 | 29.1 | ◎ | ◎ | ◎ | ◎ | 0.56 |
| | 3 | Exemplified compound No. 61 | 28.3 | ◎ | ◎ | ◎ | ◎ | 0.58 |
| | 4 | Exemplified compound No. 106 | 28.8 | ◎ | ◎ | ◎ | ◎ | 0.60 |
| | 5 | Exemplified compound No. 146 | 29.5 | ◎ | ◎ | ◎ | ◎ | 0.57 |
| | 6 | Exemplified compound No. 177 | 28.8 | ◎ | ◎ | ◎ | ◎ | 0.52 |
| | 7 | Exemplified compound No. 1 | 34.2 | ◎ | ◎ | ◎ | ◎ | 0.61 |
| | 8 | Exemplified compound No. 1 | 30.1 | ◎ | ◎ | ◎ | ◎ | 0.58 |
| | 9 | Exemplified compound No. 1 | 25.0 | ○ | ○ | ◎ | ◎ | 0.65 |
| | 10 | Exemplified compound No. 1 | 21.4 | ○ | ○ | ◎ | ◎ | 0.72 |
| Comparative Example | 1 | Comparative compound A | 28.1 | ◎ | ◎ | X | X | 0.54 |
| | 2 | Comparative compound B | 28.4 | ◎ | ◎ | X | X | 0.55 |
| | 3 | Comparative compound C | 28.5 | ◎ | ◎ | X | X | 0.60 |
| | 4 | Comparative compound D | 28.0 | ◎ | ◎ | X | X | 0.56 |
| | 5 | Comparative compound E | 28.2 | ◎ | ◎ | X | X | 0.60 |
| | 6 | Exemplified compound No. 1 | 36.1 | ○ | X | ◎ | ○ | 1.07 |
| | 7 | Exemplified compound No. 1 | 41.7 | ○ | X | ◎ | Δ | 2.00 |
| | 8 | Exemplified compound No. 1 | 46.2 | ○ | X | ◎ | X | 2.84 |
| | 9 | Exemplified compound No. 1 | 19.5 | X | X | ◎ | ◎ | 0.77 |

TABLE 35

| | | Charge-transporting substance | γ (mN/m) | Potential characteristic (N/N): VO(V) | Potential characteristic (N/N): $VL_N$(V) | Potential fluctuation (L/L): ΔVL(V) |
|---|---|---|---|---|---|---|
| Example | 1 | Exemplified compound No. 1 | 28.5 | −655 | −80 | 50 |
| | 2 | Exemplified compound No. 3 | 29.1 | −652 | −83 | 52 |
| | 3 | Exemplified compound No. 61 | 28.3 | −650 | −85 | 52 |
| | 4 | Exemplified compound No. 106 | 28.8 | −648 | −81 | 58 |
| | 5 | Exemplified compound No. 146 | 29.5 | −653 | −75 | 55 |
| | 6 | Exemplified compound No. 177 | 28.8 | −651 | −92 | 46 |
| | 7 | Exemplified compound No. 1 | 34.2 | −655 | −84 | 48 |
| | 8 | Exemplified compound No. 1 | 30.1 | −654 | −85 | 51 |
| | 9 | Exemplified compound No. 1 | 25.0 | −648 | −80 | 50 |
| | 10 | Exemplified compound No. 1 | 21.4 | −645 | −82 | 55 |
| Comparative Example | 1 | Comparative Compound A | 28.1 | −658 | −96 | 85 |
| | 2 | Comparative Compound B | 28.4 | −658 | −110 | 88 |

TABLE 35-continued

| | Charge-transporting substance | γ (mN/m) | Potential characteristic (N/N) VO(V) | Potential characteristic (N/N) $VL_N$(V) | Potential fluctuation (L/L) ΔVL(V) |
|---|---|---|---|---|---|
| 3 | Comparative Compound C | 28.5 | −658 | −124 | 98 |
| 4 | Comparative Compound D | 28.0 | −652 | −105 | 102 |
| 5 | Comparative Compound E | 28.2 | −650 | −70 | 138 |
| 6 | Exemplified compound No. 1 | 36.1 | −655 | −83 | 55 |
| 7 | Exemplified compound No. 1 | 41.7 | −653 | −82 | 62 |
| 8 | Exemplified compound No. 1 | 46.2 | −656 | −78 | 48 |
| 9 | Exemplified compound No. 1 | 19.5 | −644 | −85 | 53 |

In the evaluation for the cleaning property shown in Table 33 and Table 34, all of the photoreceptors of Example 1 to 10 and Comparative Examples 1 to 5 having the surface free energy γ on the surface within the range of the invention, that is, within the range of from 20.0 to 35.0 mN/m were evaluated as good (○) or superior under the N/N circumstance and also under the L/L circumstance. Particularly, the photoreceptors of Examples 1 to 8 and Comparative Examples 1 to 5 having γ within the range of from 28.0 to 35.0 mN/m were evaluated as very good (◎) under the N/N circumstance and also under the L/L circumstance.

On the contrary, in the photoreceptor of Comparative Example 9 having γ less than the range of the invention, black streaks and fogging occurred frequently and the evaluation for the cleaning property was poor. This is considered to be a drawback caused by the decrease of the adhesion of the toner or the like to the photoreceptor due to the decreases of γ. That is, it is considered on one hand that the transfer ratio of the toner to the test paper was increased along with decrease of the adhesion of the toner or the like to the photoreceptor to decrease the residual toner directing to the cleaning blade and, as a result, the cleaning blade is reversed or blade skip marks were formed on the photoreceptor, which lowered the image quality such as by occurrence of black streaks. It is also considered that toner scattering is promoted along with decreases in the adhesion of the toner or the like to the photoreceptor and scattered toners were deposited to the surface or the rearface of the test paper to cause fogging of the images.

Further, while evaluation for the cleaning property to the photoreceptors of Comparative Examples 6 to 8 in which γ was more than the range of the invention was good (○) or superior at the initial stage under the N/N circumstance and also under the L/L circumstance, it was worsened after forming images for 100,000 sheets. Further, along with increase of γ, evaluation for the cleaning property was tended to be worsened. This is considered that since the adhesion of obstacles such as toners and paper dusts to the photoreceptor was increased as γ was larger, the obstacles were caught by the cleaning blade to injure the surface of the photoreceptor, and the cleaning property was worsened due to the injuries occurred on the surface of the photoreceptor. Worsening of the cleaning property was particularly remarkable under the L/L circumstance.

Then, in the evaluation for the stability of picture quality, that is, the guaranteed image density level ΔD, sufficient image density was obtained before and after the formation of images for 100,000 sheets in the case of the photoreceptors of Examples 1 to 10 and Comparative Examples 9 having γ of 35.0 mN/m or less and using the enamine compound represented by the general formula (1) as the charge-transporting substance, under the N/N circumstance and also under the L/L circumstance, and evaluation was very good (◎: ΔD 0.3 or more) in each case.

On the contrary, in the case of the photoreceptors of Comparative Examples 6 to 8 using the enamine compound represented by the general formula (1) as the charge transpiration substance but having γ exceeding 35.0 mN/m, degradation of the guaranteed image density level ΔD was recognized respectively after forming the images for 100,000 sheets. Specifically, while the evaluation was very good (◎) for the photoreceptors of Comparatives 7 and 8 in the initial stage, the guaranteed image density level ΔD was deteriorated after forming the images for 100,000 sheets, and degradation was remarkable under the L/L circumstance. Further, while the evaluation was very good (◎) for the photoreceptor of Comparative Example 6 before and after the formation of images for 100,000 sheets under the N/N circumstance, degradation of the guaranteed image density level ΔD was recognized after forming images for 1000,000 sheet under the L/L circumstance. It is considered that the degradation of the guaranteed image density level ΔD is attributable to the increase of the adhesion of obstacles to the surface of the photoreceptor along with increase of γ, and the surface roughness increases due to injuries and the like caused by the adhered obstacles. That is, it is considered for the photoreceptors of Comparative Examples 6 to 8 that since γ was large, the maximum height Rmax on the surface of the photoreceptor was large after forming the images for 100,000 sheets, that is, the surface roughness was increased by injuries or the like, and the laser light for forming images was reflected at random on the photoreceptor failing to obtain a sufficient amount of exposure to lower the image density.

Further, for the photoreceptors of Comparative Examples 1 to 5 using Comparative Compound A, B, C, D or E as the charge-transporting substance, although was γ within the range of the invention, the guaranteed image density level ΔD under the L/L circumstance was poor already from the initial stage (x: ΔD larger than −0.2 in the negative direction). This is considered that since the photoreceptors of Comparative Examples 1 to 5 had poor circumstantial stability of the electric characteristics compared with that of the photoreceptors of Examples 1 to 10 and Comparative Example 9 using the enamine compound represented by the general formula (1) according to the invention, no sufficient light responsiveness could be obtained under the L/L circumstance to result in a remarkable deterioration from the specified aimed minimum reflection density Ds before and after the formation of images for 100,000 sheets.

Then, in the evaluation for the surface roughness, it can be seen from the result of the measurement for the maximum height Rmax on the surface of the photoreceptor after the completion of the image formation for 100,000 sheets that the surface roughness is larger in the photoreceptors of Comparative Examples 6 to 8 having γ exceeding 35.0 mN/m compared with the photoreceptors of Examples 1 to 10 and Comparative Examples 1 to 5, 9 having γ of 35.0 mN/m or less. Particularly, the surface roughness was tended to be increased remarkably along with increase of γ. It has been confirmed from the foregoings that the adhesion of obstacles to the surface of the photoreceptor increases along with increase of γ and the surface roughness is increased due to injuries, etc. caused by adhered obstacles.

In the evaluation for the electric characteristics shown in Table 35, it has been found that the photoreceptors of Examples 1 to 6 and Comparative Examples 6 to 9 using the enamine compounds shown by the general formula (1) according to the invention have smaller absolute values of the exposure potential $VL_N$ and were excellent in the light responsiveness compared with the photoreceptors of Comparative Examples 1 to 4 using Comparative Compound A, B, C or D as the charge-transporting substance under the N/N circumstance. Further, it has been found that the photoreceptors of Examples 1 to 6 and Comparative Examples 6 to 9 show smaller values for the potential fluctuation ΔVL, are excellent in the circumstantial stability and have sufficient light responsiveness compared with the photoreceptors of Comparative Examples 1 to 5 using the Comparison Compound A, B, C, D or E as the charge-transporting substance under the L/L circumstance. From the foregoings, it has been confirmed that the photoreceptors of Comparative Examples 1 to 5 are inferior in the circumstantial stability of the electric characteristics to the photoreceptors of Examples 1 to 10 and Comparative Example 9, and no sufficient light responsiveness is obtained under the L/L circumstance.

As has been described above, it was possible to obtain an electrophotographic photoreceptor of excellent durability having high sensitivity, and sufficient light responsiveness, excellent in the cleaning property, and less suffering from surface injuries even during long time use and not causing degradation of the picture quality in the formed images, by incorporating the enamine compound represented by the general formula (1) as the charge-transporting substance in the photosensitive layer and setting the surface free energy on the surface of the photoreceptor to 20.0 mN/m or more and 35.0 mN/m or less, in various circumstances such as a normal temperature and normal humidity circumstance, and a low temperature and low humidity circumstance.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotograpbic photoreceptor comprising:

a conductive base body; and a photosensitive layer provided on the conductive base body, in which a uniformly charged photosensitive layer is exposed to a light according to image information to form an electrostatic latent image, wherein the photosensitive layer is an outermost layer and free from polysiloxane, and contains an enamine compound represented by the following general formula (1), and a surface free energy (γ) on a surface thereof is in a range of 20.0 mN/m or more and 35.0 mN/m or less;

(1)

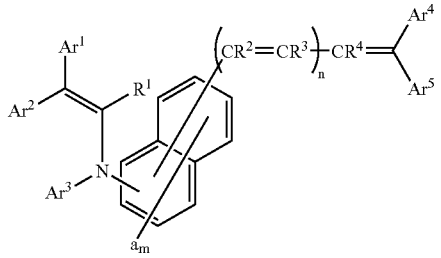

wherein $Ar^1$ and $Ar^2$ each represent an optionally-substituted aryl group or an optionally-substituted heterocyclic group; $Ar^3$ represents an optionally-substituted aryl group, an optionally-substituted heterocyclic group, an optionally-substituted aralkyl group, or an optionally-substituted alkyl group; $Ar^4$ and $Ar^5$ each represent a hydrogen atom, an optionally-substituted aryl group, an optionally-substituted heterocyclic group, an optionally-substituted aralkyl group, or an optionally-substituted alkyl group, but it is excluded that $Ar^4$ and $Ar^5$ are hydrogen atoms at the same time; $Ar^4$ and $Ar^5$ may bond to each other via an atom or an atomic group to form a cyclic structure; "a" represents an optionally-substituted alkyl group, an optionally-substituted alkoxy group, an optionally-substituted dialkylamino group, an optionally-substituted aryl group, a halogen atom, or a hydrogen atom; m indicates an integer of from 1 to 6; when m is 2 or more, then the "a"s may be the same or different and may bond to each other to form a cyclic structure; $R^1$ represents a hydrogen atom, a halogen atom, or an optionally-substituted alkyl group; $R^2$, $R^3$ and $R^4$ each represent a hydrogen atom, an optionally-substituted alkyl group, an optionally-substituted aryl group, an optionally-substituted heterocyclic group, or an optionally-substituted aralkyl group; n indicates an integer of from 0 to 3; when n is 2 or 3, then the $R^2$s may be the same or different and the $R^3$s may be the same or different, but when n is 0, $Ar^3$ is an optionally-substituted heterocyclic group.

2. The electrophotographic photoreceptor of claim 1, wherein the enamine compound represented by the general formula (1) is an enamine compound represented by the following general formula (2);

(2)

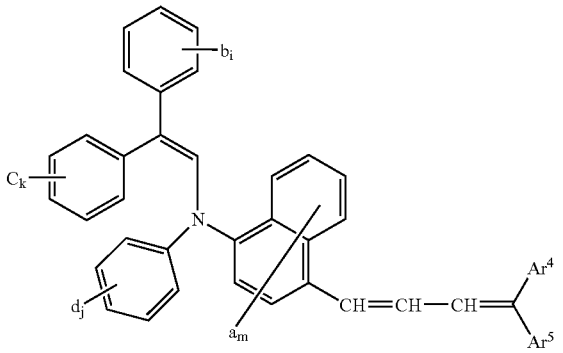

wherein b, c and d each represent an optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or mare, then the "d"s may be the same or different and may bond to each other to form a cyclic structure; $Ar^4$, $Ar^5$, "a" and "m" represent the same as those defined in formula (1).

3. The electrophotographic photoreceptor of claim 1, wherein the surface free energy (γ) is in a range of 28.0 mN/m or more and 35.0 mN/m or less.

4. The electrophotographic photoreceptor of claim 1, wherein the photosensitive layer is constituted by laminating a charge-generating layer containing a charge-generating substance and a charge-tramporting layer containing a charge-transporting substance containing an enamine compound represented by the general formula (1).

5. An image forming apparatus comprising:

the electrophotographic photoreceptor of claim 1;

charging means for charging the electrophotographic photoreceptor;

exposure means for exposing the charged electrophotographic photoreceptor to a light according to image information thereby forming an electrostatic latent image;

developing means for developing the electrostatic latent image to form a toner image;

transfer means for transferring the toner image from a surface of the electrophotographic photoreceptor to a material to be transferred; and cleaning means for cleaning the surface of the electrophotographic photoreceptor after transfer of the toner image.

* * * * *